US006351943B1

(12) United States Patent
Tagami et al.

(10) Patent No.: US 6,351,943 B1
(45) Date of Patent: Mar. 5, 2002

(54) AIR-FUEL RATIO CONTROL APPARATUS FOR EXHAUST GAS FROM INTERNAL COMBUSTION ENGINE

(75) Inventors: Hiroshi Tagami; Isao Komoriya, both of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/773,903

(22) Filed: Feb. 2, 2001

(30) Foreign Application Priority Data

Feb. 2, 2000 (JP) ..... 12-025642

(51) Int. Cl.[7] ..... F01N 3/00

(52) U.S. Cl. ..... 60/285; 60/276; 60/277; 123/679; 701/103; 701/109

(58) Field of Search ..... 60/274, 276, 277, 60/285; 123/674, 679; 701/101, 102, 103, 109, 115

(56) References Cited

U.S. PATENT DOCUMENTS

| | | | | |
|---|---|---|---|---|
| 5,190,020 A | * | 3/1993 | Cho | 123/684 |
| 5,535,135 A | * | 7/1996 | Bush et al. | 364/496 |
| 5,694,910 A | | 12/1997 | Hasegawa | |
| 5,845,490 A | | 12/1998 | Yasui et al. | |
| 5,845,491 A | | 12/1998 | Yasui et al. | |
| 5,852,930 A | | 12/1998 | Yasui et al. | |
| 5,880,952 A | | 3/1999 | Yasui et al. | |
| 5,924,281 A | | 7/1999 | Yasui et al. | |
| 6,079,205 A | | 6/2000 | Yasui et al. | |
| 6,082,099 A | | 7/2000 | Yasui et al. | |
| 6,112,517 A | | 9/2000 | Yasui et al. | |
| 6,188,953 B1 | | 2/2001 | Yasui et al. | |
| 6,195,988 B1 | | 3/2001 | Yasui et al. | |
| 6,230,486 B1 | | 5/2001 | Yasui et al. | |

FOREIGN PATENT DOCUMENTS

| | | |
|---|---|---|
| JP | 04-369471 | 12/1992 |
| JP | 05-79374 | 3/1993 |
| JP | 07-83094 | 3/1995 |
| JP | 08-21273 | 1/1996 |
| JP | 08-105345 | 4/1996 |
| JP | 11-62562 | 3/1999 |
| JP | 11-93740 | 4/1999 |
| JP | 11-93741 | 4/1999 |

OTHER PUBLICATIONS

Serial No.: 09/708,707; filed: Nov. 9, 2000; By: Yasui et al.; For: Method of Evaluating Deteriorated State of Catalytic Converter for Purifying Exhaust Gas.

Serial No.: 09/680,480; filed: Oct. 6, 2000; By: Yasui et al. For: Air–Fuel Ratio Control Apparatus for Multicylinder Internal Combustion Engine.

(List continued on next page.)

*Primary Examiner*—Thomas Denion
*Assistant Examiner*—Binh Tran
(74) *Attorney, Agent, or Firm*—Arent Fox Kintner Plotkin & Kahn, PLLC

(57) ABSTRACT

In a stoichiometric operation mode after a lean operation mode, a control unit sequentially generates data representing an estimated value of an output VO2/OUT of an $O_2$ sensor after the dead time of an exhaust system, and at the same time generates a target air-fuel ratio KCMD for an exhaust gas upstream of a catalytic converter in order to converge the estimated value to a predetermined target value. The air-fuel ratio of the exhaust gas is controlled at the target air-fuel ratio KCMD. In the stoichiometric operation mode, the reduced state of NOx in the catalytic converter is recognized based on the estimated value of the output of the $O_2$ sensor, and whether the stoichiometric operation mode is to switch to the lean operation mode or not is determined depending on the reduced state of NOx in the catalytic converter.

21 Claims, 17 Drawing Sheets

OTHER PUBLICATIONS

Serial No.: 09/680,482; filed: Oct. 6, 2000; By: Yasui et al.: For: Air–Fuel Ratio Control Apparatus for Multicylinder Internal Combustion Engine.

Serial No.: 09/748,189; Filed: Dec. 27, 2000; By: Ueno et al. For: Method of Evaluating Deteriorated State of Catalytic Converter for Purifying Exhaust Gas.

Serial No.: 09/708,679; Filed: Nov. 9, 2000; By: Yasui et al.; For: Air–Fuel Ratio Control Apparatus for Internal Combustion Engine.

Serial No.: 09/465,766; Filed: Dec. 17, 1999; By: Yasui et al. For: Plant Control System.

Serial No.: 09/465,765; Filed: Dec. 17, 1999; By: Yasui et al. For: Air–Fuel Ratio Control System for Internal Combustion Engine.

Serial No.: 09/548,931; Filed: Apr. 13, 2000; By: Yasui For: Plant Control System.

Serial No.: 09/743,906; Filed: Jan. 17, 2001; By: Yasui et al. For: Method of Determining the Deterioration of a Catalytic Converter for Purifying an Exhaust Gas.

* cited by examiner

AIR-FUEL RATIO CONTROL APPARATUS FOR EXHAUST GAS FROM INTERNAL COMBUSTION ENGINE

BACKGROUND OF THE INVENTION

1. Field of the Invention

The present invention relates to an apparatus for controlling the air-fuel ratio of an exhaust gas emitted from an internal combustion engine, and more particularly to an apparatus for controlling the air-fuel ratio of an exhaust gas that is purified by a catalytic converter of the nitrogen-oxide-absorption type that is disposed in the exhaust passage of an internal combustion engine.

2. Description of the Related Art

The applicant of the present application has proposed a technique for controlling the air-fuel ratio of an exhaust gas that enters a catalytic converter, or more specifically the air-fuel ratio of a combusted air-fuel mixture which, when burned, enters as an exhaust gas into a catalytic converter and is recognized as the concentration of oxygen in the exhaust gas, as disclosed in Japanese laid-open patent publication No. 11-93740, for example.

According to the disclosed system, an exhaust gas sensor ($O_2$ sensor) for detecting the concentration of a certain component, e.g., oxygen, of the exhaust gas that has passed through the catalytic converter is disposed downstream of the catalytic converter, and the air-fuel ratio of the exhaust gas that enters the catalytic converter is controlled depending on the output of the exhaust gas sensor, i.e., the detected value of the concentration of oxygen.

Specifically, the purifying capability of a catalytic converter, i.e., the ability of a catalytic converter to purify NOx (nitrogen oxide), HC (hydrocarbon), CO (carbon monoxide), etc. is optimum irrespectively of the deteriorated state of the catalytic converter when the air-fuel ratio of the exhaust gas that enters the catalytic converter is close to a stoichiometric air-fuel ratio and the output of the $O_2$ sensor as the exhaust gas sensor is settled to a certain output value. According to the above proposed technique, therefore, the certain output value is used as a target value for the output of the $O_2$ sensor, and the air-fuel ratio of the exhaust gas that enters the catalytic converter is controlled according to a feedback control process in order to converge the output of the $O_2$ sensor to the target value.

An exhaust system ranging from an upstream side of the catalytic converter to the $O_2$ sensor disposed downstream of the catalytic converter, i.e., a system for generating the output of the $O_2$ sensor from the air-fuel ratio of the exhaust gas that enters the catalytic converter, generally has a relatively long dead time owing to the catalytic converter included in the exhaust system. Stated otherwise, when the air-fuel ratio of the exhaust gas that enters the catalytic converter is changed, a relatively long dead time is required until the output of the $O_2$ sensor reflects the change in the air-fuel ratio. According to the above proposed technique, data representing an estimated value of the output of the $O_2$ sensor after the dead time of the exhaust system is sequentially determined. Then, a manipulated variable defining an air-fuel ratio for the exhaust gas entering the catalytic converter, i.e., a target air-fuel ratio for the exhaust gas, is sequentially generated in order to converge the estimated value of the output of the $O_2$ sensor which is represented by the above data to the target value, and the air-fuel ratio of an air-fuel mixture actually combusted by the internal combustion engine is manipulated depending on the target air-fuel ratio. In this manner, the effect of the dead time is compensated for, and the control process for converging the output of the $O_2$ sensor to the target value is stably carried out.

Some generally known internal combustion engines mounted on automobiles or the like, i.e., so-called lean-burn engines, are operated such that the air-fuel ratio of an air-fuel mixture combusted by the internal combustion engine and hence the air-fuel ratio of an exhaust gas entering a catalytic converter are controlled at a lean air-fuel ratio, which represents less fuel than at the stoichiometric air-fuel ratio, depending on operating conditions (rotational speed, intake pressure, demanded load, etc.) of the internal combustion engine in order to reduce the fuel consumption and also minimize the amount (absolute amount) of harmful gases contained in the exhaust gas.

While the internal combustion engine is being operated to control the air-fuel ratio at the lean air-fuel ratio, however, it is not possible to control the air-fuel ratio of the exhaust gas that enters the catalytic converter in order to converge the output of the $O_2$ sensor disposed downstream of the catalytic converter to the target value according to the above proposed technique. Under some operating conditions of the internal combustion engine, it is not possible or not preferable to operate the internal combustion engine to control the air-fuel ratio at the lean air-fuel ratio.

If the above proposed technique for achieving the optimum purifying capability of the catalytic converter is applied to the above internal combustion engine, then the internal combustion engine is operated in different modes including an operation. mode (hereinafter referred to as "stoichiometric operation mode") in which the air-fuel ratio of the exhaust gas that enters the catalytic converter is controlled at an air-fuel ratio close to the stoichiometric air-fuel ratio in order to converge the output of the $O_2$ sensor disposed downstream of the catalytic converter to the target value, and an operation mode (hereinafter referred to as "lean operation mode") in which the air-fuel ratio of the exhaust gas that enters the catalytic converter is controlled at a lean air-fuel ratio. Control processes of these operation modes are selectively carried out depending on operating conditions of the internal combustion engine.

While an internal combustion engine is operating in a lean operation mode, the amount of NOx contained in the exhaust gas emitted from the internal combustion engine is generally relatively large. Therefore, the internal combustion engine is combined with an NOx-absorption catalytic converter.

The NOx-absorption catalytic converter comprises a three-way catalyst and an NOx absorbent. NOx absorbents that are available includes an occlusion-type NOx absorbent for occluding NOx when the air-fuel ratio of the exhaust gas entering the catalytic converter is a lean air-fuel ratio and the oxygen concentration in the exhaust gas is relatively high, i.e., NOx in the exhaust gas is relatively high, and an adsorption-type NOx absorbent for adsorbing NOx in the exhaust gas when the air-fuel ratio of the exhaust gas entering the catalytic converter is a lean air-fuel ratio. Irrespectively of whether it is of the occlusion type or the adsorption type, an NOx adsorbent reduces NOx that has been absorbed (occluded or adsorbed) at the lean air-fuel ratio when the air-fuel ratio of the exhaust gas that enters the catalytic converter is a stoichiometric air-fuel ratio or a rich air-fuel ratio (at which the fuel is more than at the stoichiometric air-fuel ratio) and the oxygen concentration in the exhaust gas is relatively low.

More specifically, when the air-fuel ratio of the exhaust gas that enters the catalytic converter becomes a stoichiometric air-fuel ratio or a rich air-fuel ratio, the occlusion-type NOx absorbent discharges the occluded NOx, and the discharged NOx is reduced by a reducing agent such as CO, $H_2$, or the like in the exhaust gas. When the air-fuel ratio of the exhaust gas that enters the catalytic converter becomes a stoichiometric air-fuel ratio or a rich air-fuel ratio, the adsorbed NOx in the adsorption-type NOx absorbent is reduced by the reducing agent in the exhaust gas, and the reduced nitrogen gas is discharged from the NOx absorbent.

The occlusion-type NOx absorbent comprises barium oxide (BaO), and the adsorption-type NOx absorbent comprises sodium (Na), titanium (Ti), or strontium (Sr).

When the internal combustion engine with the NOx-absorption catalytic converter in the exhaust passage is operating in the lean operation mode, the amount of NOx that can be absorbed by the NOx absorbent is limited. Therefore, after the internal combustion engine has operated for a certain period of time, it is necessary to interrupt the lean operation mode and reduce NOx that has been absorbed by the catalytic converter. For example, as disclosed in Japanese laid-open patent publication No. 11-62562, if the absorption of NOx in the catalytic converter is saturated, then the air-fuel ratio is temporarily controlled at a rich air-fuel ratio, and NOx that has been absorbed by the catalytic converter is reduced.

If the internal combustion engine is operated selectively in the lean operation mode and the stoichiometric operation mode, then the internal combustion engine is operated in stoichiometric operation mode and thereafter in the lean operation mode for thereby reducing NOx that has been absorbed by the catalytic converter. That is, during the lean operation mode, the output of the $O_2$ sensor disposed downstream of the catalytic converter represents a leaner air-fuel ratio than the target value in the stoichiometric operation mode. Therefore, when the internal combustion engine switches from the lean operation mode to the stoichiometric operation mode and the process of controlling the air-fuel ratio of the exhaust gas that enters the catalytic converter in order to converge the output of the $O_2$ sensor to the target value is started, the air-fuel ratio of the exhaust gas is controlled at a rich air-fuel ratio immediately after the control process has been started. The catalytic converter can thus reduce NOx.

The catalytic converter can also reduce NOx by positively controlling the air-fuel ratio of the exhaust gas that enters the catalytic converter at a rich air-fuel ratio, as disclosed in Japanese laid-open patent publication No. 11-62562. However, such an arrangement makes the control of operation of the internal combustion engine complex because another dedicated control process separate from the control process of the stoichiometric operation mode is needed.

Under conditions in which the internal combustion engine can be operated in the lean operation mode, it is desirable to provide as many opportunities as possible for performing the control process of the lean operation mode so as to minimize the fuel consumption by the internal combustion engine. To meet such a demand, when it is necessary to interrupt the lean operation mode and perform the stoichiometric operation mode for the reduction of NOx in the catalytic converter, the period of operation of the internal combustion engine in the internal combustion engine should preferably be limited to a period that is only necessary.

When the reduction of NOx in the catalytic converter in the stoichiometric operation mode is completed, the output of the $O_2$ sensor disposed downstream of the catalytic converter changes from an output value corresponding to a lean air-fuel ratio an output value corresponding to a rich air-fuel ratio. Therefore, it is possible to recognize the time when the reduction of NOx in the catalytic converter is completed by detecting the change in the output of the $O_2$ sensor. The inventors of the present invention have attempted to limit a period in which the lean operation mode is interrupted (inhibited) for reducing NOx to a period until the above change in the output of the $O_2$ sensor disposed downstream of the catalytic converter is detected.

However, as described above, the exhaust system including the catalytic converter has a relatively long dead time. Consequently, the above change in the output of the $O_2$ sensor is caused by the control in the stoichiometric operation mode of the air-fuel ratio of the exhaust gas upstream of the catalytic converter up to a time prior to the dead time. Therefore, the control process of the stoichiometric operation mode in a period between the time when the change in the output of the $O_2$ sensor is detected and the time which is earlier than the above time by the dead time, is not necessary for reducing NOx in the catalytic converter. Stated otherwise, for reducing NOx, the lean operation mode is interrupted and the stoichiometric operation mode is performed for the unnecessarily long period of time. The unnecessarily long period of time presents an obstacle to an effort to reduce the fuel consumption by the internal combustion engine and the amount of harmful gases contained in the exhaust gas.

The NOx absorbent of the NOx-absorption catalytic converter is gradually deteriorated as the internal combustion engine is operated for a longer period of time, and as the deterioration of the NOx absorbent progresses, the amount of NOx that can be absorbed thereby in the lean operation mode is reduced. Therefore, when the catalytic converter is deteriorated to a certain degree, it is desirable to evaluate the deteriorated state of the catalytic converter for replacing the catalytic converter or otherwise treating the catalytic converter. The inventors have attempted to determine an integrated amount (or an equivalent thereof) of reducing agents (HC, CO, $H_2$, etc.) for NOx that are given via the exhaust gas to the catalytic converter after the reduction of NOx in the stoichiometric operation mode is started until the above change in the output of the $O_2$ sensor disposed downstream of the catalytic converter is detected, i.e., until the reduction of NOx in the catalytic converter is completed, and evaluate the deteriorated state of the catalytic converter based on the determined integrated amount.

However, because the reducing agent in the exhaust gas given to the catalytic converter in the control process of the stoichiometric operation mode during the period between the time when the change in the output of the $O_2$ sensor is detected and the time which is earlier than the above time by the dead time does not substantially contribute to the reduction of NOx, it has been difficult to appropriately evaluate the deteriorated state of the catalytic converter.

SUMMARY OF THE INVENTION

It is therefore an object of the present invention to provide an apparatus for controlling the air-fuel ratio of an exhaust gas emitted from an internal combustion engine, the apparatus being capable of limiting a period in which NOx absorbed by an NOx-adsorption catalytic converter is reduced during operation of the internal combustion engine in a lean operation mode to a short period that is necessary for thereby providing as many opportunities as possible for operating the internal combustion engine in the lean operation mode and hence further reducing the fuel consumption by the internal combustion engine and the amount of harmful gases contained in an exhaust gas emitted from the internal combustion engine.

Another object of the present invention is to provide an apparatus for controlling the air-fuel ratio of an exhaust gas emitted from an internal combustion engine, the apparatus being capable of appropriately evaluating the deteriorated state of a catalytic converter.

To achieve the above objects, there is provided in accordance with the present invention an apparatus for controlling the air-fuel ratio of an exhaust gas from an internal combustion engine, comprising a catalytic converter disposed in an exhaust passage of the internal combustion engine, for absorbing a nitrogen oxide in the exhaust gas when the air-fuel ratio of the exhaust gas flowing from an upstream side into the catalytic converter is a lean air-fuel ratio, and reducing the absorbed nitrogen oxide with a reducing agent in the exhaust gas when the air-fuel ratio of the exhaust gas is a stoichiometric air-fuel ratio or a rich air-fuel ratio, an exhaust gas sensor disposed downstream of the catalytic converter for detecting the concentration of a particular component in the exhaust gas which has passed through the catalytic converter, estimating means for sequentially generating data representing an estimated value of an output of the exhaust gas sensor after a dead time of an exhaust system which ranges from the upstream side of the catalytic converter to the exhaust gas sensor and includes the catalytic converter, control means for using a predetermined output value of the exhaust gas sensor when the air-fuel ratio of the exhaust gas entering the catalytic converter is close to the stoichiometric air-fuel ratio, as a target value for the output of the exhaust gas sensor, and selectively executing a control process in a stoichiometric operation mode for controlling the air-fuel ratio of the exhaust gas entering the catalytic converter in order to converge the estimated value, represented by the data generated by the estimating means, of the output of the exhaust gas sensor to the target value and a control process in a lean operation mode for controlling the air-fuel ratio of the exhaust gas entering the catalytic converter at the lean air-fuel ratio, the arrangement being such that the control means executes the control process in the stoichiometric operation mode after executing the control process in the lean operation mode to perform a reducing process to reduce the nitrogen oxide in the catalytic converter, and reduced-state recognizing means for sequentially recognizing a reduced state of the nitrogen oxide in the catalytic converter based on data generated by the estimating means while the control process in the stoichiometric operation mode is being executed in the reducing process, the control means comprising means for determining whether to switch from the control process in the stoichiometric operation mode to the control process in the lean operation mode or not depending on the reduced state recognized by the reduced-state recognizing means.

With the above arrangement, the control process in the stoichiometric operation mode is carried out in the process of reducing the nitrogen oxide (NOx) absorbed by the catalytic converter while the control process in the lean operation mode is being performed by the control means. Specifically, the air-fuel ratio of the exhaust gas entering the catalytic converter is controlled in order to converge the estimated value, represented by the data generated by the estimating means, of the output of the exhaust gas sensor to the target value, and as a result converge the output of the exhaust gas sensor to the target value. At this time, the control process in the stoichiometric operation mode finally controls the air-fuel ratio of the exhaust gas entering the catalytic converter (hereinafter also referred to as "upstream-of-catalytic-converter air-fuel ratio") at an air-fuel ratio in the vicinity of a stoichiometric air-fuel ratio. However, in an initial stage immediately after the control process in the stoichiometric operation mode has begun, the upstream-of-catalytic-converter air-fuel ratio is basically controlled at a rich air-fuel ratio due to the effect of the lean operation mode that was executed prior to the control process in the stoichiometric operation mode. When the up-stream-of-catalytic-converter air-fuel ratio is controlled in this fashion, NOx in the catalytic converter is reduced by reducing agents which are HC, CO, $H_2$, etc. contained in the exhaust gas.

While the control process in the stoichiometric operation mode is being performed, the reduced-state recognizing means sequentially recognizes the reduced state of NOx in the catalytic converter based on the data generated by the estimating means. The control means then determines whether to switch from the control process in the stoichiometric operation mode to the control process in the lean operation mode based on the reduced state recognized by the reduced-state recognizing means.

The data sequentially generated by the estimating means comprises data representing the estimated (expected) value of the output of the exhaust gas sensor after the dead time of the exhaust system including the catalytic converter, i.e., a system for generating the output of the exhaust gas sensor from the upstream-of-catalytic-converter air-fuel ratio controlled by the control means. Therefore, the reduced state of NOx which is sequentially recognized by the reduced-state recognizing means based on the above data is a reduced state in the future after the dead time. More specifically, at each point of time during the control process in the stoichiometric operation mode, the reduced state of NOx in the future after the dead time is determined as a result of the stoichiometric operation mode already performed up to the point of time, and the reduced state in the future is recognized as an estimated state by the reduced-state recognizing means.

By determining whether to switch from the control process in the stoichiometric operation mode to the control process in the lean operation mode depending on the reduced state thus recognized, the control means can switch from the control process in the stoichiometric operation mode to the control process in the lean operation mode before the reduced state becomes a desired reduced state.

As a consequence, the period for performing the control process in the stoichiometric operation mode to reduce NOx in the catalytic converter, i.e., the period for inhibiting the control process in the lean operation mode, is limited to a necessary period only, making it possible to provide many opportunities for performing the control process in the lean operation mode.

While the exhaust gas sensor preferably comprises an $O_2$ sensor (oxygen concentration sensor), it may also comprise an NOx sensor, i.e., a sensor for detecting the concentration of nitrogen oxygen. If an $O_2$ sensor is used as the exhaust gas sensor, then the target value should preferably comprise a certain constant value in order to achieve the purifying capability of the catalytic converter in the stoichiometric operation mode. If an NOx sensor is used as the exhaust gas sensor, then an output value of the NOx sensor for allowing the catalytic converter to provide a good NOx purifying capability may be established as a target value for the output of the NOx sensor.

The reduced state recognized by the reduced-state recognizing means represents a state in which the reduction of the nitrogen oxide in the catalytic converter is completed after the dead time of the exhaust system, and the control means comprises means for inhibiting the control process in the stoichiometric operation mode from switching to the control process in the lean operation mode until the reduced-state recognizing means recognizes the state in which the reduction of the nitrogen oxide in the catalytic converter is completed after the dead time of the exhaust system.

When at a certain time in the stoichiometric operation mode performed for reducing NOx it is recognized that the reduction of NOx in the catalytic converter is completed after the dead time of the exhaust system, the reduction of NOx in the catalytic converter is basically completed after the dead time from the recognized time even though the air-fuel ratio of the exhaust gas entering the catalytic converter is controlled in any way after the recognized time. After the time when the completion of the reduction of NOx is recognized, therefore, it is not necessary to perform the control process in the stoichiometric operation mode for the reduction of NOx. If operating conditions (rotational speed, intake pressure, demanded load, etc.) of the internal combustion engine are those for performing the control process in the lean operation mode, then the control process in the lean operation mode can be performed without fail. According to the present invention, therefore, the control means inhibits the control process in the stoichiometric operation mode from switching to the control process in the lean operation mode until the reduced-state recognizing means recognizes the state in which the reduction of NOx in the catalytic converter is completed after the dead time of the exhaust system. After the completion of the reduction of NOx is recognized, the control process in the lean operation mode can be carried out depending on the operating conditions of the internal combustion engine. As a result, under the operating conditions capable of performing the control process in the lean operation mode, it can be resumed before the reduction of NOx in the catalytic converter is actually completed.

Therefore, the state in which the control process in the stoichiometric operation mode is performed to reduce NOx in the catalytic converter can be limited to a necessary period, providing many opportunities for carrying out the control process in the lean operation mode. As a result, the fuel consumption by the internal combustion engine can further be reduced.

The reduced-state recognizing means may comprise means for recognizing the state in which the reduction of the nitrogen oxide in the catalytic converter is completed after the dead time of the exhaust system, by comparing the estimated value, represented by the data generated by the estimating means, of the output of the exhaust gas sensor with a predetermined threshold value. The predetermined threshold value represents the output value (e.g., a value identical to the target value) of the exhaust gas sensor at the time the air-fuel ratio of the exhaust gas is an air-fuel ratio in the vicinity of the stoichiometric air-fuel ratio.

For sequentially recognizing the completion of the reduction of NOx after the dead time, the apparatus preferably further comprises reducing agent amount data generating means for generating data representing an integrated amount of the reducing agent given to the catalytic converter until the reduced-state recognizing means recognizes the state in which the reduction of the nitrogen oxide in the catalytic converter is completed after the dead time of the exhaust system after the control process in the stoichiometric operation mode is started, while the control process in the stoichiometric operation mode is being executed in the reducing process, and catalytic converter deterioration evaluating means for evaluating a deteriorated state of the catalytic converter based on the data generated by the reducing agent amount data generating means.

Specifically, because of the control process in the stoichiometric operation mode carried out in the period after it has begun for reducing NOx until the reduced-state recognizing means recognizes the above state, the reduction of NOx in the catalytic converter is basically completed after the dead time from the time when the reduced-state recognizing means recognizes the above state. Thereafter, when the reducing agent amount data generating means generates data representing an integrated amount of the reducing agent (HC, CO, $H_2$, etc.) given to the catalytic converter via the exhaust gas, in the period after the control process in the stoichiometric operation mode has begun until the reduced-state recognizing means recognizes the above state, the generated data corresponds to the total amount of NOx absorbed by the catalytic converter during the execution of the control process in the lean operation mode prior to the execution of the control process in the stoichiometric operation mode. As the deterioration of the catalytic converter progresses, the total amount of NOx that can be absorbed thereby during the control mode in the lean operation mode is reduced. Therefore, the integrated amount of the reducing agent represented by the data generated by the reducing agent amount data generating means in the above period is correlated to the deteriorated state of the catalytic converter. It is thus possible to evaluate the deteriorated state of the catalytic converter based on the data generated by the reducing agent amount data generating means.

The amount of the reducing agent can be estimated from the amount of fuel supplied to the internal combustion engine and a command value for the amount of fuel to be supplied to the internal combustion engine.

The apparatus preferably further comprises absorption saturated-state recognizing means for recognizing whether the absorption of the nitrogen oxide by the catalytic converter is saturated or not while the control process in the stoichiometric operation mode is being executed by the control means, the catalytic converter deterioration evaluating means comprising means for evaluating the deteriorated state of the catalytic converter based on the data generated by the reducing agent amount data generating means while the control process in the stoichiometric operation mode is being executed, only when the control means switches from the control process in the lean operation mode to the control process in the stoichiometric operation mode after the absorption saturated-state recognizing means recognizes that the absorption of the nitrogen oxide by the catalytic converter is saturated.

When the control process in the lean operation mode is carried out until the absorption saturated-state recognizing means recognizes that the absorption of NOx by the catalytic converter is saturated, the total amount of NOx absorbed by the catalytic converter in the saturated state is the amount of NOx that can be absorbed to a maximum by the catalytic converter, and is distinctly correlated to the deteriorated state of the catalytic converter. Therefore, the total amount of NOx decreases monotonously as the deterioration of the catalytic converter progresses. When the control process in the stoichiometric operation mode for the reduction of NOx is carried out after the absorption of NOx by the catalytic converter is saturated, the reducing agent amount data generating means produces data representing an integrated amount of the reducing agent corresponding to the total amount of NOx in the saturated state. Depending on the operating conditions of the internal combustion engine, the control means may switch the control process in the lean operation mode to the control process in the stoichiometric operation mode before the absorption of NOx by the catalytic converter is saturated, i.e., when the catalytic converter can absorb more NOx.

The catalytic converter deterioration evaluating means evaluates the deteriorated state of the catalytic converter based on the data generated by the reducing agent amount data generating means while the control process in the stoichiometric operation mode is being executed, only when the control means switches from the control process in the lean operation mode to the control process in the stoichiometric operation mode after the absorption saturated-state recognizing means recognizes that the absorption of the nitrogen oxide by the catalytic converter is saturated.

In this manner, the integrated amount of the reducing agent represented by the data generated by the reducing agent amount data generating means corresponds to the total amount of NOx in the saturated state of the catalytic converter. Thus, the deteriorated state of the catalytic converter can appropriately be evaluated based on the above data.

With the absorption saturated-state recognizing means, the apparatus preferably further comprises nitrogen oxide amount data generating means for sequentially generating data representing an integrated amount of the nitrogen oxide given to the catalytic converter while the control process in the lean operation mode is being executed by the control means, the the absorption saturated-state recognizing means comprising means for determining whether the absorption of the nitrogen oxide by the catalytic converter is saturated or not by comparing the integrated amount of the nitrogen oxide represented by the data generated by the nitrogen oxide amount data generating means with a predetermined threshold value.

The predetermined threshold value to be compared with the integrated amount of the nitrogen oxide represented by the data generated by the nitrogen oxide amount data generating means is preferably established depending on a latest result of the deteriorated state of the catalytic converter evaluated by the catalytic converter deterioration evaluating means.

Specifically, the total amount of NOx absorbed by the catalytic converter while the absorption of NOx by the catalytic converter is being saturated varies depending on the deteriorated state of the catalytic converter, as described above. Therefore, by establishing the predetermined threshold value to be compared with the integrated amount of the nitrogen oxide depending on the latest evaluated result of the deteriorated state of the catalytic converter, it can properly be recognized that the absorption of NOx in the catalytic converter is saturated.

If the predetermined threshold value to be compared with the integrated amount of the nitrogen oxide is established depending on the latest evaluated result of the deteriorated state of the catalytic converter, then the control means preferably comprises means for canceling the control process in the lean operation mode and executing the control process in the stoichiometric operation mode when the absorption saturated-state recognizing means recognizes that the absorption of the nitrogen oxide by the catalytic converter is saturated while the control process in the lean operation mode is being executed.

When the absorption of NOx by the catalytic converter is saturated while the control process in the lean operation mode is being executed, the catalytic converter cannot absorb NOx unless the absorbed NOx is reduced. By establishing the predetermined threshold value depending on the latest evaluated result of the deteriorated state of the catalytic converter, at or nearly at the time when the absorption of NOx by the catalytic converter is actually saturated, the saturated state can be recognized by the absorption saturated-state recognizing means. Therefore, by canceling the control process in the lean operation mode and executing the control process in the stoichiometric operation mode depending on the recognition of the saturated state, excessive NOx that cannot be absorbed by the catalytic converter is prevented from passing through the catalytic converter and being discharged.

The estimating means comprises means for generating the data representing the estimated value of the output of the exhaust gas sensor according to an algorithm constructed based on a model of the exhaust system, which represents a behavior of the exhaust system regarded as a system for generating the output of the exhaust gas sensor from the air-fuel ratio of the exhaust gas entering the catalytic converter via a response delay element and a dead time element.

By determining a model which represents a behavior of the exhaust system in view of a response delay element and a dead time element of the exhaust system and performing the process of the estimating means according to an algorithm based on the model, the data representing the estimated value of the output of the exhaust gas sensor after the dead time of the exhaust system can properly be generated.

Specifically, the apparatus further comprises an air-fuel ratio sensor disposed upstream of the catalytic converter for detecting the air-fuel ratio of the exhaust gas entering the catalytic converter, the estimating means comprising means for generating the data representing the estimated value of the output of the exhaust gas sensor, using data of the output of the exhaust gas sensor and data of an output of the air-fuel ratio sensor.

Using data of the output of the air-fuel ratio sensor which corresponds to the detected value of an input to the exhaust system and data of the output of the exhaust gas sensor which corresponds to the detected value of an output to the exhaust system, highly reliable data can be generated as representing the estimated value of the output of the exhaust gas sensor after the dead time of the exhaust system. As a consequence, the reduced state of NOx in the stoichiometric operation mode can accurately be recognized based on the data representing the estimated value of the output of the exhaust gas sensor. Hence, it is possible to adequately determined whether to switch from the control process in the stoichiometric operation mode to the control process in the lean operation mode. As the reduced state of NOx can accurately be recognized, for evaluating the deteriorated state of the catalytic converter, it is possible to accurately generate data representing the integrated amount of the reducing agent required until the reduction of NOx is completed during the execution of the control process in the stoichiometric operation mode after the execution of the control process in the lean operation mode. Thus, the evaluated result of the deteriorated state of the catalytic converter based on the data representing the integrated amount of the reducing agent is made highly reliable.

According to the algorithm of the estimating means based on the model of the exhaust system, it may be possible to generate the data representing the estimated value of the output of the exhaust gas sensor, using data (e.g., a target value for the upstream-of-catalytic-converter air-fuel ratio) generated by the control means as defining the upstream-of-catalytic-converter air-fuel ratio in order to control the upstream-of-catalytic-converter air-fuel ratio in the control process in the stoichiometric operation mode, rather than the data of the output of the air-fuel ratio sensor. However, for increasing the accuracy of the data representing the estimated value of the output of the exhaust gas sensor, it is preferable to use the data of the output of the air-fuel ratio sensor which represents the actual input to the exhaust system.

For performing the process of the estimating means based on the model of the exhaust system, the model of the exhaust system has a parameter to be set to a certain value for defining its behavior. While the parameter may be of a predetermined fixed value, it is preferable to identify the parameter of the model sequentially on a real-time basis in order to achieve matching between the model and the actual behavior of the exhaust system. With the air-fuel sensor provided for detecting the upstream-of-catalytic-converter air-fuel ratio, the parameter of the model can be identified using the data of the output of the air-fuel sensor and the data of the output of the exhaust gas sensor.

According to the present invention, the apparatus further comprises identifying means for sequentially identifying the value of a parameter to be established of the model of the exhaust system, using the data of the output of the exhaust gas sensor and the data of the output of the air-fuel ratio sensor, while the control process in the stoichiometric operation mode is being executed by the control means, the estimating means comprising means for generating the data representing the estimated value of the output of the exhaust gas sensor, using the value of the parameter of the model which is identified by the identifying means, as well as the data of the output of the exhaust gas sensor and the data of the output of the air-fuel ratio sensor.

With the above arrangement, since the parameter of the model can sequentially be identified based on the actual behavior of the exhaust system, when the process of the estimating means is carried out using the parameter of the model as well as the data of the output of the exhaust gas sensor and the data of the output of the air-fuel ratio sensor, the accuracy of the estimated value of the output of the exhaust gas sensor represented by the data which is generated by the estimating means can be increased. As a result, the reduced state of NOx in the stoichiometric operation mode for the reduction of NOx can be recognized more accurately. Thus, it is possible to adequately determined whether to switch from the control process in the stoichiometric operation mode to the control process in the lean operation mode. With the deteriorated state of the catalytic converter being thus evaluated, the reliability of the deteriorated state of the catalytic converter can be increased.

Preferably, the parameter of the model which is identified by the identifying means includes a gain coefficient relative to the response delay element and a gain coefficient relative to the dead time element.

By identifying the gain coefficient relative to the response delay element and the gain coefficient relative to the dead time element as the parameter, proper matching can be achieved between the model and the behavior of the exhaust system, and hence the accuracy of the estimated value of the output of the exhaust gas sensor which is represented by the data generated by the estimating means according to the algorithm based on the model can be increased.

The model of the exhaust system preferably comprises a discrete-time system model which expresses the output of the exhaust gas sensor in each control cycle, using the output of the exhaust gas sensor in a past control cycle prior to the control cycle and the output of the air-fuel ratio sensor in a control cycle prior to the dead time of the exhaust system.

By thus constructing the model of the exhaust system as a discrete-time system model, the behavior of the exhaust system can appropriated by the model, and it is easy to construct the algorithm of the process of the identifying means and the process of the estimating means.

With the model of the exhaust system being constructed as a discrete-time system model, a coefficient relative to the output of the exhaust gas sensor and a coefficient relative to the output of the air-fuel ratio sensor in the model are provided as the parameter of the model. The coefficient relative to the output of the exhaust gas sensor becomes the gain coefficient relative to the response delay element, and the coefficient relative to the output of the air-fuel ratio sensor becomes the gain coefficient relative to the dead time element.

Preferably, the control process in the stoichiometric operation mode which is executed by the control means comprises a process for generating, according to a feedback control process, a manipulated variable which defines the air-fuel ratio of the exhaust gas entering the catalytic converter in order to converge the estimated value of the output of the exhaust gas sensor which is represented by the data generated by the estimating means to the target value, and manipulating the air-fuel ratio of an air-fuel mixture to be combusted by the internal combustion engine depending on the manipulated variable.

With the air-fuel ratio sensor provided, the control process in the stoichiometric operation mode which is executed by the control means comprises a process for generating, according to a first feedback control process, a target air-fuel ratio (a target air-fuel ratio for the upstream-of-catalytic-converter air-fuel ratio) for the exhaust gas entering the catalytic converter in order to converge the estimated value of the output of the exhaust gas sensor which is represented by the data generated by the estimating means to the target value, and manipulating, according to a second feedback control process, the air-fuel ratio of an air-fuel mixture to be combusted by the internal combustion engine in order to converge the air-fuel ratio detected by the air-fuel ratio sensor to the target air-fuel ratio.

In the control process in the stoichiometric operation mode, as described above, a manipulated variable which defines the upstream-of-catalytic-converter air-fuel ratio (a target air-fuel ratio for the upstream-of-catalytic-converter air-fuel ratio, a regulated amount for the fuel supply quantity of the internal combustion engine, etc.) is generated according to the feedback control process, and the air-fuel ratio of an air-fuel mixture combusted by the internal combustion engine is manipulated according to the manipulated variable, so that the upstream-of-catalytic-converter air-fuel ratio for converging the estimated value of the output of the exhaust gas sensor and hence the actual output of the exhaust gas sensor to their target value can appropriately be controlled.

With the air-fuel ratio sensor provided, the target air-fuel ration which is a target air-fuel ratio for the upstream-of-catalytic-converter air-fuel ratio is generated as the manipulated variable according to the first feedback control process, and the air-fuel ratio of the air-fuel mixture combusted by the internal combustion engine is manipulated according to the second feedback control process so as to converge the air-fuel ratio detected by the air-fuel ratio sensor to the target air-fuel ratio. In this fashion, the upstream-of-catalytic-converter air-fuel ratio can be controlled more reliably to converge the estimated value of the output of the exhaust gas sensor and hence the actual output of the exhaust gas sensor to their target value.

As a result, NOx can smoothly be reduced in the catalytic converter by executing the control process in the stoichiometric operation mode.

The feedback control process for generating the manipulated variable including the target air-fuel ratio for the exhaust gas entering the catalytic converter preferably comprises a sliding mode control process. Preferably, the sliding mode control process comprises an adaptive sliding mode control process.

The adaptive sliding mode control process is a combination of an ordinary sliding mode control process and a control law referred to as an adaptive law (adaptive algorithm) in order to minimize the effect of a disturbance or the like. More specifically, the sliding mode control process generally uses a function referred to as a switching function comprising the difference between a controlled variable (the output of the exhaust sensor) and its target value, and it is important to converge the switching function to "0". The ordinary sliding control process uses a control law referred to as a reaching control law in order to converge the switching function to "0". When subjected to the effect of a disturbance or the like, however, it is difficult for the reaching control law alone to achieve a sufficient level of stability and quick response with which to converge the value of the switching function to "0". On the other hand, the adaptive sliding mode control process uses a control law referred to as an adaptive law (adaptive algorithm) in addition to the reaching control law order to converge the value of the switching function to "0" while minimizing the effect of a disturbance or the like.

By using the sliding mode control process, particularly, the adaptive sliding mode control process, for generating a manipulated variable such as the target air-fuel ratio, it is possible to generate a manipulated variable suitable for stably and quickly performing the control process of converging the output of the exhaust gas sensor to the target value. As a result, when the control process in the stoichiometric control mode for reducing NOx is performed after the control process in the lean operation mode has been carried out, NOx in the catalytic converter can be reduced quickly and smoothly. Consequently, the period in which to inhibit the control process in the lean operation mode for reducing NOx can be shortened, providing more opportunities for performing the control process in the lean operation mode.

Under the operating conditions for continuing the control process in the stoichiometric control mode, since the estimated value of the output of the exhaust gas sensor and hence the actual output of the exhaust gas sensor can be controlled at their target value highly stably with a quick response, the desired purifying capability of the catalytic converter can reliably be maintained.

With the air-fuel sensor provided and the control process in the stoichiometric control mode performed according to the first and second feedback control processes, the second feedback control process preferably comprises a control process carried out by a recursive-type feedback control means.

Specifically, the recursive-type feedback control means comprises an adaptive controller or an optimum regulator. By manipulating the air-fuel ratio of the air-fuel mixture combusted by the internal combustion engine to converge the air-fuel ratio (upstream-of-catalytic-converter air-fuel ratio) detected by the air-fuel ratio sensor to the target air-fuel ratio according to a control process of the recursive-type feedback control means, the upstream-of-catalytic-converter air-fuel ratio can be controlled at the target air-fuel ratio while quickly catching up dynamic changes such as changes in the operating conditions of the internal combustion engine and time-dependent characteristic changes of the internal combustion engine. Accordingly, the upstream-of-catalytic-converter air-fuel ratio can be controlled with a highly quick response to converge the output of the exhaust gas sensor to the target value.

The recursive-type feedback control means determines a new feedback manipulated variable according to a recursive formula which contains a predetermined number of time-series data prior to the present time of a feedback manipulated variable for the air-fuel ratio of the air-fuel mixture combusted by the internal combustion engine, e.g., a corrective quantity for the fuel supply quantity. The recursive-type feedback control means should preferably comprise an adaptive controller.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENT

An apparatus for controlling the air-fuel ratio of an exhaust gas from an internal combustion engine according to the present invention will be described below with reference to FIGS. 1 through 17.

Figure 1:
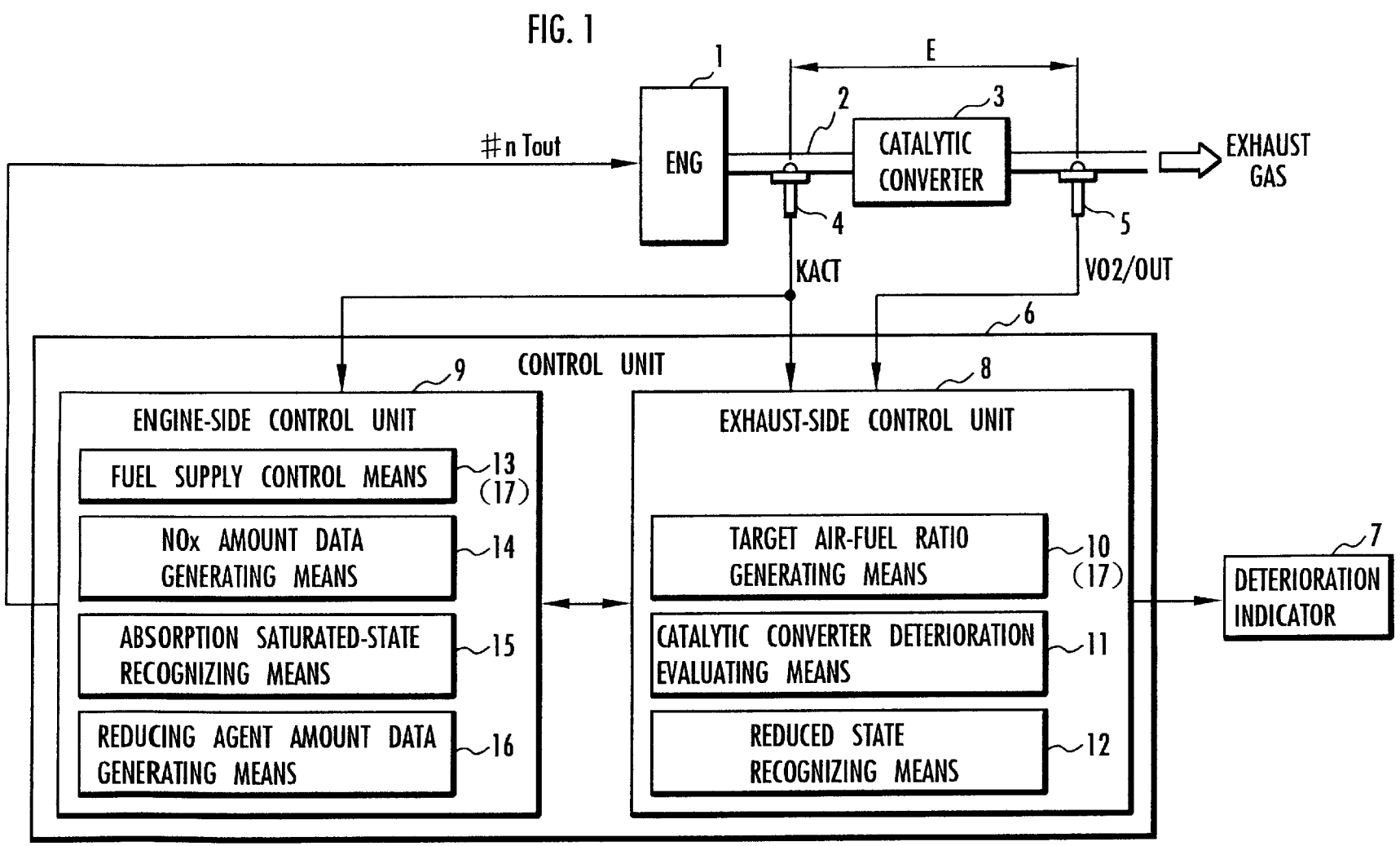
FIG. 1 is a block diagram of an overall system arrangement of an apparatus for controlling the air-fuel ratio of an exhaust gas from an internal combustion engine according to the present invention.

FIG. 1 shows in block form an apparatus for controlling the air-fuel ratio of an exhaust gas from an internal combustion engine according to the present invention. As shown in FIG. 1, a four-cylinder internal combustion engine 1 is mounted as a propulsion source, i.e., a drive source for drive wheels (not shown), on an automobile or a hybrid vehicle, for example. When a mixture of fuel and air is combusted in each cylinder of the internal combustion engine 1, an exhaust gas is generated and emitted from each cylinder into a common discharge pipe 2 positioned near the internal combustion engine 1, from which the exhaust gas is discharged into the atmosphere. A catalytic converter 3 comprising a three-way catalyst and an NOx absorbent (nitrogen oxide absorbent) is mounted in the common exhaust pipe 2 for purifying the exhaust gas.

The NOx absorbent of the catalytic converter 3 may comprise either an occlusion-type NOx absorbent or an adsorption-type NOx absorbent.

The apparatus has an air-fuel ratio sensor 4 mounted on the exhaust pipe 2 upstream of the catalytic converter 3, or more precisely at a position where exhaust gases from the cylinders of the internal combustion engine 1 are put together, and an $O_2$ sensor (oxygen concentration sensor) 5 mounted as an exhaust gas sensor on the exhaust pipe 2 downstream of the catalytic converter 3.

The $O_2$ sensor 5 comprises an ordinary $O_2$ sensor for generating an output VO2/OUT having a level depending on the oxygen concentration in the exhaust gas that has passed through the catalytic converter 3, i.e., an output VO2/OUT representing a detected value of the oxygen concentration. The oxygen concentration in the exhaust gas is commensurate with the air-fuel ratio of an air-fuel mixture which, when combusted, produces the exhaust gas. The output VO2/OUT from the $O_2$ sensor 5 will change with high sensitivity in proportion to the oxygen concentration in the exhaust gas, with the air-fuel ratio corresponding to the oxygen concentration in the exhaust gas being in a range Δ close to a stoichiometric air-fuel ratio, as indicated by the solid-line curve a in FIG. 2. At oxygen concentrations corresponding to air-fuel ratios outside of the range Δ, the output VO2/OUT from the $O_2$ sensor 5 is saturated and is of a substantially constant level.

The air-fuel ratio sensor 4 generates an output KACT representing a detected value of the air-fuel ratio which is recognized from the concentration of oxygen in the exhaust gas that enters the catalytic converter 3. The air-fuel ratio sensor 4 comprises a wide-range air-fuel ration sensor disclosed in detail in Japanese laid-open patent publication No. 4-369471, for example. As indicated by the solid-line curve b in FIG. 2, the air-fuel ratio sensor 4 generates an output whose level is proportional to the concentration of oxygen in the exhaust gas in a wider range than the $O_2$ sensor 5. Stated otherwise, the air-fuel ratio sensor 4 (hereinafter referred to as "LAF sensor 4") generates an output KACT whose level corresponds to the concentration of oxygen in the exhaust gas in a wide range of air-fuel ratios.

The apparatus provides different operation modes of the internal combustion engine 1, or more specifically, different modes of controlling an air-fuel ratio. These operation modes include a stoichiometric operation mode in which the air-fuel ratio of the exhaust gas that enters the catalytic converter 3, i.e., the air-fuel ratio detected by the LAF sensor 4 (hereinafter referred to as "upstream-of-catalytic-converter air-fuel ratio"), is controlled at an air-fuel ratio close to the stoichiometric air-fuel ratio in order to achieve an optimum purifying capability of the catalytic converter 3, and a lean operation mode in which the upstream-of-catalytic-converter air-fuel ratio is controlled at a lean air-fuel ratio. The apparatus operates the internal combustion engine selectively in these operation modes. While the internal combustion engine is operating in the stoichiometric operation mode, the deteriorated state of the catalytic converter 3, or more precisely the deteriorated state of the catalytic converter 3 with respect to the absorption of NOx by the NOx absorbent of the catalytic converter 3, is evaluated.

In order to perform control processes of these operation modes and a control process for evaluating the deteriorated state of the catalytic converter 3, the apparatus has a control unit 6 comprising a microcomputer. The control 6 is supplied with the output KACT of the LAF sensor 4 and the output VO2/OUT of the $O_2$ sensor 5, and also detected outputs from various other sensors (not shown) for detecting operating conditions of the internal combustion engine 1, including a engine speed sensor, an intake pressure sensor, a coolant temperature sensor, a throttle valve opening, etc. A deterioration indicator 7 is connected to the control unit 6 for indicating the deteriorated state of the catalytic converter 3.

The deterioration indicator 7 may comprise a lamp, a buzzer, or a display unit for displaying characters, a graphic image, etc. to indicate the deteriorated state of the catalytic converter 3.

The control unit 6 comprises an exhaust-side control unit 8 and an engine-side control unit 9 for carrying out their control processes in respective given control cycles.

The engine-side control unit 8 has, as its functions, a target air-fuel ratio generating means 10 for sequentially determining a target air-fuel ratio (hereinafter represented by KCMD), which is a target air-fuel ratio for the upstream-of-catalytic-converter air-fuel ratio in order to achieve an optimum purifying capability of the catalytic converter 3, as a manipulated variable defining the upstream-of-catalytic-converter air-fuel ratio, a catalytic converter deterioration evaluating means 11 for evaluating the deteriorated state of the catalytic converter 3 and controlling operation of the deterioration indicator 7, and a reduced-state recognizing means 12 for recognizing a reduced state of NOx in the catalytic converter 3.

In view of calculating loads on the target air-fuel ratio generating means 10 and a relatively long dead time of an exhaust system E, described later on, the process performed by the exhaust-side control unit 8 is performed in control cycles of a predetermined constant period (e.g., 30–100 ms).

The engine-side control unit 9 has, as its functions, a fuel supply control means 13 for adjusting the amount of fuel supplied to the internal combustion engine 1 in the stoichiometric and lean operation modes to sequentially control the upstream-of-catalytic-converter air-fuel ratio, a nitrogen oxide amount data generating means (NOx amount data generating means) 14 for sequentially generating data representing an integrated amount of NOx given to the catalytic converter 3 and absorbed by the catalytic converter 3 in the lean operation mode, an absorption saturated-state recognizing means 15 for recognizing whether the absorption of NOx in the catalytic converter 3 in the lean operation mode is saturated or not, and a reducing agent amount data generating means 16 for generating data representing an integrated amount of a reducing agent for NOx which is given to the catalytic converter 3 in the stoichiometric operation mode.

Since the process of the fuel supply control means 13 needs to be carried out in synchronism with combustion cycles of the internal combustion engine, the process of the engine-side control unit 9 is performed in control cycles in synchronism with the crankshaft angle period (TDC) of the internal combustion engine 1.

The period (constant) of control cycles of the exhaust-side control unit 8 is longer than the crankshaft angle period (TDC) of the internal combustion engine 1.

The exhaust-side control unit 8 and the engine-side control unit 9 can exchange various data (e.g., the target air-fuel ratio KCMD) generated thereby.

The target air-fuel ratio generating means 10 of the exhaust-side control unit 8 and the fuel supply control means 13 of the engine-side control unit 9 jointly serve as a control means 17.

The target air-fuel ratio generating means 10 and the fuel supply control means 13 of the control means 17 will further be described below. Details of the catalytic converter deterioration evaluating means 11, the reduced-state recognizing means 12, the NOx amount data generating means 14, the absorption saturated-state recognizing means 15, and the reducing agent amount data generating means 16 will be described later on with respect to the description of overall operation of the apparatus according to the present embodiment.

Figure 2:
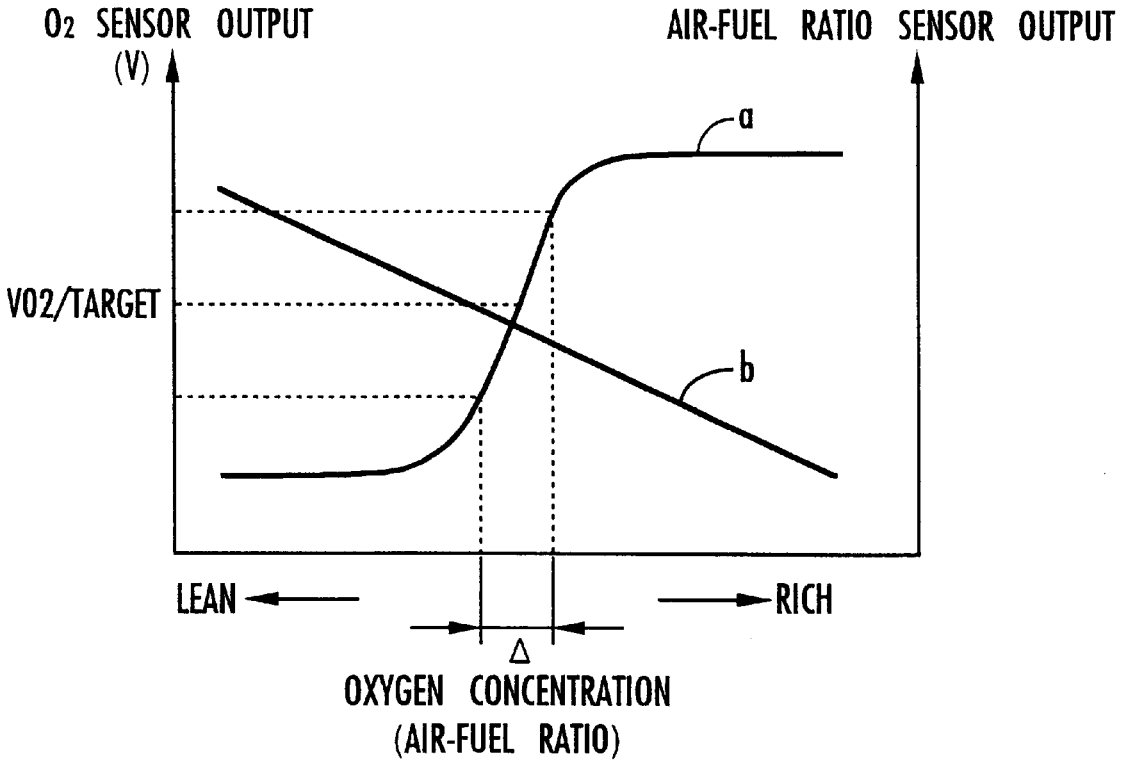
FIG. 2 is a diagram showing output characteristics of an $O_2$ sensor and an air-fuel ratio sensor used in the apparatus shown in FIG. 1.

With respect to the target air-fuel ratio generating means 10 of the exhaust-side control unit 8, the purifying capability of the catalytic converter 3, or specifically the rate at which NOx, HC, CO, etc. in the exhaust gas are purified, is made optimum irrespectively of the deteriorated state of the three-way catalyst of the catalytic converter 3 when the air-fuel ratio of the exhaust gas that flows through the catalytic converter 3 is controlled at an air-fuel ratio close to the stoichiometric air-fuel ratio so that the output VO2/OUT of the $O_2$ sensor 5 is settled at a constant value VO2/TARGET (see FIG. 2). The target air-fuel ratio generating means 10 uses the constant value VO2/TARGET as a target value for the output VO2/OUT of the $O_2$ sensor 5, and sequentially generates a target air-fuel ratio KCMD in order to converge the output VO2/OUT of the $O_2$ sensor 5 to the target value VO2/TARGET.

The target air-fuel ratio generating means 10 sequentially generates the target air-fuel ratio KCMD in control cycles (constant period) of the exhaust-side control unit 8 according to a sliding mode control process, or more specifically an adaptive sliding mode control process, which is a feedback control process, in view of a dead time present in an exhaust system (denoted by E in FIG. 1) including the catalytic converter 3, which ranges from the LAF sensor 4 to the $O_2$ sensor 5 along the exhaust pipe 2, and behavioral changes of the exhaust system E.

In order to perform the above process of the target air-fuel ratio generating means 10, the exhaust system E is regarded as a system for generating the output VO2/OUT of the $O_2$ sensor 5 from the output KACT of the LAF sensor 4 (the detected value of the upstream-of-catalytic-converter air-fuel ratio) via a dead time element and a response delay element, and the behavior of the system is modeled as a discrete time system.

In the present embodiment, the difference between the output KACT from the LAF sensor 4 and a predetermined reference value FLAF/BASE (=KACT−FLAF/BASE, hereinafter referred to as "differential output kact of the LAF sensor 4") is employed as an input to the exhaust system E, and the difference between the output VO2/OUT of the $O_2$ sensor 5 and the target value VO2/TARGET (=VO2/OUT−VO2/TARGET, hereinafter referred to as "differential output VO2 of the $O_2$ sensor 5") is used an output from the exhaust system E. The behavior of the exhaust system E is expressed by an autoregressive model, specifically an autoregressive model having a dead time in the differential output kact of the LAF sensor 4 as the input to the exhaust system E, according to the equation (1) shown below. The reference value FLAF/BASE relative to the differential output kact of the LAF sensor 4 is set to a stoichiometric air-fuel ratio.

$$VO2(k+1)=a1\cdot VO2(k)+a2-VO2(k-1)+b1\cdot \mathrm{kact}(k-d) \quad (1)$$

In the equation (1) "k" represents the ordinal number of a discrete-time control cycle of the exhaust-side control unit 8, and "d" the dead time of the exhaust system E as represented by the number of control cycles. The dead time of the exhaust system E (more specifically, the dead time required until the upstream-of-catalytic-converter air-fuel ratio detected at each point of time by the LAF sensor 4 is reflected in the output VO2/OUT of the $O_2$ sensor 5) is generally equal to the time of 3–10 control cycles (d=3–10) if the period (constant in the present embodiment) of control cycles of the exhaust-side control unit 8 ranges from 30 to 100 ms. In the present embodiment, a preset constant value (d=7, for example) which is equal to or slightly longer than the actual dead time of the exhaust system E is used as the dead time d in the model of the exhaust system E (hereinafter referred to as "exhaust system model") as represented by the equation (1).

The first and second terms of the right side of the equation (1) correspond to a response delay element of the exhaust system E, the first term being a primary autoregressive term and the second term being a secondary autoregressive term. In the first and second terms, "a1", "a2" represent respective gain coefficients of the primary autoregressive term and the secondary autoregressive term. Stated otherwise, these gain coefficients a1, a2 are relative to the differential output VO2 of the $O_2$ sensor 5 as the output of the exhaust system E.

The third term of the right side of the equation (1) represents the differential output kact of the LAF sensor 4 as the input to the exhaust system E, including the dead time d of the exhaust system E. In the third term, "b1" represents a gain coefficient relative to the input to the exhaust system E, i.e., the differential output kact of the LAF sensor 4. These gain coefficients "a1", "a2", "b1" are parameters to be set to certain values in defining the behavior of the exhaust system model, and are sequentially identified by an identifier which will be described later on.

The exhaust system model defined according to the equation (1) expresses the differential output VO2(k+1) of the $O_2$ sensor 5 in each control cycle of the exhaust-side control unit 8, with differential outputs VO2(k), VO2(k−1) of the $O_2$ sensor 5 in past control cycles prior to the above control cycle and a differential output kact(k−d) of the LAF sensor 4 in a control cycle prior to the dead time d of the exhaust system E.

The target air-fuel ratio generating means 10 generates the target air-fuel ratio KCMD based on the exhaust system model defined according to the equation (1), in control cycles, i.e., control cycles of constant period, of the exhaust-side control unit 8. In order to perform this process, the target air-fuel ratio generating means 10 has its functions as shown in FIG. 3.

Figure 3:
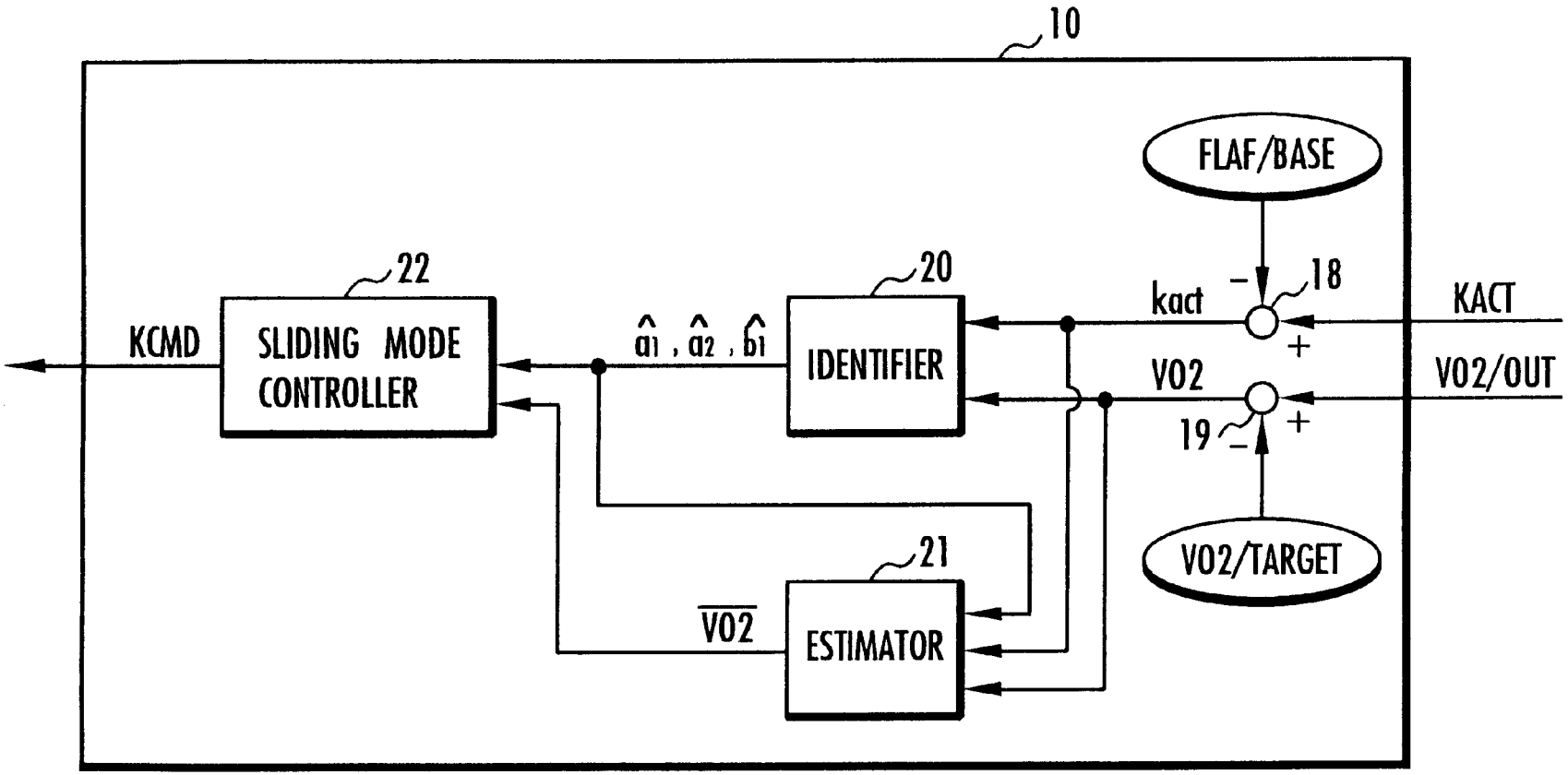
FIG. 3 is a block diagram showing a basic arrangement of an exhaust-side control unit of the apparatus shown in FIG. 1.

As shown in FIG. 3, the target air-fuel ratio generating means 10 has a subtractor 18 for subtracting the air-fuel ratio reference value FLAF/BASE from the output KACT from the LAF sensor 4 to sequentially determine the differential output kact of the LAF sensor 4 in each control cycle, and a subtractor 19 for subtracting the target value VO2/TARGET from the output VO2/OUT from the $O_2$ sensor 5 to sequentially determine the differential output VO2 of the $O_2$ sensor 5 in each control cycle.

The target air-fuel ratio generating means 10 also has an identifier 20 (identifying means) for sequentially determining in each control cycle identified values a1 hat, a2 hat, b1 hat of the gain coefficients a1, a2, b1 (hereinafter referred to as "identified gain coefficients a1 hat, a2 hat, b1 hat") which are parameters to be set of the exhaust system model, an estimator 21 (estimating means) for sequentially determining in each control cycle an estimated value VO2 bar of the differential output VO2 from the $O_2$ sensor 5 (hereinafter referred to as "estimated differential output VO2 bar") after the dead time d of the object exhaust system E, and a sliding mode controller 22 for sequentially calculating in each control cycle the target air-fuel ratio KCMD according to an adaptive slide mode control process in order to converge the estimated differential output VO2 bar of the $O_2$ sensor 5 to "0", or stated otherwise, to converge the estimated value (=VO2 bar+VO2/TARGET) of the output VO2/OUT from the $O_2$ sensor 5 after the dead time d of the exhaust system E to the target value VO2/TARGET.

The algorithm of a processing operation to be carried out by the identifier 20, the estimator 21, and the sliding mode controller 22 is constructed as follows:

The identifier 20 serves to identify the values of the gain coefficients a1, a2, b1 sequentially on a real-time basis for the purpose of minimizing a modeling error of the exhaust system model expressed by the equation (1) with respect to the actual exhaust system E. The identifier 22 carries out its identifying process as follows:

In each control cycle of the exhaust-side control unit 8, the identifier 20 determines an identified value VO2(k) hat of the differential output VO2 (the output of the exhaust system model) from the $O_2$ sensor 5 (hereinafter referred to as "identified differential output VO2 (k) hat") on the exhaust system model, using the data of the present values of the identified gain coefficients a1 hat, a2 hat, b1 hat of the exhaust system model, i.e., the values of identified gain coefficients a1(k−1) hat, a2(k−1) hat, b1(k−1) hat determined in a preceding control cycle, and the data kact(k−d−1), VO2(k−1), VO2(k−2) of the past values of the differential output kact from the LAF sensor 4 and the differential output VO2 from the $O_2$ sensor 5, according to the following equation (2):

$$V\hat{O}\mathbf{2}(k)=a\hat{1}(k-1)\cdot VO\mathbf{2}(k-1)+a\hat{2}(k-1)\cdot VO\mathbf{2}(k-2)+b\hat{1}(k-1)\cdot \mathrm{kact}(k-d\mathbf{1}-1)=\Theta^T(k-1)\cdot\xi(k) \quad (2)$$

where $\Theta^T(k)=[a\hat{1}(k)a\hat{2}(k)b\hat{1}(k)]$ $\xi^T(k)=[VO\mathbf{2}(k-1)VO\mathbf{2}(k-2)\mathrm{kact}(k-d\mathbf{1}-1)]$ The equation (2) corresponds to the equation (1) expressing the exhaust system model which is shifted into the past by one control cycle with the gain coefficients a1, a2, b1 being replaced with the respective identified gain coefficients a1(k−1) hat, a2(k−1) hat, b1(k−1) hat. The constant value (d=7) established as described above is used as the value of the dead time d= of the exhaust system E in the third term of the equation (2).

In the equation (2), Θ, ξ represent vectors defined therein. In the equation (2), the letter T represents a transposition.

The identifier 20 also determines a difference id/e(k) between the identified differential output VO2(k) hat from the $O_2$ sensor 5 which is determined by the equation (2) and the present differential output VO2(k) from the $O_2$ sensor 5, as representing a modeling error of the exhaust system model with respect to the actual exhaust system E (hereinafter the difference id/e will be referred to as "identified error id/e"), according to the following equation (3):

$$id/e(k)=VO\mathbf{2}(k)-V\hat{O}\mathbf{2}(k) \quad (3)$$

The identifier 20 further determines new identified gain coefficients a1(k) hat, a2(k) hat, b1(k) hat, stated otherwise, a new vector Θ(k) having these identified gain coefficients as elements (hereinafter the new vector Θ(k) will be referred to as "identified gain coefficient vector Θ"), in order to minimize the identified error id/e, according to the equation (4) given below. That is, the identifier 25 varies the identified gain coefficients a1(k−1) hat, a2(k−1) hat, b1(k−1) hat determined in the preceding control cycle by a quantity proportional to the identified error id/e for thereby determining the new identified gain coefficients a1(k) hat, a2(k) hat, b1(k) hat.

$$\Theta(k)=\Theta(k-1)+K\Theta(k)\cdot id/e(k) \quad (4)$$

where Kθ represents a cubic vector determined by the following equation (5), i.e., a gain coefficient vector for determining a change depending on the identified error id/e of the identified gain coefficients a1 hat, a2 hat, b1 hat):

$$K\theta(k)=\frac{P(k-1)\cdot\xi(k)}{1+\xi^T(k)\cdot P(k-1)\cdot\xi(k)} \quad (5)$$

where P represents a cubic square matrix determined by a recursive formula expressed by the following equation (6):

$$P(k)=\frac{1}{\lambda_1}\cdot\left[I-\frac{\lambda_2\cdot P(k-1)\cdot\xi(k)\cdot\xi^T(k)}{\lambda_1+\lambda_2\cdot\xi^T(k)\cdot P(k-1)\cdot\xi(k)}\right]\cdot P(k-1) \quad (6)$$

where I represents a unit matrix.

In the equation (6), $\lambda_1$, $\lambda_2$ are established to satisfy the conditions $0<\lambda_1\leqq 1$ and $0\leqq\lambda_2<2$, and an initial value P(0) of P represents a diagonal matrix whose diagonal components are positive numbers.

Depending on how $\lambda_1$, $\lambda_2$ in the equation (6) are established, any one of various specific algorithms including a fixed gain method, a degressive gain method, a method of weighted least squares, a method of least squares, a fixed tracing method, etc. may be employed. According to the present embodiment, a method of least squares ($\lambda_1=\lambda_2=1$), for example, is employed.

Basically, the identifier 20 sequentially determines in each control cycle the identified gain coefficients a1 hat, a2 hat, b1 hat in order to minimize the identified error id/e according to the above algorithm (calculating operation). Through this operation, it is possible to sequentially obtain the identified gain coefficients a1 hat, a2 hat, b1 hat which match the actual object exhaust system E.

The algorithm described above is the basic algorithm that is carried out by the identifier 20.

The estimator 21 sequentially determines in each control cycle the estimated differential output VO2 bar which is an estimated value of the differential output VO2 from the $O_2$ sensor 5 after the dead time d in order to compensate for the effect of the dead time of the exhaust system E for the calculation of the target air-fuel ratio KCMD with the sliding mode controller 22 as described in detail later on. The algorithm for the estimator 21 to determine the estimated differential output VO2 bar is constructed as described below.

By using the equation (1) representing the exhaust system model, the estimated differential output VO2(k+d) bar which is an estimated value of the differential output VO2(k+d) of the $O_2$ sensor 5 after the dead time d in each control cycle can be expressed using time-series data VO2(k), VO2(k−1) of the present and past values of the differential output VO2 of the $O_2$ sensor 5 and time-series data kact(k−j) (j=1, 2, . . . , d) of the past values of the differential output kact of the LAF sensor 4, according to the following equation (7):

$$\overline{VO2}(k+d) = \alpha 1 \cdot VO2(k) + \alpha 2 \cdot VO2(k-1) + \sum_{j=1}^{d} \beta_j \cdot kact(k-j) \tag{7}$$

where $\alpha 1$=the first-row, first-column element of $A^d$, $\alpha 2$=the first-row, second-column element of $A^d$, $\beta j$=the first-row elements of $A^{j-1} \cdot B$ $$A = \begin{bmatrix} a1 & a2 \\ 1 & 0 \end{bmatrix}$$

$$B = \begin{bmatrix} b1 \\ 0 \end{bmatrix}$$

In the equation (7), "$\alpha 1$", "$\alpha 2$" represent the first-row, first-column element and the first-row, second-column element, respectively, of the dth power $A^d$ (d: total dead time) of the matrix A defined as described above with respect to the equation (7), and "$\beta j$" (j=1, 2, . . . , d) represents the first-row elements of the product $A^{j-1} \cdot B$ of the (j−1)th power $A^{j-1}$ (j=1, 2, . . . , d) of the matrix A and the vector B defined as described above with respect to the equation (7).

The equation (7) is a basic formula for the estimator 21 to determine the estimated differential output VO2(k+d) bar. Stated otherwise, the estimator 21 determines, in each control cycle, the estimated differential output VO2(k+d) bar of the $O_2$ sensor 5 according to the equation (7), using the time-series data VO2(k), VO2(k−1) of the differential output VO2 of the $O_2$ sensor 5, and the time-series data kact(k−j) (j=1, 2, . . . , d) of the past values of the differential output kact of the LAF sensor 4.

In the present embodiment, the values of the co-efficients $\alpha 1$, $\alpha 2$, $\beta j$ (j=1, 2, . . . , d) required to calculate the estimated differential output VO2(k+d) bar according to the equation (7) are basically calculated using the identified gain coefficients a1(k) hat, a2(k), hat, b1(k) hat which are the latest identified values of the gain coefficients a1, a2, b1 (which are elements of the vectors A, B defined with respect to the equation (7)). The value of the dead time d required in the equation (7) comprises the preset value as described above.

The sliding mode controller 22 will be described in detail below.

The sliding mode controller 22 determines an input quantity to be given to the exhaust system E to be controlled (which is specifically a target value for the difference between the output KACT of the LAF sensor 4 (the detected value of the upstream-of-catalytic-converter air-fuel ratio) and the reference value FLAF/BASE, which target value is equal to the target differential air-fuel ratio kcmd) (the input quantity will be referred to as "SLD manipulating input Usl) in order to cause the output VO2/OUT of the $O_2$ sensor 5 to settle on the target value VO2/TARGET, i.e., to converge the differential output VO2 of the $O_2$ sensor 5 to "0" according to an adaptive sliding mode control process which incorporates an adaptive control law (adaptive algorithm) for minimizing the effect of a disturbance, in a normal sliding mode control process, and determines the target air-fuel ratio KCMD from the determined SLD manipulating input Usl. An algorithm for carrying out the adaptive sliding mode control process is constructed as follows:

A switching function required for the algorithm of the adaptive sliding mode control process carried out by the sliding mode controller 22 and a hyperplane defined by the switching function (also referred to as a slip plane) will first be described below.

According to a basic concept of the sliding mode control process, the differential output VO2(k) of the $O_2$ sensor 5 obtained in each control cycle and the differential output VO2(k−1) obtained in a preceding control cycle are used as a state quantity to be controlled, and a switching function a for the sliding mode control process is defined as a linear function whose variable components are represented by the differential outputs VO2(k), VO2(k−1), according to the following equation (8):

$$\begin{aligned} \sigma(k) &= s1 \cdot VO2(k) + s2 \cdot VO2(k-1) \\ &= S \cdot X \end{aligned} \tag{8}$$

where

S=[s1 s2], $$X = \begin{bmatrix} VO2(k) \\ VO2(k-1) \end{bmatrix}$$

A vector X defined above with respect to the equation (8) as a vector whose elements are represented by the differential outputs VO2(k), VO2(k−1) will hereinafter be referred to as a state quantity X.

The coefficients s1, s2 of the switching function a is set in order to meet the condition of the following equation (9):

$$-1 < \frac{s2}{s1} < 1 \tag{9}$$

(when s1=1, −1<s2<1)

In the present embodiment, for the sake of brevity, the coefficient s1 is set to s1=1 (s2/s1=s2), and the coefficient s2 is established to satisfy the condition:

$$-1 < s2 < 1.$$

Figure 4:
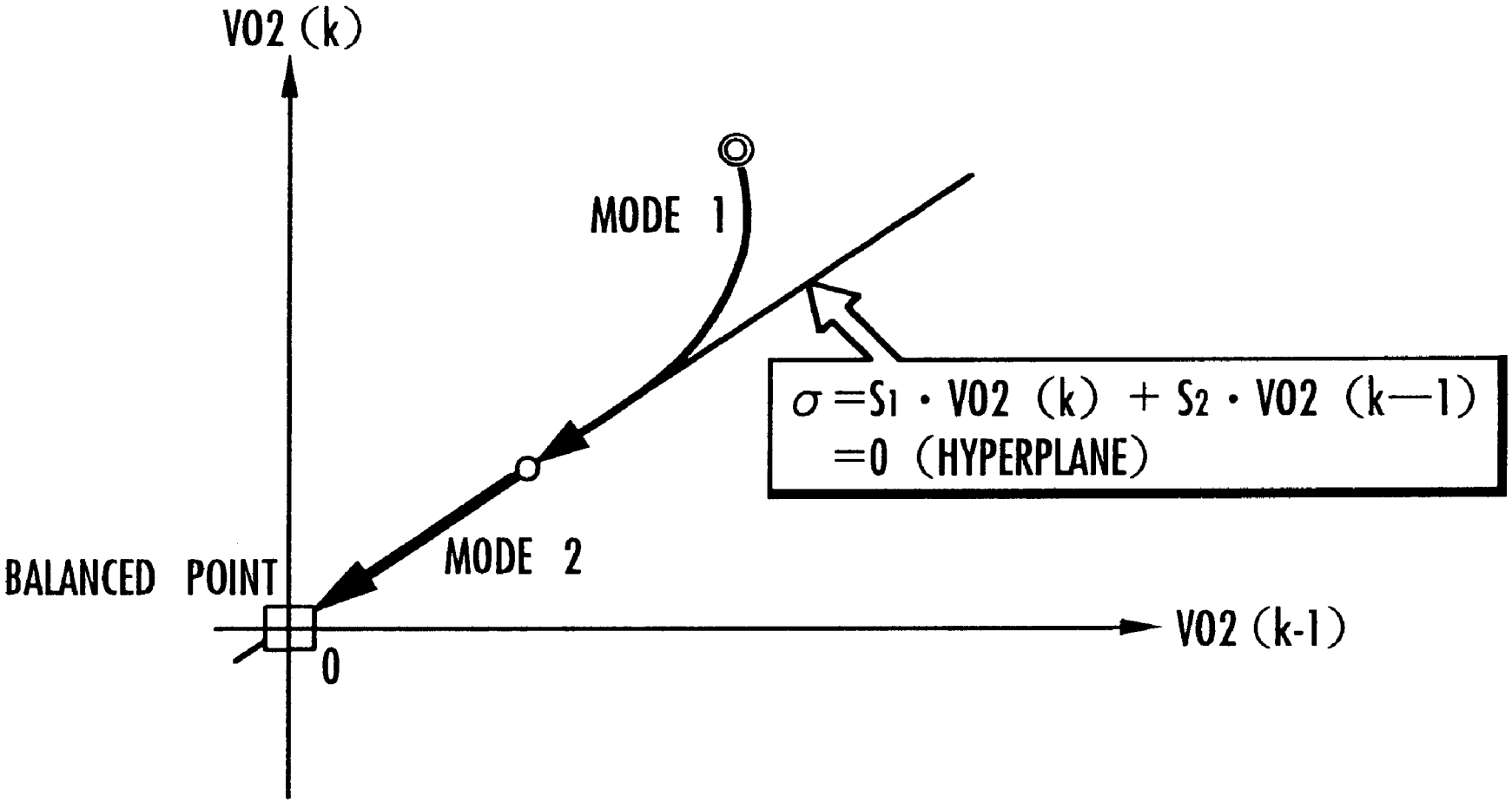
FIG. 4 is a diagram illustrative of a sliding mode control process employed by the apparatus shown in FIG. 1.

With the switching function $\sigma$ thus defined, the hyperplane for the sliding mode control process is defined by the equation a $\sigma$=0. Since the state quantity X is of the second degree, the hyperplane $\sigma$=0 is represented by a straight line as shown in FIG. 4. At this time, the hyperplane is called a switching line or a switching plane depending on the degree of a topological space.

In the present embodiment, the time-series data of the estimated differential output VO2 bar determined by the estimator 21 is actually used as the variable components of the switching function for the sliding mode control process, as described later on.

The adaptive sliding mode control process serves to converge the state quantity X onto the hyperplane σ=0 according to a reaching control law which is a control law for converging the state quantity X (=VO2(k), VO2(k−1)) onto the hyperplane σ=0, and an adaptive control law (adaptive algorithm) which is a control law for compensating for the effect of a disturbance in converging the state quantity X onto the hyperplane σ=0 (mode 1 in FIG. 4). While holding the state quantity X onto the hyperplane σ=0 according to an equivalent control input, the state quantity X is converged to a balanced point on the hyperplane σ=0 where VO2(k)=VO2(k−1)=0, i.e., a point where time-series data VO2/OUT(k), VO2/OUT(k−1) of the output VO2/OUT of the $O_2$ sensor 5 are equal to the target value VO2/TARGET (mode 2 in FIG. 4).

The SLD manipulating input Usl (=the target differential air-fuel ratio kcmd) to be generated by the sliding mode controller 22 for converging the state quantity X toward the balanced point on the hyperplane σ=0 is expressed as the sum of an equivalent control input Ueq to be applied to the exhaust system E according to the control law for converging the state quantity X onto the hyperplane σ=0, an input Urch (hereinafter referred to as "reaching control law input Urch") to be applied to the exhaust system E according to the reaching control law, and an input Uadp (hereinafter referred to as "adaptive control law Uadp") to be applied to the exhaust system E according to the adaptive control law (see the following equation (10)).

$$Usl=Ueq+Urch+Uadp \tag{10}$$

The equivalent control input Ueq, the reaching control law input Urch, and the adaptive control law input Uadp are determined on the basis of the exhaust system model expressed by the equation (1), as follows:

The equivalent control input Ueq which is an input component to be applied to the exhaust system E for converging the state quantity X onto the hyperplane σ=0 is the differential output kact which satisfies the condition: σ(k+1)=σ(k)=0. Using the equations (1), (8), the equivalent control input Ueq which satisfies the above condition is given by the following equation (11):

$$\begin{aligned} Ueq(k) &= -(S\cdot B)^{-1}\cdot\{S\cdot(A-1)\}\cdot X(k+d) \\ &= \frac{-1}{s1d1}\cdot\{[s1\cdot(a1-1)+s2]\cdot VO2(k+d)+ \\ &\quad (s1\cdot a2-s2)\cdot VO2(k+d-1)\} \end{aligned} \tag{11}$$

The equation (11) is a basic formula for determining the equivalent control law input Ueq(k) in each control cycle.

According to the present embodiment, the reaching control law input Urch is basically determined according to the following equation (12):

$$\begin{aligned} Urch(k) &= -(S\cdot B)^{-1}\cdot F\cdot\sigma(k+d) \\ &= \frac{-1}{s1b1}\cdot F\cdot\sigma(k+d) \end{aligned} \tag{12}$$

Specifically, the reaching control law input Urch is determined in proportion to the value σ(k+d) of the switching function a after the dead time d, in view of the effect of the dead time d of the exhaust system E.

The coefficient F in the equation (12) which determines the gain of the reaching control law is established to satisfy the condition expressed by the following equation (13):

$$0<F<2 \tag{13}$$

(Preferably, 0<F<1)

The preferable condition in the equation (13) is a condition to prevent the value of the switching function σ from varying in an oscillating fashion (so-called chattering) with respect to the hyperplane σ=0.

The adaptive control law input Uadp is basically determined according to the following equation (14) (ΔT in the equation (14) represents the period of the control cycles of the exhaust-side control unit 8):

$$\begin{aligned} Uadp(k) &= -(S\cdot B)^{-1}\cdot G\cdot\sum_{i=0}^{k+d}(\sigma(i)\cdot\Delta T) \\ &= \frac{-1}{s1b1}\cdot G\cdot\sum_{i=0}^{k+d}(\sigma(i)\cdot\Delta T) \end{aligned} \tag{14}$$

The adaptive control law input Uadp is determined in proportion to an integrated value (which corresponds to an integral of the values of the switching function a) over control cycles of the product of values of the switching function a and the period ΔT of the exhaust-side control unit 8 until after the dead time d, in view of the effect of the dead time d.

The coefficient G (which determines the gain of the adaptive control law) in the equation (14) is established to satisfy the condition of the following equation (15):

$$G = J\cdot\frac{2-F}{\Delta T} \quad (0<J<2) \tag{15}$$

A specific process of deriving conditions for establishing the equations (9), (13), (15) is described in detail in Japanese patent application No. 11-93741, and will not be described in detail below.

In the present embodiment, the sliding mode controller 22 determines the sum (Ueq+Urch+Uadp) of the equivalent control input Ueq, the reaching control law input Urch, and the adaptive control law Uadp determined according to the respective equations (11), (12), (14) as the SLD manipulating input Usl to be applied to the exhaust system E. However, the differential outputs VO2(K+d), VO2(k+d−1) of the $O_2$ sensor 5 and the value σ(k+d) of the switching function σ, etc. used in the equations (11), (12), (14) cannot directly be obtained as they are values in the future.

According to the present embodiment, therefore, the sliding mode controller 22 actually uses the estimated differential outputs VO2(k+d) bar, VO2(k+d−1) bar determined by the estimator 21, instead of the differential outputs VO2(K+d), VO2(k+d−1) from the $O_2$ sensor 5 for determining the equivalent control input Ueq according to the equation (11), and calculates the equivalent control input Ueq in each control cycle according to the following equation (16):

$$\begin{aligned} Ueq(k) &= \frac{-1}{s1b1}\{[s1\cdot(a1-1)+s2]\cdot\overline{VO2}(k+d)+ \\ &\quad (s1\cdot a2-s2)\cdot\overline{VO2}(k+d-1)\} \end{aligned} \tag{16}$$

According to the present embodiment, furthermore, the sliding mode controller 22 actually uses time-series data of the estimated differential output VO2 bar sequentially determined by the estimator 21 as described above as a state quantity to be controlled, and defines a switching function a bar according to the following equation (17) (the switching function a bar corresponds to time-series data of the differential output VO2 in the equation (8) which is replaced with time-series data of the estimated differential output VO2 bar), in place of the switching function σ established according to the equation (8):

$$\overline{\sigma(k)}=s1\cdot\overline{VO2}(k)+s2\cdot\overline{VO2}(k-1) \tag{17}$$

The sliding mode controller 22 calculates the reaching control law input Urch in each control cycle according to the following equation (18), using the switching function a bar represented by the equation (17), rather than the value of the switching function a for determining the reaching control law input Urch according to the equation (12):

$$Urch(k) = \frac{-1}{s1\cdot b1}\cdot F\cdot\overline{\sigma}(k+d) \tag{18}$$

Similarly, the sliding mode controller 22 calculates the adaptive control law input Uadp in each control cycle according to the following equation (19), using the value of the switching function a bar represented by the equation (17), rather than the value of the switching function a for determining the adaptive control law input Uadp according to the equation (14):

$$Uadp(k) = \frac{-1}{s1\cdot b1}\cdot G\cdot\sum_{i=0}^{k+d}(\overline{\sigma}(i)\cdot\Delta T) \tag{19}$$

The latest identified gain coefficients a1(k) hat, a2(k) hat, b1(k) hat which have been determined by the identifier 20 are basically used as the gain coefficients a1, a1, b1 that are required to calculate the equivalent control input Ueq, the reaching control law input Urch, and the adaptive control law input Uadp according to the equations (16), (18), (19).

The sliding mode controller 22 determines the sum of the equivalent control input Ueq, the reaching control law input Urch, and the adaptive control law input Uadp determined according to the equations (16), (18), (19), as the SLD manipulating input Usl to be applied to the object exhaust system E (see the equation (10)). The conditions for establishing the coefficients s1, s2, F, G used in the equations (16), (18), (19) are as described above.

The above process is a basic algorithm for determining the SLD manipulating input Usl (=target differential air-fuel ratio kcmd) to be applied to the exhaust system E with the sliding mode controller 22. According to the above algorithm, the SLD manipulating input Usl is determined to converge the estimated differential output VO2 bar from the $O_2$ sensor 5 toward "0", and as a result, to convert the output VO2/OUT from the $O_2$ sensor 5 toward the target value VO2/TARGET.

The sliding mode controller 22 eventually sequentially determines the target air-fuel ratio KCMD in each control cycle. The SLD manipulating input Usl determined as described above signifies a target value for the difference between the air-fuel ratio of the exhaust gas detected by the LAF sensor 4 and the reference value FLAF/BASE, i.e., the target differential air-fuel ratio kcmd. Consequently, the sliding mode controller 22 eventually determines the target air-fuel ratio KCMD by adding the reference value FLAF/BASE to the determined SLD manipulating input Usl in each control cycle according to the following equation (20):

$$\begin{aligned} KCMD(k) &= Usl(k) + FLAF/BASE \\ &= Ueq(k) + Urch(k) + Uadp(k) + FLAF/BASE \end{aligned} \tag{20}$$

The above process is a basic algorithm for determining the target air-fuel ratio KCMD with the sliding mode controller 22 according to the present embodiment.

In the present embodiment, the stability of the adaptive sliding mode control process carried out by the sliding mode controller 22 is checked for limiting the value of the SLD manipulating input Usl. Details of such a checking process will be described later on.

The fuel supply control means 13 of the engine-side control unit 9 will further be described below with reference to FIGS. 5 and 6.

Figure 5:
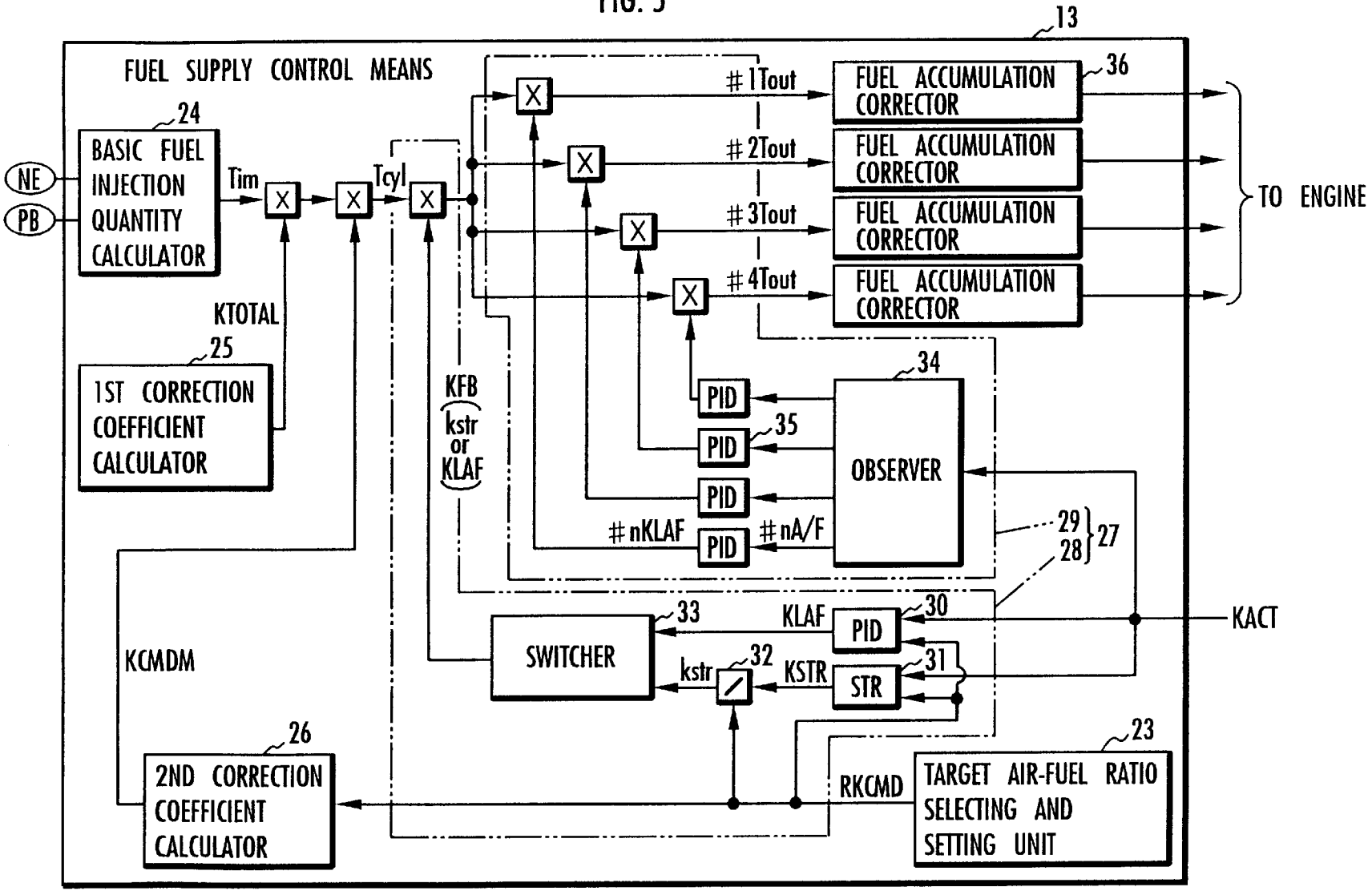
FIG. 5 is a block diagram showing a basic arrangement of an engine-side control unit of the apparatus shown in FIG. 1.

As shown in FIG. 5, the fuel supply control means 13 has, as its functions, a target air-fuel ratio selecting and setting unit 23 for determining an actually used target air-fuel ratio RKCMD as a target value for the upstream-of-catalytic-converter air-fuel ratio that is actually used to manipulate the air-fuel ratio of the air-fuel mixture combusted in the internal combustion engine 1.

In the stoichiometric operation mode, the target air-fuel ratio selecting and setting unit 23 determines the target air-fuel ratio KCMD generated by the target air-fuel ratio generating means 10, as the actually used target air-fuel ratio RKCMD. In the lean operation mode, the target air-fuel ratio selecting and setting unit 23 determines a lean air-fuel ratio determined from the rotational speed NE, the intake pressure PB, etc. of the internal combustion engine 1 using a map or a data table, as the actually used target air-fuel ratio RKCMD.

The fuel supply control means 13 has, as its functions, a basic fuel injection quantity calculator 24 for determining a basic fuel injection quantity Tim to be injected into the internal combustion engine 1, a first correction coefficient calculator 25 for determining a first correction coefficient KTOTAL to correct the basic fuel injection quantity Tim, and a second correction coefficient calculator 26 for determining a second correction coefficient KCMDM to correct the basic fuel injection quantity Tim.

The basic fuel injection quantity calculator 24 determines a reference fuel injection quantity (fuel supply quantity) for the internal combustion engine 1 from the rotational speed NE and intake pressure PB of the internal combustion engine 1 using a predetermined map, and corrects the determined reference fuel injection quantity depending on the effective opening area of a throttle valve (not shown) of the internal combustion engine 1, thereby calculating a basic fuel injection quantity Tim. The basic fuel injection quantity Tim is basically a fuel injection quantity with which the air-fuel ratio of the air-fuel mixture combusted in the internal combustion engine 1 becomes a stoichiometric air-fuel ratio.

The first correction coefficient KTOTAL determined by the first correction coefficient calculator 25 serves to correct the basic fuel injection quantity Tim in view of an exhaust gas recirculation ratio of the internal combustion engine 1, i.e., the proportion of an exhaust gas contained in an air-fuel mixture introduced into the internal combustion engine 1, an amount of purged fuel supplied to the internal combustion engine 1 when a canister (not shown) is purged, a coolant temperature, an intake temperature, etc. of the internal combustion engine 1.

The second correction coefficient KCMDM determined by the second correction coefficient calculator 26 serves to correct the basic fuel injection quantity Tim in view of the charging efficiency of an air-fuel mixture due to the cooling effect of fuel flowing into the internal combustion engine 1 depending on an actually used target air-fuel ratio RKCMD generated by the target air-fuel ratio selecting and setting unit 23.

The fuel supply control means 13 corrects the basic fuel injection quantity Tim with the first correction coefficient KTOTAL and the second correction coefficient KCMDM by multiplying the basic fuel injection quantity Tim by the first correction coefficient KTOTAL and the second correction coefficient KCMDM, thus producing a demand fuel injection quantity Tcyl for the internal combustion engine 1.

Specific details of processes for calculating the basic fuel injection quantity Tim, the first correction coefficient KTOTAL, and the second correction coefficient KCMDM are disclosed in detail in Japanese laid-open patent publication No. 5-79374, and will not be described below.

The fuel supply control means 13 also has, in addition to the above functions, a feedback controller 27 for adjusting a fuel injection quantity for the internal combustion engine 1 according to a feedback control process so as to converge the output KACT of the LAF sensor 4 (the detected value of the upstream-of-catalytic-converter air-fuel ratio) toward the actually used target air-fuel ratio RKCMD, thereby manipulating the air-fuel ratio of the air-fuel mixture combusted in the internal combustion engine 1.

The feedback controller 27 comprises a general feedback controller 28 for controlling a total air-fuel ratio for the cylinders of the internal combustion engine 1 and a local feedback controller 29 for feedback-controlling an air-fuel ratio for each of the cylinders of the internal combustion engine 1.

The general feedback controller 28 sequentially determines a feedback correction coefficient KFB to correct the demand fuel injection quantity Tcyl (by multiplying the demand fuel injection quantity Tcyl) so as to converge the output KACT from the LAF sensor 4 toward the actually used target air-fuel ratio RKCMD.

The general feedback controller 28 comprises a PID controller 30 for generating a feedback manipulated variable KLAF as the feedback correction coefficient KFB depending on the difference between the output KACT from the LAF sensor 4 and the actually used target air-fuel ratio RKCMD according to a known PID control process, and an adaptive controller 31 (indicated by "STR" in FIG. 5) for adaptively determining a feedback manipulated variable KSTR for determining the feedback correction coefficient KFB in view of changes in operating conditions of the internal combustion engine 1 and characteristic changes thereof from the output KACT from the LAF sensor 4 and the actually used target air-fuel ratio RKCMD.

In the present embodiment, the feedback manipulated variable KLAF generated by the PID controller 30 is of "1" and can be used directly as the feedback correction coefficient KFB when the output KACT (the detected air-fuel ratio of then engine 1) from the LAF sensor 4 is equal to the actually used target air-fuel ratio RKCMD. The feedback manipulated variable KSTR generated by the adaptive controller 31 becomes the actually used target air-fuel ratio RKCMD when the output KACT from the LAF sensor 4 is equal to the actually used target air-fuel ratio RKCMD. A feedback manipulated variable kstr (=KSTR/RKCMD) which is produced by dividing the feedback manipulated variable KSTR by the actually used target air-fuel ratio RKCMD with a divider 32 can be used as the feedback correction coefficient KFB.

The feedback manipulated variable KLAF generated by the PID controller 30 and the feedback manipulated variable kstr which is produced by dividing the feedback manipulated variable KSTR from the adaptive controller 31 by the actually used target air-fuel ratio RKCMD are selected one at a time by a switcher 33. A selected one of the feedback manipulated variable KLAF and the feedback manipulated variable kstr is used as the feedback correction coefficient KFB. The demand fuel injection quantity Tcyl is corrected by being multiplied by the feedback correction coefficient KFB. Details of the general feedback controller 28 (particularly, the adaptive controller 31) will be described later on.

The local feedback controller 29 comprises an observer 34 for estimating real air-fuel ratios #nA/F (n=1, 2, 3, 4) of the respective cylinders of the internal combustion engine 1 from the output KACT from the LAF sensor 4, and a plurality of PID controllers 21 (as many as the number of the cylinders) for determining respective feedback correction coefficients #nKLAF for fuel injection quantities for the cylinders from the respective real air-fuel ratios #nA/F estimated by the observer 34 according to a PID control process so as to eliminate variations of the air-fuel ratios of the cylinders.

Briefly stated, the observer 34 estimates a real air-fuel ratio #nA/F of each of the cylinders as follows: A system from the internal combustion engine 1 to the LAF sensor 4 (where the exhaust gases from the cylinders are combined) is considered to be a system for generating an up-stream-of-catalytic-converter air-fuel ratio detected by the LAF sensor 4 from a real air-fuel ratio #nA/F of each of the cylinders, and is modeled in view of a detection response delay of the LAF sensor 4 (e.g., a delay of first order) and a chronological contribution of the air-fuel ratio of each of the cylinders of the internal combustion engine 1 to the upstream-of-catalytic-converter air-fuel ratio detected by the LAF sensor 4. Based on the modeled system, a real air-fuel ratio #nA/F of each of the cylinders is estimated from the output KACT from the LAF sensor 4.

Details of the observer 34 are disclosed in Japanese laid-open patent publication No. 7-83094, for example, and will not be described below.

Each of the PID controllers 35 of the local feedback controller 29 divides the output KACT from the LAF sensor 4 by an average value of the feedback correction coefficients #nKLAF for all the cylinders determined by the respective PID controllers 35 in a preceding control cycle to produce a quotient value, and uses the quotient value as a target air-fuel ratio for the corresponding cylinder. Each of the PID controllers 35 then determines a feedback correction coefficient #nKLAF in a present control cycle so as to eliminate any difference between the target air-fuel ratio and the estimated value of the corresponding real air-fuel ratio #nA/F determined by the observer 34.

The local feedback controller 29 multiplies a value, which has been produced by multiplying the demand fuel injection quantity Tcyl by the feedback correction coefficient KFB produced by the general feedback controller 28, by the feedback correction coefficient #nKLAF for each of the cylinders, thereby determining an output fuel injection quantity #nTout (n=1, 2, 3, 4) for each of the cylinders.

The output fuel injection quantity #nTout thus determined for each of the cylinders is corrected for accumulated fuel particles on intake pipe walls of the internal combustion engine 1 by a fuel accumulation corrector 36 in the fuel supply control means 13. The corrected output fuel injection quantity #nTout is applied, as a command for the fuel injection quantity for each of the cylinders, to each of fuel injectors (not shown) of the internal combustion engine 1, which injects fuel into each of the cylinders with the corrected output fuel injection quantity #nTout.

The correction of the output fuel injection quantity in view of accumulated fuel particles on intake pipe walls is disclosed in detail in Japanese laid-open patent publication No. 8-21273, for example, and will not be described in detail below.

The general feedback controller 28, particularly, the adaptive controller 31, will further be described below.

The general feedback controller 28 effects a feedback control process to converge the output KACT (detected upstream-of-catalytic-converter air-fuel ratio of the internal combustion engine 1) from the LAF sensor 4 toward the actually used target air-fuel ratio RKCMD as described above. If such a feedback control process were carried out under the known PID control only, it would be difficult keep stable controllability against dynamic behavioral changes including changes in the operating conditions of the internal combustion engine 1, characteristic changes due to aging of the internal combustion engine 1, etc.

The adaptive controller 31 is a recursive-type controller which makes it possible to carry out a feedback control process while compensating for dynamic behavioral changes of the internal combustion engine 1. As shown in FIG. 6, the adaptive controller 31 comprises a parameter adjuster 37 for establishing a plurality of adaptive parameters using the parameter adjusting law proposed by I. D. Landau, et al., and a manipulated variable calculator 38 for calculating the feedback manipulated variable KSTR using the established adaptive parameters.

The parameter adjuster 37 will be described below. According to the parameter adjusting law proposed by I. D. Landau, et al., when polynomials of the denominator and the numerator of a transfer function $B(Z^{-1})/A(Z^{-1})$ of a discrete-system object to be controlled are generally expressed respectively by equations (21), (22), given below, an adaptive parameter θ hat (j) (j indicates the ordinal number of a control cycle) established by the parameter adjuster 37 is represented by a vector (transposed vector) according to the equation (23) given below. An input ζ(j) to the parameter adjuster 37 is expressed by the equation (24) given below. In the present embodiment, it is assumed that the internal combustion engine 1, which is an object to be controlled by the general feedback controller 28, is considered to be a plant of a first-order system having a dead time dp corresponding to the time of three combustion cycles of the internal combustion engine 1, and m=n=1, dp=3 in the equations (21)–(24), and five adaptive parameters s0, r1, r2, r3, b0 are established (see FIG. 6). In the upper and middle expressions of the equation (24), us, ys generally represent an input (manipulated variable) to the object to be controlled and an output (controlled variable) from the object to be controlled. In the present embodiment, the input is the feedback manipulated variable KSTR and the output from the object (the internal combustion engine 1) is the output KACT (detected air-fuel ratio) from the LAF sensor 4, and the input ζ(j) to the parameter adjuster 37 is expressed by the lower expression of the equation (24) (see FIG. 6).

$$A(Z^{-1})=1+a1Z^{-1}+\ldots+anZ^{-n} \tag{21}$$

$$B(Z^{-1})=b0+b1Z^{-1}+\ldots+bmZ^{-m} \tag{22}$$

$$\begin{aligned}\hat{\theta}^T(j) &= [\hat{b}0(j), \hat{B}R(Z^{-1}, j), \hat{S}(Z^{-1}, j)] \\ &= [b0(j), r1(j), \ldots, rm+dp-1(j), s0(j), \ldots, sn-1(j)] \\ &= [b0(j), r1(j), r2(j), r3(j), s0(j)]\end{aligned} \tag{23}$$

$$\begin{aligned}\zeta^T(j) &= [us(j), \ldots, us(j-m-dp+1), ys(j), \ldots, ys(j-n+1)] \\ &= [us(j), us(j-1), us(j-2), us(j-3), ys(j)] \\ &= [KSTR(j), KSTR(j-1), KSTR(j-2), KSTR(j-3), \\ &\quad KACT(j)]\end{aligned} \tag{24}$$

Figure 6:
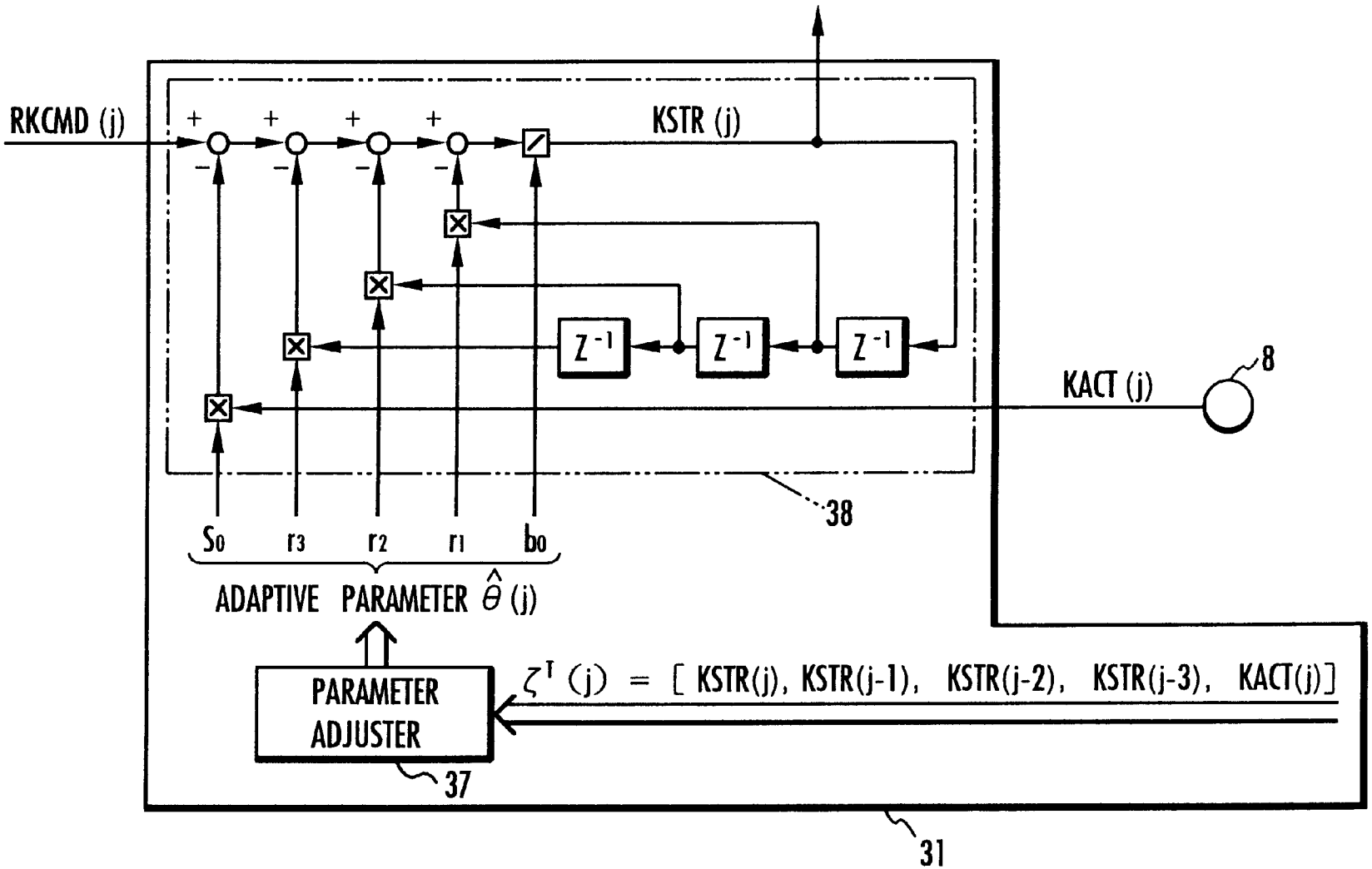
FIG. 6 is a block diagram of an adaptive controller in the engine-side control unit shown in FIG. 5.

The adaptive parameter θ hat expressed by the equation (23) is made up of a scalar quantity element b0 hat$^{-1}$ (j) for determining the gain of the adaptive controller 31, a control element BR hat ($Z^{-1}$,j) expressed using a manipulated variable, and a control element S ($Z^{-1}$,j) expressed using a controlled variable, which are expressed respectively by the following equations (25)–(27) (see the block of the manipulated variable calculator 38 shown in FIG. 6):

$$\hat{b}0^{-1}(j) = \frac{1}{b0} \tag{25}$$

$$\begin{aligned}\hat{B}R(Z^{-1}, j) &= r1Z^{-1} + r2Z^{-2} + \ldots + rm+dp-1Z^{-(n+dp-1)} \\ &= r1Z^{-1} + r2Z^{-2} + r3Z^{-3}\end{aligned} \tag{26}$$

$$\begin{aligned}\hat{S}(Z^{-1}, j) &= s0 + s1Z^{-1} + \ldots + sn-1Z^{-(n-1)} \\ &= s0\end{aligned} \tag{27}$$

The parameter adjuster 37 establishes coefficients of the scalar quantity element and the control elements, described above, and supplies them as the adaptive parameter θ hat expressed by the equation (23) to the manipulated variable calculator 38. The parameter adjuster 37 calculates the adaptive parameter θ hat so that the output KACT from the LAF sensor 4 will agree with the target air-fuel ratio KCMD, using time-series data of the feedback manipulated variable KSTR from the present to the past and the output KACT from the LAF sensor 4.

Specifically, the parameter adjuster 37 calculates the adaptive parameter θ hat according to the following equation (28):

$$\hat{\theta}(j)=\hat{\theta}(j-1)+\Gamma(j-1)\cdot\zeta(j-dp)\cdot e^*(j) \tag{28}$$

where Γ(j) represents a gain matrix (whose degree is indicated by m+n+dp) for determining a rate of establishing the adaptive parameter θ hat, and e*(j) an estimated error of the adaptive parameter θ hat. Γ(j) and e*(j) are expressed respectively by the following recursive formulas (29), (30):

$$\Gamma(j) = \frac{1}{\lambda 1(j)}\cdot\left[\Gamma(j-1) - \frac{\lambda 2(j)\cdot\Gamma(j-1)\cdot\zeta(j-dp)\cdot\zeta^T(j-dp)\cdot\Gamma(j-1)}{\lambda 1(j)\cdot\lambda 2(j)\cdot\zeta^T(j-dp)\cdot\Gamma(j-1)\cdot\zeta(j-dp)}\right] \tag{29}$$

where $0<\lambda 1(j)\leqq 1$, $0\leqq\lambda 2(j)<2$, $\Gamma(0)>0$.

$$e^*(j) = \frac{D(Z^{-1})\cdot KACT(j) - \hat{\theta}^T(j-1)\cdot\zeta(j-dp)}{1+\zeta^T(j-dp)\cdot\Gamma(j-1)\cdot\zeta(j-dp)} \tag{30}$$

where $D(Z^{-1})$ represents an asymptotically stable polynomial for adjusting the convergence. In the present embodiment, $D(Z^{-1})=1$.

Various specific algorithms including the degressive gain algorithm, the variable gain algorithm, the fixed trace algorithm, and the fixed gain algorithm are obtained depending on how λ1(j), λ2(j) in the equation (29) are selected. For a time-dependent plant such as a fuel injection process, an air-fuel ratio, or the like of the internal combustion engine 1, either one of the degressive gain algorithm, the variable gain algorithm, the fixed gain algorithm, and the fixed trace algorithm is suitable.

Using the adaptive parameter θ hat (s0, r1, r2, r3, b0) established by the parameter adjuster 37 and the actually used target air-fuel ratio RKCMD determined by the target air-fuel ratio selecting and setting unit 23, the manipulated variable calculator 38 determines the feedback manipulated variable KSTR according to a recursive formula expressed by the following equation (31):

$$KSTR = \frac{1}{b0} \cdot [RKCMD(j) - s0 \cdot KACT(j) - r1 \cdot KSTR(j-1) - r2 \cdot KSTR(j-2) - r3 \cdot KSTR(j-3)] \quad (31)$$

The manipulated variable calculator 38 shown in FIG. 6 represents a block diagram of the calculations according to the equation (31).

The feedback manipulated variable KSTR determined according to the equation (31) becomes the actually used target air-fuel ratio RKCMD insofar as the output KACT of the LAF sensor 4 agrees with the actually used target air-fuel ratio RKCMD. Therefore, the feedback manipulated variable KSTR is divided by the actually used target air-fuel ratio RKCMD by the divider 32 for thereby determining the feedback manipulated variable kstr that can be used as the feedback correction coefficient KFB.

As is apparent from the foregoing description, the adaptive controller 31 thus constructed is a recursive-type controller taking into account dynamic behavioral changes of the internal combustion engine 1 which is an object to be controlled. Stated otherwise, the adaptive controller 31 is a controller described in a recursive form to compensate for dynamic behavioral changes of the internal combustion engine 1, and more particularly a controller having a recursive-type adaptive parameter adjusting mechanism.

A recursive-type controller of this type may be constructed using an optimum regulator. In such a case, however, it generally has no parameter adjusting mechanism. The adaptive controller 31 constructed as described above is suitable for compensating for dynamic behavioral changes of the internal combustion engine 1.

The details of the adaptive controller 31 have been described above.

The PID controller 30, which is provided together with the adaptive controller 31 in the general feedback controller 28, calculates a proportional term (P term), an integral term (I term), and a derivative term (D term) from the difference between the output KACT of the LAF sensor 4 and the actually used target air-fuel ratio RKCMD, and calculates the total of those terms as the feedback manipulated variable KLAF, as is the case with the general PID control process. In the present embodiment, the feedback manipulated variable KLAF is set to "1" when the output KACT of the LAF sensor 4 agrees with the actually used target air-fuel ratio RKCMD by setting an initial value of the integral term (I term) to "1", so that the feedback manipulated variable KLAF can be used as the feedback correction coefficient KFB for directly correcting the fuel injection quantity. The gains of the proportional term, the integral term, and the derivative term are determined from the rotational speed and intake pressure of the internal combustion engine 1 using a predetermined map.

The switcher 33 of the general feedback controller 28 outputs the feedback manipulated variable KLAF determined by the PID controller 30 as the feedback correction coefficient KFB for correcting the fuel injection quantity if the combustion in the internal combustion engine 1 tends to be unstable as when the temperature of the coolant of the internal combustion engine 1 is low, the internal combustion engine 1 rotates at high speeds, or the intake pressure is low, or if the output KACT of the LAF sensor 4 is not reliable due to a response delay of the LAF sensor 4 as when the actually used target air-fuel ratio RKCMD changes largely or immediately after the air-fuel ratio feedback control process has started, or if the internal combustion engine 1 operates highly stably as when it is idling and hence no high-gain control process by the adaptive controller 31 is required. Otherwise, the switcher 33 outputs the feedback manipulated variable kstr which is produced by dividing the feedback manipulated variable KSTR determined by the adaptive controller 31 by the actually used target air-fuel ration RKCMD, as the feedback correction coefficient KFB for correcting the fuel injection quantity. This is because the adaptive controller 31 effects a high-gain control process and functions to converge the output KACT of the LAF sensor 4 quickly toward the actually used target air-fuel ratio RKCMD, and if the feedback manipulated variable KSTR determined by the adaptive controller 31 is used when the combustion in the internal combustion engine 1 is unstable or the output KACT of the LAF sensor 4 is not reliable, then the air-fuel ratio control process tends to be unstable.

Such operation of the switcher 33 is disclosed in detail in Japanese laid-open patent publication No. 8-105345, and will not be described in detail below.

Operation of the entire apparatus according to the present embodiment will be described below.

First, a control process carried out by the engine-side control unit 9 will be described below with reference to FIG. 7. The fuel supply control means 13 of the engine-side control unit 9 performs the process in control cycles in synchronism with a crankshaft angle period (TDC) of the internal combustion engine 1 as follows:

The engine-side control unit 9 reads outputs from various sensors including the LAF sensor 4 and the $O_2$ sensor 5 in STEPa. The output KACT of the LAF sensor 4 and the output VO2/OUT of the $O_2$ sensor 5, including those obtained in the past, are stored in a time-series fashion in a memory (not shown).

Then, the process of the fuel supply control means 13 is carried out in STEPb–STEPi.

Figure 8:
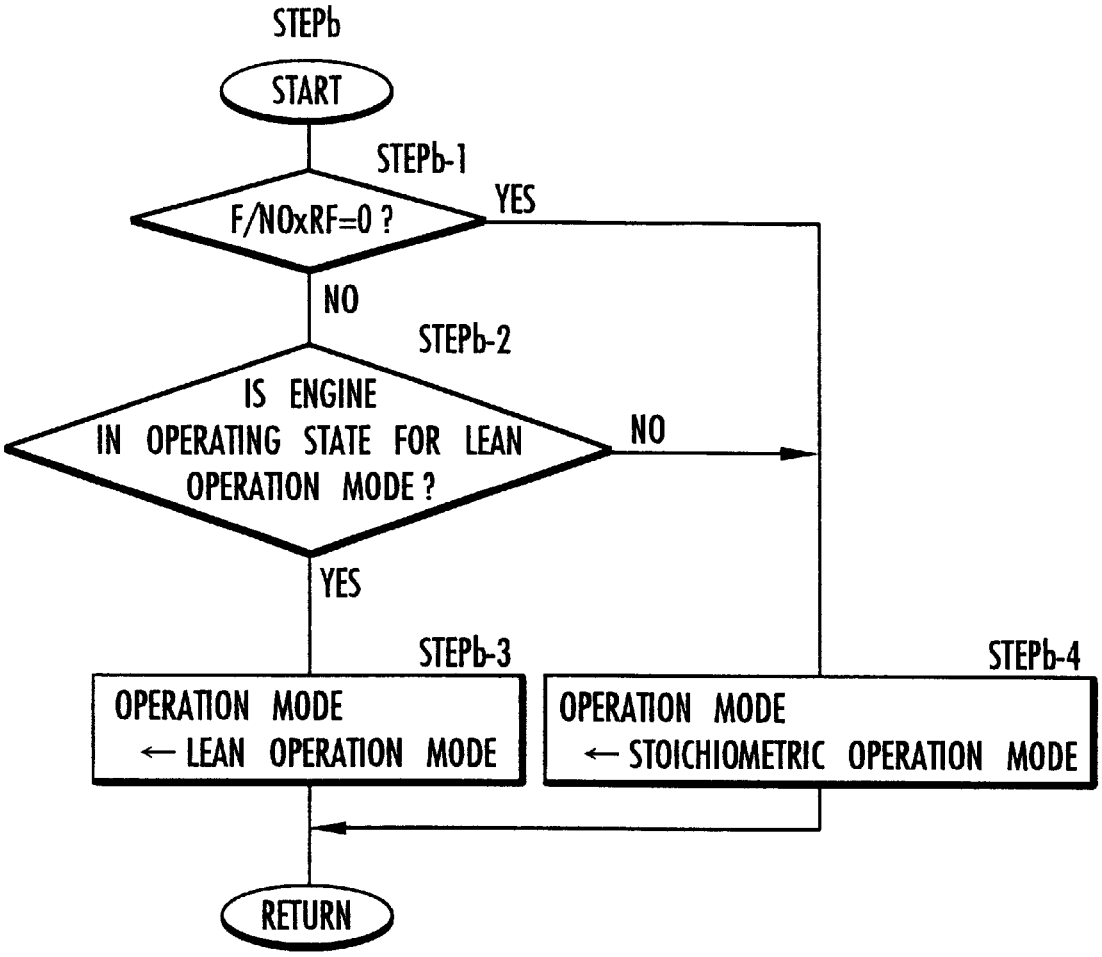
FIG. 8 is a flowchart of a subroutine of the processing sequence shown in FIG. 7.

The target air-fuel ratio selecting and setting unit 23 of the fuel supply control means 13 performs a process of setting an operation mode of the internal combustion engine 1 according to a subroutine shown in FIG. 8 in STEPb.

Specifically, the target air-fuel ratio selecting and setting unit 23 determines the value of a flag F/NOxRF in STEPb-1. The flag F/NOxRF is "0" when NOx is to be reduced in the catalytic converter 3, and "1" when NOx is not to be reduced in the catalytic converter 3. The flag F/NOxRF (hereinafter referred to as "reduction decision flag F/NOxRF") has an initial value of 1 (at the time of startup of the internal combustion engine 1), and is set to "0" depending on the process of the absorption saturated-state recognizing means 15 and the reduced-state recognizing means 12.

If F/NOXRF=1, i.e., if NOx does not need to be reduced (in this state, no NOx is basically absorbed by the NOx absorbent of the catalytic converter 3), then the target air-fuel ratio selecting and setting unit 23 determines whether the operating state of the internal combustion engine 1 is a predetermined state for the lean operation mode or not in STEPb-2. The operating state of the internal combustion engine 1 includes a demanded torque recognized from the present opening of the throttle valve of the internal combustion engine 1, the present rotational speed of the internal combustion engine 1, and the coolant temperature thereof.

If the operating state of the internal combustion engine 1 is a predetermined state for the lean operation mode in STEPb-2, then the target air-fuel ratio selecting and setting unit 23 sets the operation mode of the internal combustion engine 1 to the lean operation mode in STEPb-3.

If F/NOxRF=0 (NOx does not need to be reduced) in STEPb-1 or if the operating state of the internal combustion engine 1 is not a predetermined state for the lean operation mode in STEPb-2, then the target air-fuel ratio selecting and setting unit 23 sets the operation mode of the internal combustion engine 1 to the stoichiometric operation mode in STEPb-4.

Figure 7:
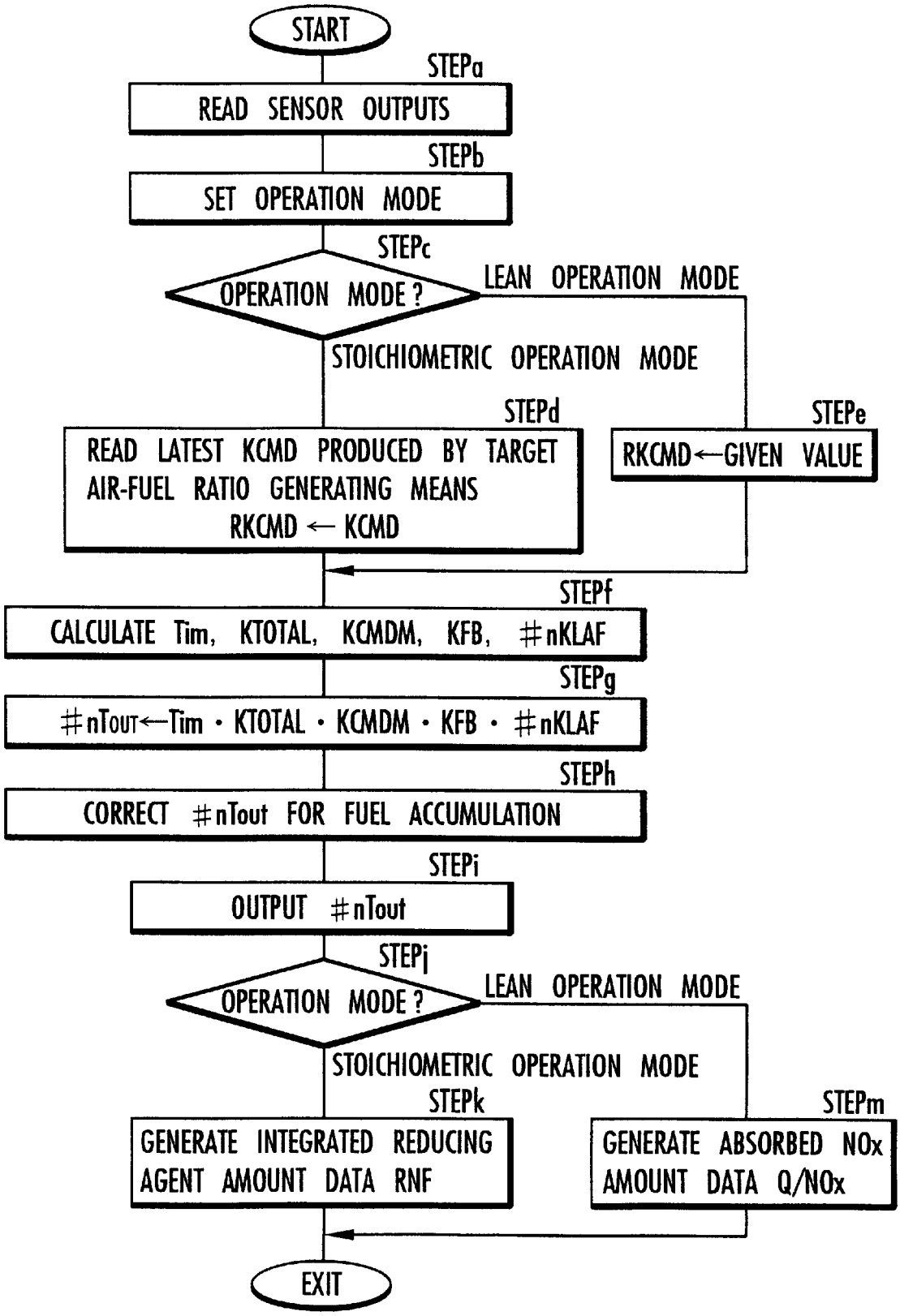
FIG. 7 is a flowchart of a processing sequence of the engine-side control unit of the apparatus shown in FIG. 1.

Control then returns to the processing sequence shown in FIG. 7. The target air-fuel ratio selecting and setting unit 23 determines the present operation mode set in STEPb in STEPc.

If the present operation mode is the stoichiometric operation mode, then the target air-fuel ratio selecting and setting unit 23 reads the latest target air-fuel ratio KCMD generated by the process (described later on) of the target air-fuel ratio generating means 10, and establishes the read latest target air-fuel ratio KCMD as the actually used target air-fuel ratio RKCMD in STEPd. If the present operation mode is the lean operation mode, then the target air-fuel ratio selecting and setting unit 23 establishes a given value determined from the present rotational speed NE and the intake pressure PB of the internal combustion engine 1 using a map or a data table, as the actually used target air-fuel ratio RKCMD in STEPe. The given value established as the actually used target air-fuel ratio RKCMD is an air-fuel ratio in a lean range.

Then, the basic fuel injection quantity calculator 24, the first correction coefficient calculator 25, the second correction coefficient calculator 26, the general feedback controller 28, and the local feedback controller 29 calculate the basic fuel injection quantity Tim, the first correction coefficient KTOTAL, the second correction coefficient KCMDM, the feedback correction coefficient KFB for the entire air-fuel ratio of the internal combustion engine 1, and the feedback correction coefficients #nKLAF for the respective cylinders of the internal combustion engine 1, respectively, in STEPf.

Depending on the operating conditions of the internal combustion engine 1, the switcher 33 selects either the feedback manipulated variable KLAF determined by the PID controller 30 or the feedback manipulated variable kstr which has been produced by dividing the feedback manipulated variable KSTR determined by the adaptive controller 31 by the actually used target air-fuel ratio RKCMD (normally, the switcher 33 selects the feedback manipulated variable kstr). The switcher 33 then outputs the selected feedback manipulated variable KLAF or kstr as a feedback correction coefficient KFB for correcting the fuel injection quantity.

When switching the feedback correction coefficient KFB from the feedback manipulated variable KLAF from the PID controller 30 to the feedback manipulated variable kstr from the adaptive controller 31, the adaptive controller 31 determines a feedback manipulated variable KSTR in a manner to hold the correction coefficient KFB to the preceding correction coefficient KFB (=KLAF) as long as in the cycle time for the switching in order to avoid an abrupt change in the correction coefficient KFB. When switching the feedback correction coefficient KFB from the feedback manipulated variable kstr from the adaptive controller 31 to the feedback manipulated variable KLAF from the PID controller 30, the PID controller 30 calculates a present correction coefficient KLAF in a manner to regard the feedback manipulated variable KLAF determined by itself in the preceding cycle time as the preceding correction coefficient KFB (=kstr).

Then, the fuel supply control means 13 multiplies the basic fuel injection quantity Tim, determined as described above, by the first correction coefficient KTOTAL, the second correction coefficient KCMDM, the feedback correction coefficient KFB, and the feedback correction coefficients #nKLAF of the respective cylinders, determining output fuel injection quantities #nTout of the respective cylinders in STEPg. The output fuel injection quantities #nTout are then corrected for accumulated fuel particles on intake pipe walls of the internal combustion engine 1 by the fuel accumulation correctors 36 in STEPh. The corrected output fuel injection quantities #nTout are applied to the non-illustrated fuel injectors of the internal combustion engine 1 in STEPi.

In the internal combustion engine 1, the fuel injectors inject fuel into the respective cylinders according to the respective output fuel injection quantities #nTout.

The above calculation of the output fuel injection quantities #nTout for the respective cylinders and control of the fuel injection of the internal combustion engine 1 is carried out in successive cycles synchronous with the crankshaft angle period (TDC) of the internal combustion engine 1 for controlling the air-fuel ratio of the air-fuel mixture combusted by the internal combustion engine 1 in order to converge the output KACT of the LAF sensor 4 (the detected upstream-of-catalytic-converter air-fuel ratio) toward the actually used target air-fuel ratio RKCMD. While the feedback manipulated variable kstr from the adaptive controller 30 is being used as the feedback correction coefficient KFB, the output KACT of the LAF sensor 4 is quickly converged toward the actually used target air-fuel ratio RKCMD with high stability against behavioral changes such as changes in the operating conditions of the internal combustion engine 1 and characteristic changes thereof. A response delay of the internal combustion engine 1 is also appropriately compensated for.

In the stoichiometric operation mode, since the actually used target air-fuel ratio RKCMD is the target air-fuel ratio KCMD generated by the target air-fuel ratio generating means 10 to control the output VO2/OUT of the $O_2$ sensor 5 at the target value VO2/TARGET, the upstream-of-catalytic-converter air-fuel ratio detected by the LAF sensor 4 is smoothly and quickly controlled at an air-fuel ratio (target air-fuel ratio KCMD) for converging the output VO2/OUT of the $O_2$ sensor 5 to the target value VO2/TARGET according to the above process of the fuel supply control means 13.

In the lean operation mode, since the actually used target air-fuel ratio RKCMD is an air-fuel ratio in the lean region, the air-fuel ratio of the air-fuel mixture combusted by the internal combustion engine 1 and hence the upstream-of-catalytic-converter air-fuel ratio are controlled at lean air-fuel ratios.

While the internal combustion engine 1 is operating in the lean operation mode, NOx in the exhaust gas emitted from the internal combustion engine 1 is absorbed by the NOx absorbent of the catalytic converter 3. When the operation mode of the internal combustion engine 1 switches from the lean operation mode to the stoichiometric operation mode, since the output VO2/OUT of the $O_2$ sensor 5 represents a leaner air-fuel ratio due to the effect of the prior lean operation mode immediately after the mode switching, the target air-fuel ratio KCMD generated by the target air-fuel ratio generating means 10 and hence the actually used target air-fuel ratio RKCMD become air-fuel ratios in the lean region. Immediately after the operation mode of the internal combustion engine 1 switches from the lean operation mode to the stoichiometric operation mode, therefore, the upstream-of-catalytic-converter air-fuel ratio is controlled at a rich air-fuel ratio. At this time, NOx absorbed by the catalytic converter 3 is reduced by reducing agents which are HC, CO, $H_2$, etc. contained in the exhaust gas.

After the process of the fuel supply control means 13 is performed as described above, the engine-side control unit 9 performs the respective processes of the NOx amount data generating means 14, the absorption saturated-state recognizing means 15, and the reducing agent amount data generating means 16 in STEPj–STEPm.

First, the engine-side control unit 9 determines the present operation mode set in STEPb in STEPj.

If the present operation mode is the stoichiometric operation mode, then the reducing agent amount data generating means 16 generates integrated reducing agent amount data RNF representing an integrated amount of reducing agents (HC, CO, $H_2$, etc.) that are supplied via the exhaust gas from the internal combustion engine 1 to the catalytic converter 3 as having an ability to reduce NOx absorbed by the catalytic converter 3, in STEPk. Then, the processing in the present control cycle is put to an end.

Figure 9:
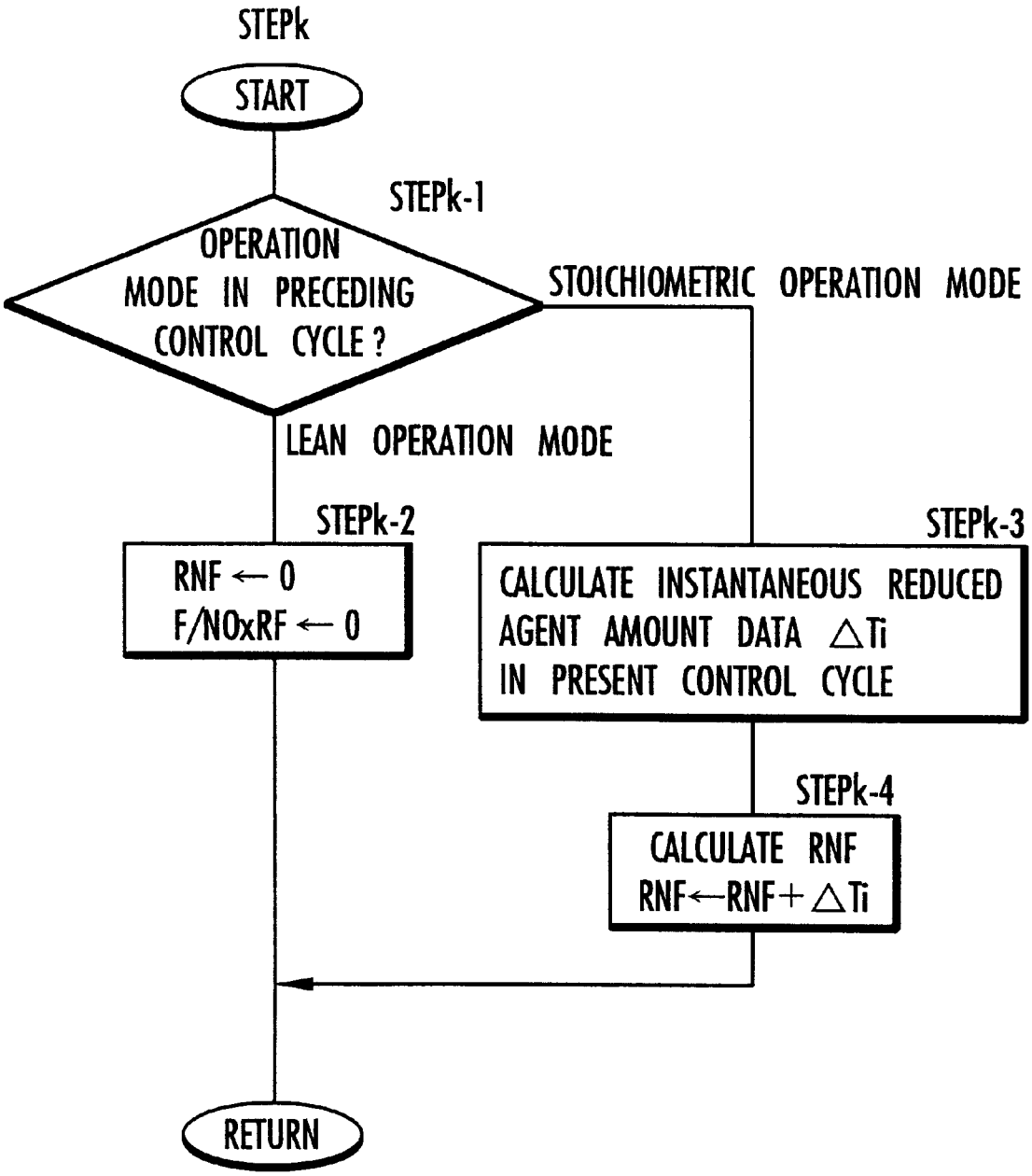
FIG. 9 is a flowchart of a subroutine of the processing sequence shown in FIG. 7.

The processing in STEPk is carried out according to a subroutine shown in FIG. 9. First, the reducing agent amount data generating means 16 determines the operation mode in the preceding control cycle in STEPk-1. If the operation mode in the preceding control cycle is the lean operation mode, i.e., if the operation mode has switched from the lean operation mode to the stoichiometric operation mode, then the reducing agent amount data generating means 16 initializes the value of the integrated reducing agent amount data RNF to "0" in order to start calculaing the integrated reducing agent amount data RNF in STEPk-2. In STEPk-2, the reducing agent amount data generating means 16 set to the value of the reduction decision flag F/NOxRF to "0" to inhibit the lean operation mode from a next control cycle.

The value of the reduction decision flag F/NOxRF which has been set to "0" is changed to "1" only when a certain condition is met in the process of the exhaust-side control unit 8.

If the operation mode in the preceding control cycle is not the lean operation mode in STEPk-1, i.e., if the internal combustion engine 1 is operating in the stoichiometric operation mode, then the reducing agent amount data generating means 16 determines instantaneous reduced agent amount data ATi representing an amount of reducing agents per TDC supplied to the catalytic converter 3 in the present control cycle in STEPk-3.

The reducing agents (HC, CO, $H_2$, etc.) having an ability to reduce NOx absorbed by the catalytic converter 3 are basically generated when an amount of fuel in excess of the fuel injection quantity corresponding to the stoichiometric air-fuel ratio is combusted in the internal combustion engine 1, and the amount of reducing agents depends on the excessive amount of fuel. Immediately after the operation mode of the internal combustion engine 1 switches from the lean operation mode to the stoichiometric operation mode, since the actually used target air-fuel ratio RKCMD becomes an air-fuel ratio in the lean region, a command value for the fuel injection quantity to be supplied to the internal combustion engine 1, i.e., the output fuel injection quantity #nTout, is greater than the fuel injection quantity corresponding to the stoichiometric air-fuel ratio. In the present embodiment, the basic fuel injection quantity Tim determined by the basic fuel injection quantity calculator 24 is a fuel injection quantity corresponding to the stoichiometric air-fuel ratio.

In the present embodiment, the reducing agent amount data generating means 16 determines a value produced by subtracting the basic fuel injection quantity Tim from the output fuel injection quantity #nTout, which has finally be determined in each control cycle by the fuel supply control means 13, which value corresponds to the excessive amount of fuel with respect to the fuel injection quantity corresponding to the stoichiometric air fuel ratio, as the instantaneous reduced agent amount data ΔTi.

The fuel injection quantity corresponding to the stoichiometric air fuel ratio may be obtained by correcting the basic fuel injection quantity Tim in view of accumulated fuel particles on intake pipe walls.

After having determined the instantaneous reduced agent amount data ΔTi, the reducing agent amount data generating means 16 accumulatively adds the instantaneous reduced agent amount data ΔTi in respective control cycles to determine the integrated reducing agent amount data RNF in STEPk-4. Specifically, the instantaneous reduced agent amount data ΔTi is added to the present value of the integrated reducing agent amount data RNF, i.e., the value determined in the preceding control cycle, in each control cycle to update the value of the integrated reducing agent amount data RNF.

In this manner, after the stoichiometric operation mode is started after the lean operation mode, the integrated reducing agent amount data RNF representing the integrated amount of reducing agents for NOx supplied to the catalytic converter 3 during the stoichiometric operation mode is sequentially generated in each control cycle of the engine-side control unit 9. The integrated reducing agent amount data RNF thus generated is used in the process of the catalytic converter deterioration evaluating means 11 described later on.

If the present operation mode is the lean operation mode in STEPj shown in FIG. 7, then the absorption saturated-state recognizing means 15 recognizes whether the absorption of NOx in the catalytic converter 3 is saturated or not, and the NOx amount data generating means 14 generates absorbed NOx amount data Q/NOx representing an integrated amount of NOx absorbed by the NOx absorbent of the catalytic converter 3 in STEPm. Then, the processing in the present control cycle is put to an end.

Figure 10:
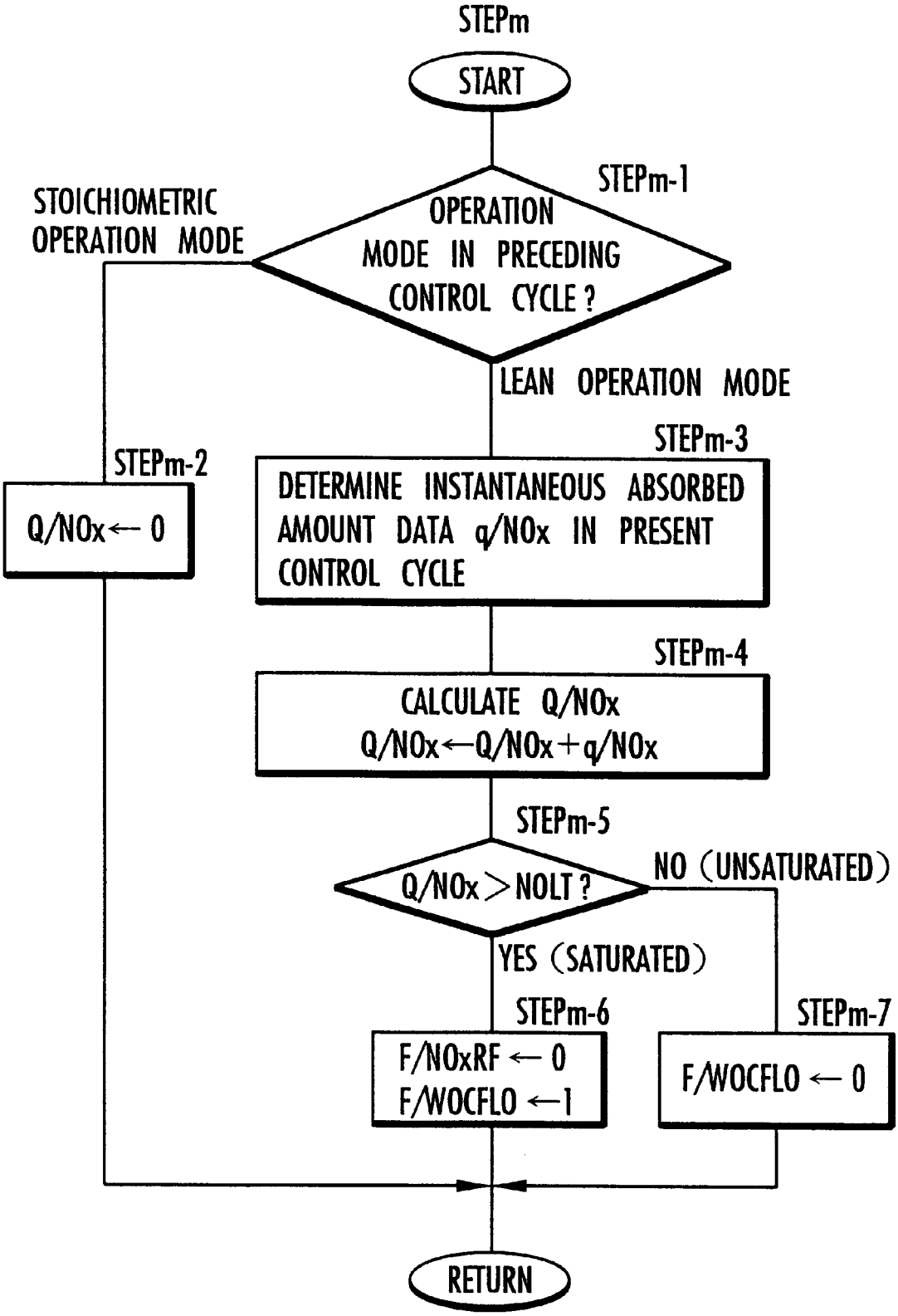
FIG. 10 is a flowchart of a subroutine of the processing sequence shown in FIG. 7.

The processing in STEPm is carried out as shown in FIG. 10.

The NOx amount data generating means 14 determines the operation mode in the preceding control cycle in STEPm-1. If the preceding operation mode is the stoichiometric operation mode, i.e., if the operation mode has switched from the stoichiometric operation mode to the lean operation mode, then the NOx amount data generating means 14 initializes the value of the absorbed NOx amount data Q/NOx to "0" in order to start calculating the absorbed NOx amount data Q/NOx in STEPm-2. Thereafter, control returns to the processing sequence shown in FIG. 7.

If the preceding operation mode is not the stoichiometric operation mode, i.e., if the internal combustion engine 1 is operating in the lean operation mode, then the NOx amount data generating means 14 determines instantaneous NOx amount data q/NOx representing an amount of NOx per TDC absorbed by the NOx absorbent of the catalytic converter 3 in the present control cycle in STEPm-3.

The instantaneous NOx amount data q/NOx is estimated from the present rotational speed, intake pressure, coolant temperature, and actually used target air-fuel ratio RKCMD of the internal combustion engine 1, using a map or a data table.

Some direct-injection engines may be operated selectively in two lean operation modes, i.e., a pre-mixed lean operation mode in which fuel and air are mixed in intake strokes of the engine and then the air-fuel mixture is combusted, and a highly lean operation mode in which an air-fuel mixture with a very small amount of fuel is generated in compression strokes of the engine and then the air-fuel mixture is combusted. With those engines, the instantaneous NOx amount data may be determined in view of the rotational speed and intake pressure of the internal combustion engine 1 and also based on whether the engine is to operate in one of the two lean operation modes.

The NOx amount data generating means 14 accumulatively adds the instantaneous NOx amount data q/NOx in successive control cycles to determine the absorbed NOx amount data Q/NOx in STEPm-4. Specifically, the instantaneous NOx amount data q/NOx is added to the present value of the instantaneous NOx amount data q/NOx, i.e., the value determined in the preceding control cycle, in each control cycle to update the value of the absorbed NOx amount data Q/NOx.

In this manner, after the lean operation mode is started, the absorbed NOx amount data Q/NOx representing the integrated amount of NOx supplied to and absorbed by the catalytic converter 3 in the lean operation mode are sequentially generated in the respective control cycles of the engine-side control unit 9.

Then, the absorption saturated-state recognizing means 15 compares the absorbed NOx amount data Q/NOx with a predetermined threshold value NOLT to determine whether the absorption of NOx in the catalytic converter 3 is saturated or not in STEPm-5.

Figure 11:
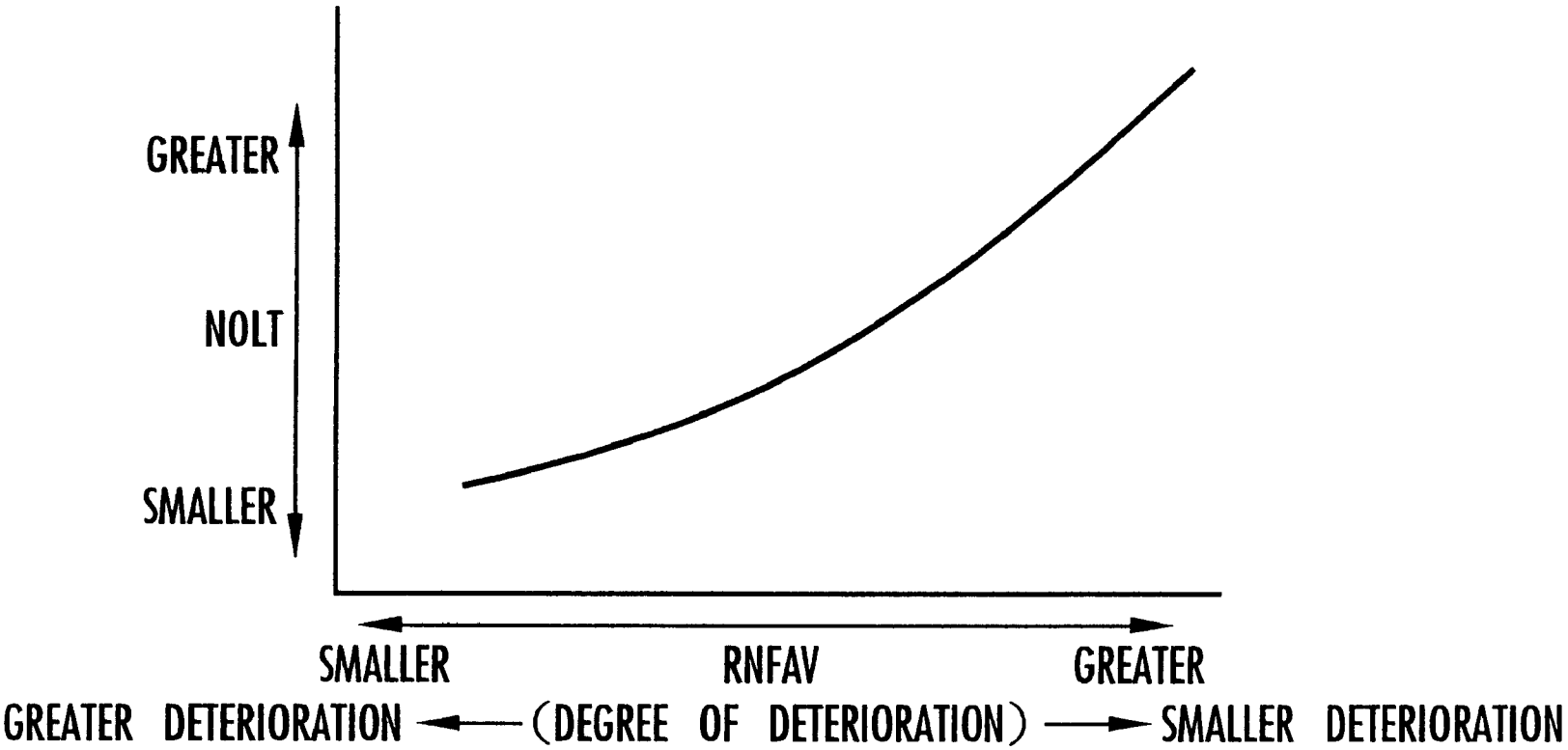
FIG. 11 is a diagram illustrating a portion of the subroutine shown in FIG. 10.

In the present embodiment, the threshold value NOLT is determined as shown in FIG. 11 depending on the latest degree of deterioration of the catalytic converter 3 recognized by the catalytic converter deterioration evaluating means 11, which will be described in detail later on. An average value RNFAV of the integrated reducing agent amount data RNF is used as representing the degree of deterioration of the catalytic converter 3, as described later on.

Specifically, the threshold value NOLT is smaller as the degree of deterioration of the catalytic converter 3 is higher, i.e., as the deterioration of the catalytic converter 3 is in greater progress. This is because as the deterioration of the catalytic converter 3, or specifically the NOx absorbent thereof, progresses, the amount of NOx that can be absorbed to a maximum by the catalytic converter 3, which corresponds to the absorbed NOx amount data Q/NOx in the saturated state, becomes smaller.

If Q/NOx>NOLT, then the absorption saturated-state recognizing means 15 judges that the absorption of NOx in the catalytic converter 3 is saturated. If Q/NOx≦NOLT, then the absorption saturated-state recognizing means 15 judges that the absorption of NOx in the catalytic converter 3 is not saturated.

If the absorption saturated-state recognizing means 15 judges that the absorption of NOx in the catalytic converter 3 is saturated (Q/NOx>NOLT) in STEPm-5, then the catalytic converter 3 is unable to absorb more NOx and NOx needs to be reduced. Therefore, the engine-side control unit 9 sets the value of the reduction decision flag F/NOxRF to "0" to disable the lean operation mode and switch to the stoichiometric operation mode in STEPm-6. In STEPm-6, the engine-side control unit 9 also sets the value of a flag F/WOCFLO to "1". The value of the flag F/WOCFLO is "1" when the lean operation mode has been continued until the absorption of NOx in the catalytic converter 3 is saturated, and "0" when the lean operation mode has not been continued until the absorption of NOx in the catalytic converter 3 is saturated. The flag F/WOCFLO (hereinafter referred to as "absorption saturated operation decision flag F/WOCFLO") is used in relation to the evaluation of the deteriorated state of the catalytic converter 3 by the catalytic converter deterioration evaluating means 11.

When the reduction decision flag F/NOxRF is set to "0" in STEPm-6, the operation mode is set to the stoichiometric operation mode in STEPb shown in FIG. 7 in a next control cycle of the engine-side control unit 9 (see FIG. 8). Therefore, the operation mode of the internal combustion engine 1 is switched to the stoichiometric operation mode, and NOx is reduced in the catalytic converter 3.

If the absorption saturated-state recognizing means 15 judges that the absorption of NOx in the catalytic converter 3 is not saturated (Q/NOx≦NOLT) in STEPm-5, then since the lean operation mode has not been continued until the absorption of NOx in the catalytic converter 3 is saturated, the absorption saturated-state recognizing means 15 sets the value of the absorption saturated operation decision flag F/WOCFLO to "0" in STEPm-7. Inasmuch as the catalytic converter 3 can absorb more NOx at this time, the reduction decision flag F/NOxRF remains to be of the present value (=1). Therefore, the lean operation mode is continuously carried out insofar as the condition of STEPb-2 shown in FIG. 8 is satisfied.

Details of the engine-side control unit 9 have been described above.

Now, the process of the exhaust-side control unit 8 will be described in detail below. While the operation mode is set to the stoichiometric operation mode, the exhaust-side control unit 8 executes a main routine shown in FIG. 12 in control cycle of a constant period concurrent with the above process of the engine-side control unit 9.

Figure 12:
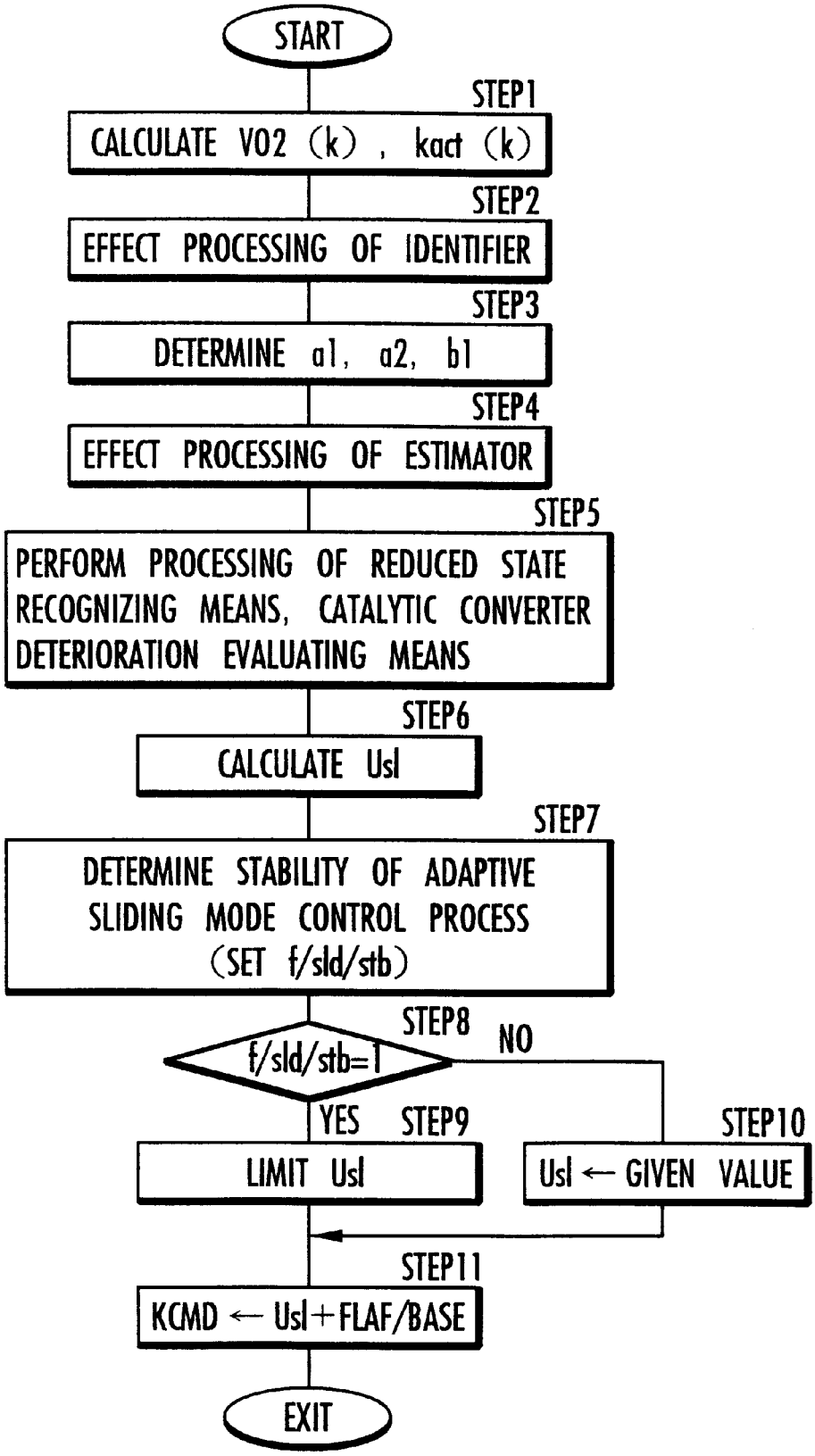
FIG. 12 is a flowchart of a processing sequence of the exhaust-side control unit of the apparatus shown in FIG. 1.

As shown in FIG. 12, the exhaust-side control unit 8 calculates the latest differential outputs kact(k) (=KACT−FLAF/BASE), VO2(k) (=VO2/OUT−VO2/TARGET) respectively from the subtractors 18, 19 in STEP1. Specifically, the subtractors 18, 19 select latest ones of the time-series data read and stored in the non-illustrated memory in STEPa shown in FIG. 7, calculate the differential outputs kact(k), VO2(k), and store the calculated differential outputs kact(k), VO2(k), as well as data given in the past, in a time-series manner in a memory (not shown) in the exhaust-side control unit 8.

Then, the exhaust-side control unit 8 effects the processing of the identifier 20 in STEP2.

Figure 13:
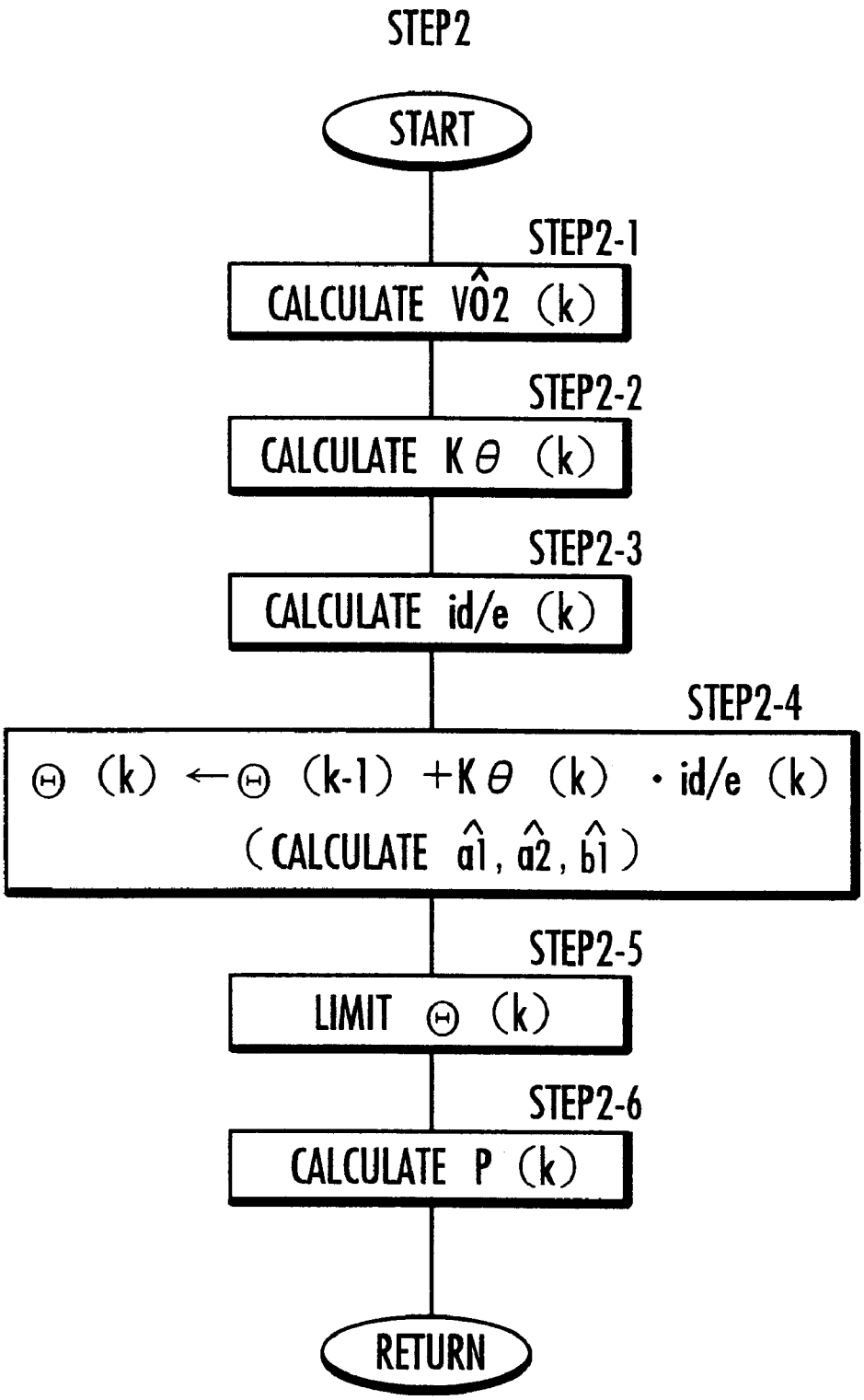
FIG. 13 is a flowchart of a subroutine of the processing sequence shown in FIG. 12.

The processing of the identifier 20 in STEP2 is shown in detail in FIG. 13.

The identifier 20 calculates the identified differential output VO2(k) hat, using the present identified gain coefficients a1(k-1) hat, a2(K-1) hat, b1(k-1) hat and the past data VO2(k-1), VO2(k-2), kact(k-d-1) of the differential outputs VO2, kact calculated in each control cycle in STEP1, in STEP2-1.

The identifier 20 then calculates the vector Kθ(k) to be used in determining the new identified gain coefficients a1 hat, a2 hat, b1 hat according to the equation (5) in STEP2-2. Thereafter, the identifier 20 calculated the identified error id/e(k), i.e., the difference between the identified differential output VO2(k) hat and the actual differential output VO2 (see the equation (3)) in STEP 2-3.

The identified error id/e(k) may basically be calculated according to the equation (3). In the present embodiment, however, a value (=VO2(k)−VO2(k) hat) calculated according to the equation (3) from the differential output VO2 calculated in each control cycle in STEP1 (see FIG. 12), and the identified differential output VO2 hat calculated in each control cycle in STEP2-2 is filtered with low-pass characteristics to calculate the identified error id/e(k).

This is because since the behavior of the exhaust system E including the catalytic converter 3, or more specifically the characteristics of changes of the output of the exhaust system E with respect to changes of the input of the exhaust system E, generally have low-pass characteristics, it is preferable to attach importance to the low-frequency behavior of the exhaust system E in appropriately identifying the gain coefficients a1, a2, b1 of the exhaust system model.

Both the differential output VO2 and the identified differential output VO2 hat may be filtered with the same low-pass characteristics. For example, after the differential output VO2 and the identified differential output VO2 hat have separately been filtered, the equation (3) may be calculated to determine the identified error id/e(k). The above filtering is carried out by a moving average process which is a digital filtering process, for example.

Thereafter, the identifier 20 calculates a new identified gain coefficient vector Θ(k), i.e., new identified gain coefficients a1(k) hat, a2(k) hat, b1(k) hat, according to the equation (4) using the identified error id/e(k) determined in STEP2-3 and Kθ(k) calculated in SETP2-2 in STEP2-4.

After having calculated the new identified gain coefficients a1(k) hat, a2(k) hat, b1(k) hat, the identifier 20 limits the values of the identified gain coefficients a1 hat, a2 hat, b1 hat (elements of the identified gain coefficient vector Θ), to meet predetermined conditions in STEP2-5. Then, the identifier 20 updates the matrix P(k) according to the equation (6) for the processing of a next control cycle in STEP2-6, after which control returns to the main routine shown in FIG. 12.

The process of limiting the values of the identified gain coefficients a1 hat, a2 hat, b1 hat in STEP2-5 comprises a process of limiting combinations of the identified gain coefficients a1(k) hat, a2(k) hat to a certain combination, i.e., a process of limiting points (a1 hat, a2 hat) within a certain area on a coordinate plane whose components are represented by the identified gain coefficients a1 hat, a2 hat, and a process of limiting the value of the identified gain coefficient b1 hat within a certain range. In the former process, if the points (a1 hat, a2 hat) on the coordinate plane determined by the identified gain coefficients a1(k) hat, a2(k) hat calculated in STEP2-4 deviate from the certain area on the coordinate plane, then the values of the identified gain coefficients a1(k) hat, a2(k) hat are forcibly limited to the values of points in the certain region. In the latter process, if the value of the identified gain coefficient b1 hat exceeds an upper limit or lower limit of the certain range, then the value of the identified gain coefficient b1 hat is forcibly limited to the upper limit or lower limit of the certain range.

The above process of limiting the values of the identified gain coefficients a1 hat, a2 hat, b1 hat is carried out to maintain stability of the SLD manipulating input Usl (the target differential air-fuel ratio kcmd) calculated by the sliding mode controller 22 and hence the target air-fuel ratio KCMD.

Specific details of the process of limiting the values of the identified gain coefficients a1 hat, a2 hat, b1 hat are described in detail in Japanese laid-open patent publication No. 11-153051, for example, and will not be described below.

The preceding values a1(k−1) hat, a2(k−1) hat, b1(k−1) hat of the identified gain coefficients used to determine the new identified gain coefficients a1(k) hat, a2(k) hat, b1(k) hat in STEP2-4 shown in FIG. 13 are the values of the identified gain coefficients which have been limited in STEP2-5 in the preceding control cycle.

In a situation where the supply of fuel to the internal combustion engine 1 is cut off, i.e., the fuel injection is stopped, or the throttle valve is substantially fully opened, while the internal combustion engine 1 is in the stoichiometric operation mode, the identifier 20 does not update the values of the identified gain coefficients a1 hat, a2 hat, b1 hat, but keeps their present values.

The values of the identified gain coefficients a1 hat, a2 hat, b1 hat and the values of the elements of the matrix P are initialized to predetermined values while the internal combustion engine 1 is in the lean operation mode.

In FIG. 12, after the processing of the identifier 20 has been carried out, the exhaust-side control unit 8 determines the values of the gain coefficients a1, a2, b1 in STEP3. Specifically, the gain coefficients a1, a2, b1 are set to the latest identified gain coefficients a1 hat, a2 hat, b1 hat determined by the identifier 20 in STEP2 (limited in STEP2-5). In a situation where the supply of fuel to the internal combustion engine 1 is cut off, i.e., the fuel injection is stopped, or the throttle valve is substantially fully opened, while the internal combustion engine 1 is in the stoichiometric operation mode, if the identifier 20 does not update the values of the identified gain coefficients a1 hat, a2 hat, b1 hat, the gain coefficients a1, a2, b1 are set to predetermined values, i.e., values determined in the preceding control cycle.

Then, the exhaust-side control unit 8 effects a processing operation of the estimator 21, i.e., calculates the estimated differential output VO2 bar, in STEP4.

The estimator 21 calculates the coefficients α1, α2, βj (j=1, 2, . . . , d) to be used in the equation (7), using the gain coefficients a1, a2, b1 determined in STEP3 (these values are basically the identified gain coefficients a1 hat, a2 hat, b1 hat) as described above.

Then, the estimator 21 calculates the estimated differential output VO2(k+d) bar (the estimated value of the differential output VO2 after the dead time d of the exhaust system E from the time of the present control cycle) according to the equation (7), using the time-series data VO2(k), VO2(k−1), from before the present control cycle, of the differential output VO2 of the $O_2$ sensor 5 calculated in each control cycle in STEP1, the time-series data kact(k−j) (j=1, 2, . . . , d1), from before the present control cycle, of the differential output kact of the LAF sensor 4, and the coefficients α1, α2, βj calculated as described above.

The exhaust-side control unit 8 then performs the process of the reduced-state recognizing means 12 and also executes the process of the catalytic converter deterioration evaluating means 11.

Figure 14:
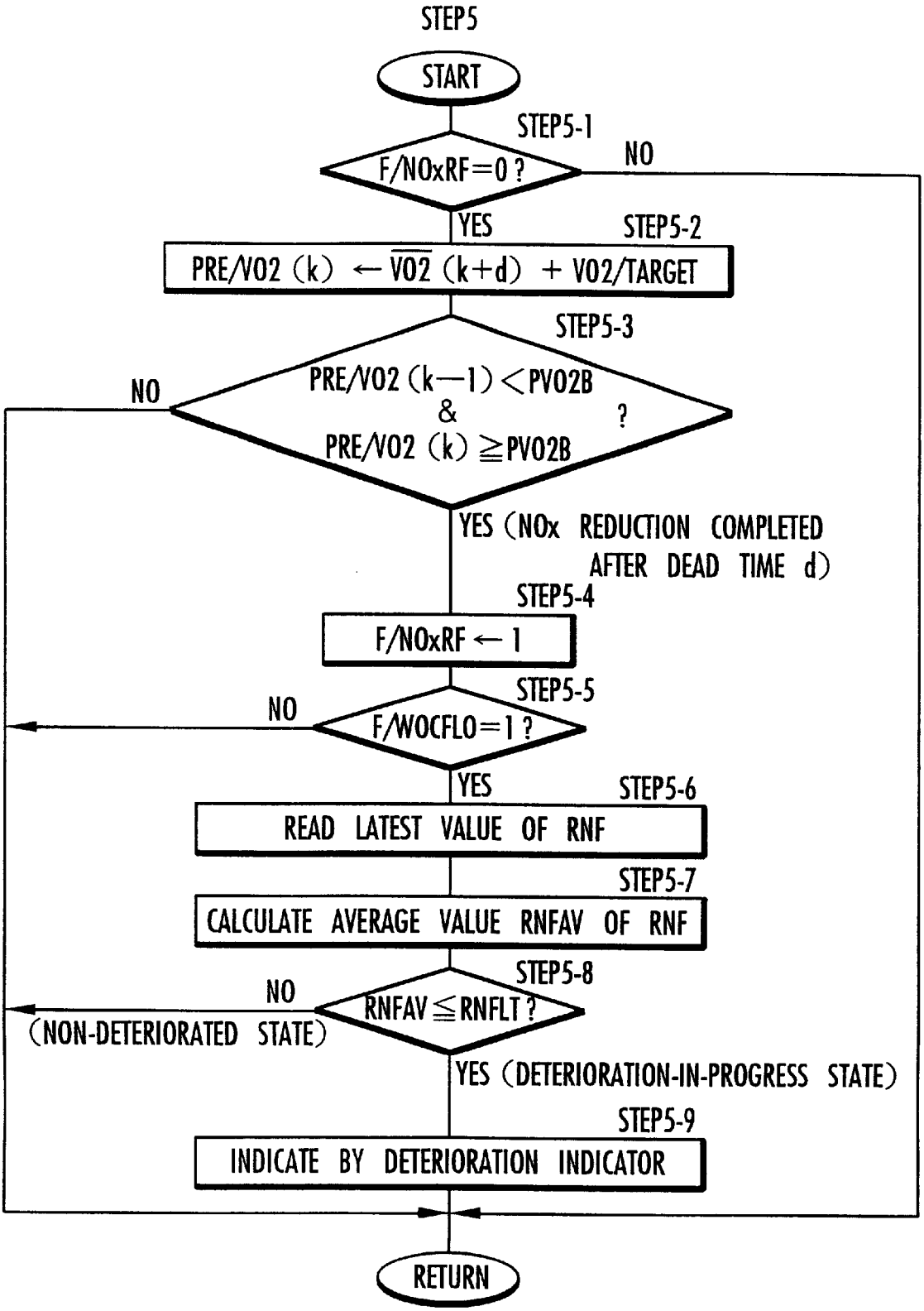
FIG. 14 is a flowchart of a subroutine of the processing sequence shown in FIG. 12.
Figure 15:
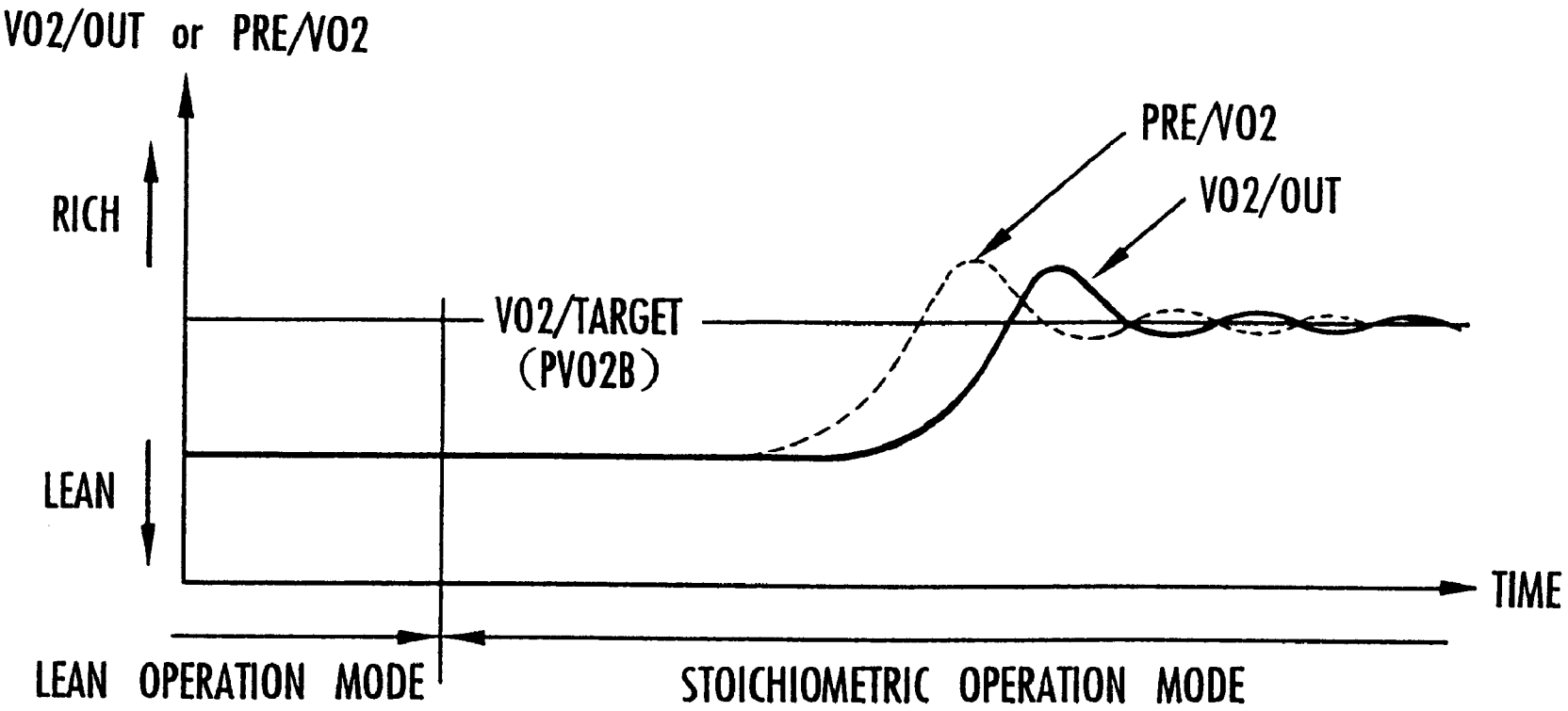
FIG. 15 is a diagram illustrating a portion of the subroutine shown in FIG. 14.

This processing sequence of the exhaust-side control unit 8 is shown in FIG. 14. The exhaust-side control unit 8 determines whether conditions to estimate the deteriorated state of the catalytic converter 3 are satisfied or not in STEP5-1 through STEP5-5.

Specifically, the exhaust-side control unit 8 determines the value of the reduction decision flag F/NOxRF in STEP5-

1. If F/NOxRF=1, i.e., if the reduction of NOx in the catalytic converter 3 is completed as described later on, then control immediately goes back to the processing sequence shown in FIG. 12.

Immediately after the operation mode of the internal combustion engine 1 switches from the lean operation mode to the stoichiometric operation mode, F/NOxRF=0 because of the processing in STEPk-2 shown in FIG. 9. When F/NOxRF=0, the exhaust-side control unit 8 adds the target value VO2/TARGET to the estimated differential output VO2(k+d) bar in the present control cycle which has been determined by the estimator 21 in STEP4, thus determining an estimated output PRE/VO2(k) which represents the estimated value of the output VO2/OUT of the $O_2$ sensor 5 which is the dead time d later than the present control cycle in STEP5-2.

Then, the reduced-state recognizing means 12 compares a present value PRE/VO2(k) and a preceding value PRE/VO2 (k−1) of the estimated output PRE/VO2 with a predetermined threshold value PVO2B to determine whether the reduction of NOx in the catalytic converter 3 is completed after the dead time d or not in STEP5-3.

Immediately after the operation mode of the internal combustion engine 1 switches from the lean operation mode to the stoichiometric operation mode, the output VO2/OUT of the $O_2$ sensor 5 and the estimated output PRE/VO2 thereof after the dead time d represent a leaner air-fuel ratio due to the effect of the prior lean operation mode. As the stoichiometric operation mode, i.e., the operation mode for controlling the upstream-of-catalytic-converter air-fuel ratio to converge the estimated differential output VO2 bar of the $O_2$ sensor 5 to the target value VO2/TARGET and hence to converge the actual output VO2/OUT of the $O_2$ sensor 5 to the target value VO2/TARGET, progresses, the output VO2/OUT of the $O_2$ sensor 5 and the estimated output PRE/VO2 thereof are shifted to a rich value and then finally converged to the target value VO2/TARGET.

When the reduction of NOx in the catalytic converter 3 is actually completed, the actual output VO2/OUT of the $O_2$ sensor 5 changes substantially simultaneously from a lean value to a rich value. Since the estimated output PRE/VO2 is an estimated value of the output of the $O_2$ sensor 5 after the dead time d, when the estimated output PRE/VO2 changes from a lean value to a rich value, the actual output VO2/OUT of the $O_2$ sensor 5 also basically changes from a lean value to a rich value at a time which is the dead time d later than the time at which the estimated output PRE/VO2 has changed.

In STEP5-3, the reduced-state recognizing means 12 employs the output VO2/OUT of the $O_2$ sensor 5 close to the stoichiometric air-fuel ratio, e.g., the target value VO2/TARGET, as the threshold value PVO2B, and compares the threshold value PVO2B with the present value PRE/VO2(k) and the preceding value PRE/VO2(k−1) of the estimated output PRE/VO2 determined in STEP5-2. If PRE/VO2(k−1)<PVO2B and PRE/VO2(k)≧PVO2B, i.e., when the estimated output PRE/VO2 changes from a lean value to a rich value, it is determined that the reduction of NOx in the catalytic converter 3 is completed after the dead time d.

The threshold value PVO2B may be a value which is slightly shifted from the target value VO2/TARGET toward a lean value.

If PRE/VO2(k−1)<PVO2B and PRE/VO2(k)≧PVO2B, i.e., the reduced-state recognizing means 12 determines that the reduction of NOx in the catalytic converter 3 is completed after the dead time d, then the exhaust-side control unit 7 sets the value of the reduction decision flag F/NOxRF to "1" in STEP5-4. The operation mode of the internal combustion engine 1 can now change from the stoichiometric operation mode to the lean operation mode (see FIG. 8).

Then, the exhaust-side control unit 7 determines the value of the absorption saturated operation decision flag F/WOCFLO that is set in the processing in STEPm (see FIG. 10) in the lean operation mode in STEP5-5.

If F/WOCFLO=1, i.e., if the lean operation mode prior to the present stoichiometric operation mode has been continued until the absorption of NOx in the catalytic converter 3 is saturated, the catalytic converter deterioration evaluating means 11 evaluates the deteriorated state of the catalytic converter 3 in STEP5-6 through STEP5-9.

Specifically, the catalytic converter deterioration evaluating means 11 reads the latest value (present value) of the integrated reducing agent amount data RNF which is determined in STEPk by the reducing agent amount data generating means 16 of the engine-side control unit 9 concurrent with the process of the exhaust-side control unit 8 in the stoichiometric operation mode in STEP5-6.

The integrated reducing agent amount data RNF read in STEP5-6, including those data read in the past, are stored in a time-series fashion in a memory (not shown). The memory for storing the integrated reducing agent amount data RNF comprises a nonvolatile memory such as an EEPROM so that the stored time-series data of the integrated reducing agent amount data RNF will not be lost when the internal combustion engine 1 is shut off.

Then, the catalytic converter deterioration evaluating means 11 determines an average RNFAV of a predetermined number of latest integrated reducing agent amount data RNF of the time-series data of the integrated reducing agent amount data RNF stored in the memory, as representing the degree of deterioration of the catalytic converter 3, or more precisely the degree of deterioration of the NOx absorbent included in the catalytic converter 3 in STEP5-7.

Figure 16:
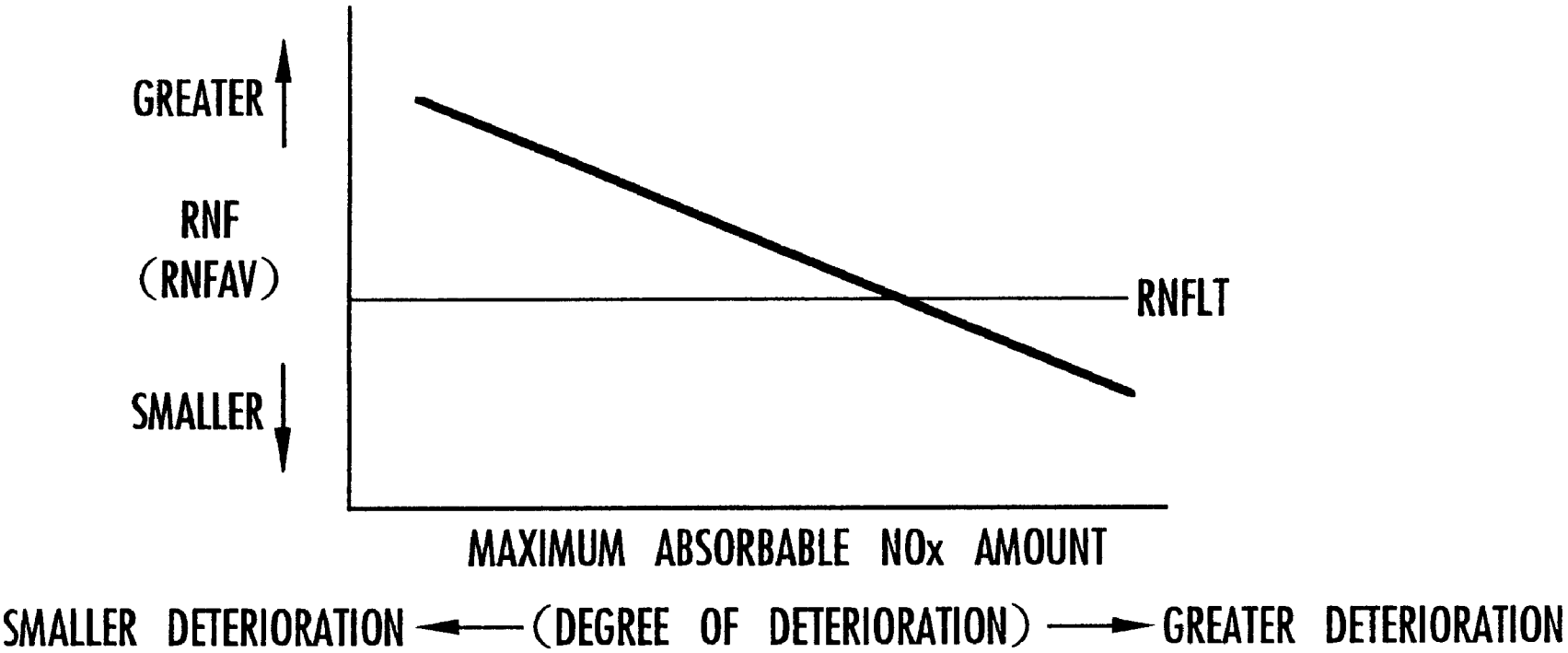
FIG. 16 is a diagram illustrating a portion of the subroutine shown in FIG. 14.

Since the integrated reducing agent amount data RNF read in STEP5-6 is read when the conditions of STEP5-3, STEP5-5 are satisfied, it is the integrated reducing agent amount data RNF at the time it is determined that the reduction of NOx in the catalytic converter 3 is finished after the dead time d. In addition, the integrated reducing agent amount data RNF is determined during the stoichiometric operation mode after the lean operation mode has been carried out until it is determined that the absorption of NOx in the catalytic converter is saturated. Therefore, the integrated reducing agent amount data RNF corresponds to the amount of NOx that can be absorbed to a maximum by the catalytic converter 3 (hereinafter referred to as "maximum absorbable NOx amount"). As the deterioration of the NOx absorbent of the catalytic converter 3 progresses, the maximum absorbable NOx amount decreases monotonously. Therefore, the integrated reducing agent amount data RNF and the maximum absorbable NOx amount or the degree of deterioration of the catalytic converter 3 are related to each other as shown in FIG. 16.

Specifically, as the deterioration of the catalytic converter 3 progresses and the maximum absorbable NOx amount decreases, the value of the integrated reducing agent amount data RNF read in STEP5-6 also decreases. Therefore, the average RNFAV of the integrated reducing agent amount data RNF also decreases monotonously as the deterioration of the catalytic converter 3 progresses, and hence represents the degree of deterioration of the catalytic converter 3. While the integrated reducing agent amount data RNF may vary due to a disturbance or the like, the average RNFAV thereof distinctly exhibits the above tendency with respect to the degree of deterioration of the catalytic converter 3.

After having determined the average RNFAV of the integrated reducing agent amount data RNF, the catalytic converter deterioration evaluating means 11 compares the average RNFAV with a predetermined threshold value RNFLT (see FIG. 16) in STEP5-8.

In the present embodiment, specifically, the degree of deterioration of the catalytic converter 3 is evaluated to judge whether the catalytic converter 3 is in a state where it has been deteriorated to the extent that it needs to be replaced immediately or soon (such a deteriorated state will hereinafter be referred to as "deterioration-in-progress state", or not (a state of the catalytic converter 3 which is not in the deterioration-in-progress state will hereinafter be referred to as "non-deteriorated state"). If RNFAV≦RNFLT (FIG. 16), then the catalytic converter deterioration evaluating means 11 judges the catalytic converter 3 as being in the deterioration-in-progress state, and if RNFAV>RNFLT, then the catalytic converter deterioration evaluating means 11 judges the catalytic converter 3 as being in the non-deteriorated state. When the catalytic converter deterioration evaluating means 11 judges the catalytic converter 3 as being in the deterioration-in-progress state, the catalytic converter deterioration evaluating means 11 operates the deterioration indicator 7 to indicate the deterioration-in-progress state in STEP5-9. When the catalytic converter deterioration evaluating means 11 judges the catalytic converter 3 as being in the non-deteriorated state, the catalytic converter deterioration evaluating means 11 does not operate the deterioration indicator 7, but finishes the processing in STEP5, after which control returns to the main routine shown in FIG. 12.

If the conditions of PRE/VO2(k−1)<PVO2B and PRE/VO2(k)≧PVO2B in STEP5-3 are not satisfied, then since the reduction of NOx in the catalytic converter 3 has not yet been completed after the dead time d, the catalytic converter deterioration evaluating means 11 does not perform the processing from STEP5-4, but finishes the processing in STEP5. In this case, the reduction decision flag F/NOxRF is kept at "0", and the lean operation mode is continuously inhibited.

If F/WOCFLO=0 in STEP5-5, i.e., if the lean operation mode prior to the stoichiometric operation mode has not been carried out until the absorption of NOx in the catalytic converter 3 is saturated, then the catalytic converter deterioration evaluating means 11 does not perform the processing from STEP5-6, but finishes the processing in STEP5.

If the reduced-state recognizing means 12 judges that the reduction of NOx in the catalytic converter 3 is completed after the dead time d based on the estimated output PRE/VO2 which represents the estimated value of the output VO2/OUT of the $O_2$ sensor 5 after the dead time d, then since the reduction decision flag F/NOxRF is set to "1" in STEP5-4, the lean operation mode is carried out in and after a next control cycle if the internal combustion engine 1 operates when the internal combustion engine 1 operates with the condition of STEPb-2 shown in FIG. 8 being satisfied.

If and only if the lean operation mode prior to the stoichiometric operation mode for performing the process of the exhaust-side control unit 8 has been carried out until the absorption of NOx in the catalytic converter 3 is saturated, then the converter deterioration evaluating means 11 evaluates the deteriorated state of the catalytic converter 3 when the reduced-state recognizing means 12 has made the above recognition.

After having performed the processing in STEP5 in FIG. 12, the exhaust-side control unit 8 calculates the SLD manipulating input Usl (=the target differential air-fuel ratio kcmd) with the sliding mode controller 22 in STEP6.

Specifically, the sliding mode controller 22 calculates a value σ(k+d) bar (corresponding to an estimated value, after the dead time d, of the switching function a defined according to the equation (8)), after the dead time d from the present control cycle, of the switching function a bar defined according to the equation (17), using the time-series data VO2(k+d) bar, VO2(k+d−1) bar of the estimated differential output VO2 bar determined by the estimator 21.

At this time, the sliding mode controller 22 keeps the value of the switching function a bar within a predetermined allowable range. If the value σ(k+d) bar determined as described above exceeds the upper or lower limit of the allowable range, then the sliding mode controller 22 forcibly limits the value σ(k+d) bar to the upper or lower limit of the allowable range. This is because if the value of the switching function a bar were excessive, the reaching control law input Urch would be excessive, and the adaptive control law Uadp would change abruptly, tending to impair the stability of the process of converging the output VO2/OUT of the $O_2$ sensor 5 to the target value VO2/TARGET.

Then, the sliding mode controller 22 accumulatively adds values σ(k+d) bar·ΔT, produced by multiplying the value σ(k+d) bar of the switching function a bar by the period ΔT (constant period) of the control cycles of the exhaust-side control unit 8. That is, the sliding mode controller 22 adds the product σ(k+d) bar·ΔT of the value σ(k+d) bar and the period ΔT calculated in the present control cycle to the sum determined in the preceding control cycle, thus calculating an integrated value σ bar (hereinafter represented by "Σσ bar") which is the calculated result of the term Σ(σ bar·ΔT) of the equation (19).

In the present embodiment, the sliding mode controller 22 keeps the integrated value Σσ bar in a predetermined allowable range. If the integrated value Σσ bar exceeds the upper or lower limit of the allowable range, then the sliding mode controller 22 forcibly limits the integrated value Σσ bar to the upper or lower limit of the allowable range. This is because if the integrated value Σσ bar were excessive, the adaptive control law Uadp determined according to the equation (19) would be excessive, tending to impair the stability of the process of converging the output VO2/OUT of the $O_2$ sensor 5 to the target value VO2/TARGET.

Then, the sliding mode controller 22 calculates the equivalent control input Ueq, the reaching control law input Urch, and the adaptive control law Uadp according to the respective equations (16), (18), (19), using the time-series data VO2(k+d)bar, VO2(k+d−1) bar of the present and past values of the estimated differential output VO2 bar determined by the estimator 21 in STEP4, the value σ(k+d) bar of the switching function a and its integrated value Σσ bar which are determined as described above, and the gain coefficients a1, a2, b1 determined in STEP 3 (these values are basically the latest identified gain coefficients a1(k) hat, a2(k) hat, b1(k) hat).

The sliding mode controller 22 then adds the equivalent control input Ueq, the reaching control law input Urch, and the adaptive control law Uadp to calculate the SLD manipulating input Usl, i.e., the input (=the target differential air-fuel ratio kcmd) to be applied to the exhaust system E for converging SLD manipulating input Usl, i.e., the estimated output PRE/VO2 of the $O_2$ sensor 5 and the actual output VO2/OUT thereof, toward the target value VO2/TARGET.

After the SLD manipulating input Usl has been calculated, the exhaust-side control unit 8 determines the stability of the adaptive sliding mode control process carried out by the sliding mode controller 22, or more specifically, the ability of the controlled state of the output VO2/OUT of the $O_2$ sensor 5 based on the adaptive sliding mode control process (hereinafter referred to as USLD controlled state"), and sets a value of a flag f/sld/stb indicative of whether the SLD controlled state is stable or not in STEP7. The value of the flag f/sld/stb. is "1" if the SLD controlled state is stable, and "0" otherwise.

Figure 17:
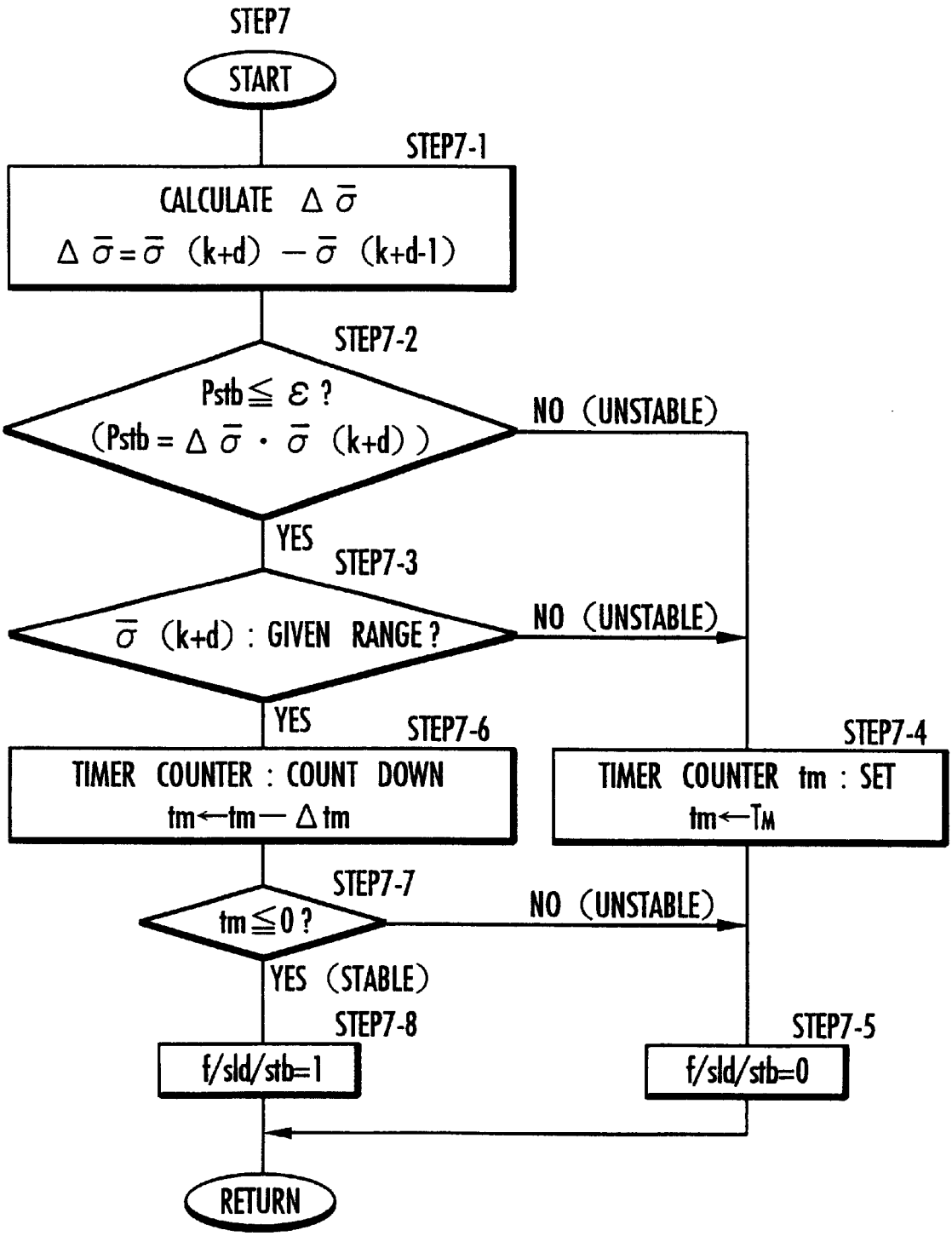
FIG. 17 is a flowchart of a subroutine of the processing sequence shown in FIG. 12.

The determining subroutine of STEP7 is shown in detail in FIG. 17.

As shown in FIG. 23, the exhaust-side control unit 8 calculates a difference Δσ bar (corresponding to a rate of change of the switching function σ bar) between the present value σ(k+d) bar of the switching function a bar calculated in STEP6 and a preceding value σ(k+d−1) bar thereof in STEP7-1.

Then, the exhaust-side control unit 8 decides whether or not a product Δσbar·σ(k+d) bar (corresponding to the time-differentiated function of a Lyapunov function σ $bar^2/2$ relative to the σ bar) of the difference Δσ bar and the present value σ(k+d) bar is equal to or smaller than a predetermined value ε (≧0) in STEP7-2.

The difference Δσ bar·σ(k+d) bar (hereinafter referred to as "stability determining parameter Pstb") will be described below. If the stability determining parameter Pstb is greater than 0 (Pstb>0), then the value of the switching function σ bar is basically changing away from "0". If the stability determining parameter Pstb is equal to or smaller than 0 (Pstb≦0), then the value of the switching function a bar is basically converged or converging to "0". Generally, in order to converge a controlled variable to its target value according to the sliding mode control process, it is necessary that the value of the switching function be stably converged to "0". Basically, therefore, it is possible to determine whether the SLD controlled state is stable or unstable depending on whether or not the value of the stability determining parameter Pstb is equal to or smaller than 0.

If, however, the stability of the SLD controlled state is determined by comparing the value of the stability determining parameter Pstb with "0", then the determined result of the stability is affected even by slight noise contained in the value of the switching function σ bar. According to the present embodiment, therefore, the predetermined value ε with which the stability determining parameter Pstb is to be compared in STEP7-2 is of a positive value slightly greater than "0".

If Pstb>ε in STEP7-2, then the SLD controlled state is judged as being unstable, and the value of a timer counter tm (count-down timer) is set to a predetermined initial value $T_M$ (the timer counter tm is started) in order to inhibit the determination of the target air-fuel ratio KCMD using the SLD manipulating input Usl calculated in STEP6 for a predetermined time in STEP7-4. Thereafter, the value of the flag f/sld/stb is set to "0" in STEP7-5, after which control returns to the main routine shown in FIG. 12.

If Pstb 23 ε in STEP7-2, then the exhaust-side control unit 8 decides whether the present value σ(k+d) bar of the switching function σ bar falls within a predetermined range or not in STEP7-3.

If the present value σ(k+d) bar of the switching function σ bar does not fall within the predetermined range, then since the present value σ(k+d) bar is spaced widely apart from "0", the SLD controlled state is considered to be unstable. Therefore, if the present value σ(k+d) bar of the switching function σ bar does not fall within the predetermined range in STEP7-3, then the SLD controlled state is judged as being unstable, and the processing of STEP7-4 and STEP7-5 is executed to start the timer counter tm and set the value of the flag f/sld/stb to "0".

In the present embodiment, since the value of the switching function σ bar is limited within the allowable range in STEP6, the decision processing in STEP7-3 may be dispensed with.

If the present value σ(k+d) bar of the switching function σ bar falls within the predetermined range in STEP7-3, then the exhaust-side control unit 8 counts down the timer counter tm for a predetermined time Δtm in STEP7-6. The exhaust-side control unit 8 then decides whether or not the value of the timer counter tm is equal to or smaller than "0", i.e., whether a time corresponding to the initial value $T_M$ has elapsed from the start of the timer counter tm or not, in STEP7-7.

If tm>0, i.e., if the timer counter tm is still measuring time and its set time has not yet elapsed, then since no substantial time has elapsed after the SLD controlled state is judged as unstable in STEP7-2 or STEP7-3, the SLD controlled state tends to become unstable. Therefore, if tm>0 in STEP7-7, then the value of the flag f/sld/stb is set to "0" in STEP7-5.

If tm≦0 in STEP7-7, i.e., if the set time of the timer counter tm has elapsed, then the SLD controlled stage is judged as being stable, and the value of the flag f/sld/stb is set to "1" in STEP7-8.

According to the above processing, if the SLD controlled state is judged as being unstable, then the value of the flag f/sld/stb is set to "0", and if the SLD controlled state is judged as being stable, then the value of the flag f/sld/stb is set to "1".

In the present embodiment, the above process of determining the stability of the SLD controlled state is by way of illustrative example only. The stability of the SLD controlled state may be determined by any of various other processes. For example, in each given period longer than the control cycle, the frequency with which the value of the stability determining parameter Pstb in the period is greater than the predetermined value ε is counted. If the frequency is in excess of a predetermined value, then the SLD controlled state is judged as unstable. Otherwise, the SLD controlled state is judged as stable.

Referring back to FIG. 12, after a value of the flag f/sld/stb indicative of the stability of the SLD controlled state has been set, the exhaust-side control unit 8 determines the value of the flag f/sld/stb in STEP8. If the value of the flag f/sld/stb is "1", i.e., if the SLD controlled state is judged as being stable, then the sliding mode controller 22 limits the SLD manipulating input Usl calculated in STEP6 in STEP9. Specifically, the sliding mode controller 22 determines whether the present value of the SLD manipulating input Usl calculated in STEP6 falls in a predetermined allowable range or not. If the present value of the SLD manipulating input Usl exceeds the upper or lower limit of the allowable range, then the sliding mode controller 22 forcibly limits the present value Usl(k) of the SLD manipulating input Usl to the upper or lower limit of the allowable range.

Then, the exhaust-side control unit 8 adds the reference value FLAF/BASE to the SLD manipulating input Usl which has been limited in STEP9 by the sliding mode controller 22 for thereby determining a target air-fuel ratio KCMD in STEP 11. Then, the processing in the present control cycle is finished.

If f/sld/stb=0 in STEP11, i.e., if the SLD controlled state is judged as unstable, in STEP8, then the exhaust-side control unit 8 forcibly sets the value of the SLD manipulating input Usl in the present control cycle to a predetermined value (e.g., the fixed value or the preceding value of the SLD manipulating input Usl) in STEP10. The exhaust-side control unit 8 then calculates the target air-fuel ratio KCMD according to the equation (20) in STEP 11. Then, the processing in the present control cycle is finished.

The target air-fuel ratio KCMD finally determined in STEP11 is stored in a memory (not shown) in a time-series fashion in each control cycle. When the engine-side control unit 9 is to use the target air-fuel ratio KCMD determined by the exhaust-side control unit 8 in the stoichiometric operation mode as the actually used target air-fuel ratio RKCMD (see STEPd in FIG. 7), the latest one of the time-series data of the target air-fuel ratio KCMD thus stored is selected. In the stoichiometric operation mode, the engine-side control unit 9 regulates the fuel injection quantity for the internal combustion engine 1 in order to converge the output KACT of the LAF sensor 4 (the detected upstream-of-catalytic-converter air-fuel ratio) to the target air-fuel ratio KCMD for thereby controlling the upstream-of-catalytic-converter air-fuel ratio at the target air-fuel ratio KCMD. That is, the upstream-of-catalytic-converter air-fuel ratio is controlled to converge the estimated value PRE/VO2 (=VO2 bar+VO2/TARGET) of the output of the $O_2$ sensor 5 after the dead time d to the target value VO2/TARGET and hence to converge the actual output VO2/OUT of the $O_2$ sensor 5 to the target value VO2/TARGET.

In the embodiment described above, when the operation mode of the internal combustion engine 1 changes from the lean operation mode to the stoichiometric operation mode, the reduced-state recognizing means 12 sequentially (in each control cycle of the exhaust-side control unit 8) recognizes whether the reduction of NOx in the catalytic converter 3 is completed after the dead time d or not, based on the estimated output PRE/VO2 of the $O_2$ sensor 5 that is determined by the estimated differential output VO2 bar determined by the estimator 21 in the stoichiometric operation mode (see STEP5-3 shown in FIG. 14). At this time, when the lean operation mode switches to the stoichiometric operation mode, the reduction decision flag is set to "0" (see STEPk-2 in FIG. 9), and the reduction decision flag F/NOxRF is kept at "0" until it is recognized that the reduction of NOx in the catalytic converter 3 is completed after the dead time d. Thereafter, until the above recognition is made, the operation mode is inhibited from changing from the stoichiometric operation mode to the lean operation mode. After the above recognition is made, since the reduction decision flag F/NOXRF is set to "1" (see STEP5-4 shown in FIG. 14), the operation mode changes from the stoichiometric operation mode to the lean operation mode if the condition of STEPb-2 shown in FIG. 8 is satisfied. Thus, even if the reduction of NOx in the catalytic converter 3 is not actually completed, it is possible to operate the internal combustion engine 1 in the lean operation mode from the time at which it is expected that the reduction of NOx in the catalytic converter 3 will be completed after the dead time d. Therefore, there are provided more opportunities for operating the internal combustion engine 1 in the lean operation mode, reducing the fuel consumption and also minimizing the amount of harmful gases contained in the exhaust gas.

In the stoichiometric operation mode, the target air-fuel ratio KCMD defining the upstream-of-catalytic-converter air-fuel ratio is generated according to the adaptive sliding mode control process carried out by the sliding mode controller 22. The upstream-of-catalytic-converter air-fuel ratio is controlled at the target air-fuel ratio KCMD primarily by the adaptive controller 31 which is a recursive control means. Thereafter, immediately after the lean operation mode switches to the stoichiometric operation mode, the upstream-of-catalytic-converter air-fuel ratio is controlled to converge the estimated value PRE/VO2 of the $O_2$ sensor 5 and hence the actual output VO2/OUT thereof quickly to the target value VO2/TARGET. Therefore, the reduction of NOx in the catalytic converter progresses smoothly and quickly. It is thus recognized that the reduction of NOx in the catalytic converter 3 is actually completed after the dead time d, in a relatively short time after the stoichiometric operation mode has started. The period in which the lean operation mode is inhibited for completing the reduction of NOx after the dead time d after the stoichiometric operation mode has started is made relatively short. As a result, the time to make it possible to switch from the stoichiometric operation mode to the lean operation mode can be made earlier, and hence more opportunities are provided to operate the internal combustion engine 1 in the lean operation mode. At the same time, by controlling the upstream-of-catalytic-converter air-fuel ratio as described above, an optimum purifying capability of the catalytic converter 3 can quickly be achieved in a situation where the stoichiometric operation mode is to be performed continuously.

The algorithm of the process for the estimator 21 to determine the estimated differential output VO2 bar is constructed on the basis of the exhaust system model expressed according to the equation (1) in view of the response delay and dead time of the exhaust system E. The gain coefficients a1, a2, b1 which are parameters of the exhaust system E are identified on a real-time basis depending on the actual behavior of the exhaust system E by the identifier 20. The estimated differential output VO2 is determined using the gain coefficients a1, a2, b1 and the differential output kact of the LAF sensor 4 and the differential output VO2 of the $O_2$ sensor 5 which are respective detected values of the input and output of the exhaust system E. Therefore, the estimated differential output VO2 and hence the estimated output PRE/VO2 of the $O_2$ sensor 5 are made highly reliable and accurate. If it is recognized that the reduction of NOx in the catalytic converter 3 is completed after the dead time d based on the estimated output PRE/VO2, then the reduction of NOx in the catalytic converter 3 will actually be completed reliably when the dead time actually elapses from the recognized time. Therefore, the catalytic converter 3 can absorb NOx without fail even if the lean operation mode is performed immediately after the above recognition is made. Since NOx can be absorbed to a maximum from the state in which the reduction of NOx in the catalytic converter 3 is completed, the period in which the lean operation mode is carried out can be increased.

In the present invention, furthermore, whether the absorption of NOx in the catalytic converter 3 is saturated or not in the lean operation mode is recognized by sequentially comparing the absorbed NOx amount data Q/NOx with the threshold value NOLT. When the saturation of the absorption of NOx is recognized, the reduction decision flag F/NOxRF is set to "0" (see STEPm-6 shown in FIG. 10), inhibiting the lean operation mode. (At this time, the operation mode switches from the lean operation mode to the stoichiometric operation mode.) The threshold NOLT to be compared with the reduction decision flag F/NOxRF for recognizing the saturation of NOx is established as shown in FIG. 11 depending on the latest degree of deterioration recognized by the catalytic converter deterioration evaluating means 11, i.e., the average RNFAV of the integrated reducing agent amount data RNF obtained in STEP5-6 shown in FIG. 14. Therefore, the lean operation mode is reliably prevented from being carried out continuously while the catalytic converter 3 is incapable of absorbing NOx.

Regarding the evaluation of the deteriorated state of the catalytic converter 3 with the catalytic converter deterioration evaluating means 11, only when the lean operation mode is carried out until the absorption saturated-state recognizing means 15 recognizes that the absorption of NOx in the catalytic converter 3 is saturated, i.e., the absorption saturated operation decision flag F/WOCFLO becomes "1", the integrated reducing agent amount data RNF determined by the reducing agent amount data generating means 16 (the integrated reducing agent amount data RNF obtained in STEP5-6 shown in FIG. 14) in a period after the stoichiometric operation mode is started following the above lean operation mode until the reduced-state recognizing means 12 recognizes that the reduction of NOx in the catalytic converter 3 is completed after the dead time d is obtained as representing the degree of deterioration of the catalytic converter 3. The deteriorated state of the catalytic converter 3 is evaluated based on the average RNFAV of the integrated reducing agent amount data RNF.

Since the reduced-state recognizing means 12 makes the above recognition based on the highly reliable estimated output PRE/VO2 of the $O_2$ sensor 5, the integrated reducing agent amount data RNF obtained in STEP5-6 is highly reliable as representing the required amount of reducing agents for reducing all the amount of NOx that has been absorbed to a maximum by the catalytic converter 3 until it is saturated. That is, the integrated reducing agent amount data RNF obtained in STEP5-6 is highly reliable as corresponding to the total amount of NOx (the maximum absorbable NOx amount) that can be absorbed to a maximum by the catalytic converter 3 in its present deteriorated state. Therefore, the deteriorated state of the catalytic converter 3 can accurately and appropriately be evaluated based on the average RNFAV of the integrated reducing agent amount data RNF.

The present invention is not limited to the above embodiment, but may be modified as follows:

In the above embodiment, the estimator 21 uses the output KACT of the LAF sensor 4 as the detected value of the upstream-of-catalytic-converter air-fuel ratio (the input to the exhaust system E) in order to determine the estimated differential output VO2 bar. However, since the output KACT of the LAF sensor 4 is controlled at the target air-fuel ratio KCMD, it is possible to determine the estimated differential output VO2 bar by using the data of the target air-fuel ratio KCMD instead of the output KACT of the LAF sensor 4.

In the above embodiment, the gain coefficients a1, a2, b1 of the exhaust system model used for the estimator 21 to determine the estimated differential output VO2 bar are identified by the identifier 20. However, the gain coefficients a1, a2, b1 may be determined from the rotational speed and intake pressure, etc. of the internal combustion engine 1 using a map or the like, or the process of the estimator 21 may be performed using gain coefficients a1, a2, b1 as predetermined fixed values.

For increasing the accuracy of the estimated differential output VO2 bar, however, it is preferable to perform the process of the estimator 21 using the output KACT of the LAF sensor 4 and the identified gain coefficients a1 hat, a2 hat, b1 hat determined by the identifier 20.

In the present embodiment, the exhaust system model is constructed using the differential output kact of the LAF sensor 4 and the differential output VO2 of the $O_2$ sensor 5. However, the exhaust system model may be constructed directly using the output KACT of the LAF sensor 4 and the output VO2/OUT of the $O_2$ sensor 5. Furthermore, the exhaust system model may be expressed according to an equation including autoregressive terms of higher order than those of the equation (1).

In the above embodiment, the exhaust system model is constructed as a discrete-time system. However, the exhaust system model may be constructed as a continuous-time system, and the process of the estimator 21 may be performed based on the model of the continuous-time system.

In the above embodiment, the adaptive sliding mode control process is used to determine the target air-fuel ratio KCMD in the stoichiometric operation mode. However, the target air-fuel ratio KCMD may be determined according to an ordinary sliding mode control process which does not employ an adaptive control law (adaptive algorithm). According to such a modification, the sum of the equivalent control input Ueq and the reaching control law input Urch may be determined as the SLD manipulating input Usl.

The target air-fuel ratio KCMD may be determined according to a feedback control process other than the sliding mode control process in order to converge the estimated value PRE/VO2 of the output of the $O_2$ sensor to the target value VO2/TARGET.

In the above embodiment, the output KACT of the LAF sensor 4 is feedback-controlled at the actually used target air-fuel ratio RKCMD in both the stoichiometric operation mode and the lean operation mode. However, the upstream-of-catalytic-converter air-fuel ratio may be controlled at a lean air-fuel ratio or the target air-fuel ratio KCMD depending on the actually used target air-fuel ratio RKCMD, etc. according to a feed-forward control process.

In the above embodiment, the $O_2$ sensor 5 is used as the exhaust gas sensor disposed downstream of the catalytic converter 3. However, an NOx sensor may be used as the exhaust gas sensor disposed downstream of the catalytic converter 3. Even if an NOx sensor is used, it is possible to estimate the output of the NOx sensor after the dead time of the exhaust system by constructing a suitable model of the exhaust system including the catalytic converter 3. In the stoichiometric operation mode, NOx can be reduced in the catalytic converter 3 by controlling the upstream-of-catalytic-converter air-fuel ratio such that an estimated value of the output of the NOx sensor will be equalized to a desired target value. At this time, the reduced state of NOx, i.e., whether the reduction of NOx in the catalytic converter 3 is completed after the dead time of the exhaust system or not, may be recognized based on the estimated value of the output of the NOx sensor.

Although a certain preferred embodiment of the present invention has been shown and described in detail, it should be understood that various changes and modifications may be made therein without departing from the scope of the appended claims.

What is claimed is:

1. An apparatus for controlling the air-fuel ratio of an exhaust gas from an internal combustion engine, comprising:

a catalytic converter disposed in an exhaust passage of the internal combustion engine, for absorbing a nitrogen oxide in the exhaust gas when the air-fuel ratio of the exhaust gas flowing from an upstream side into the catalytic converter is a lean air-fuel ratio, and reducing the absorbed nitrogen oxide with a reducing agent in the exhaust gas when the air-fuel ratio of the exhaust gas is a stoichiometric air-fuel ratio or a rich air-fuel ratio;

an exhaust gas sensor disposed downstream of said catalytic converter for detecting the concentration of a particular component in the exhaust gas which has passed through said catalytic converter;

estimating means for sequentially generating data representing an estimated value of an output of said exhaust gas sensor after a dead time of an exhaust system which ranges from the upstream side of said catalytic converter to said exhaust gas sensor and includes said catalytic converter;

control means for using a predetermined output value of said exhaust gas sensor when the air-fuel ratio of the exhaust gas entering said catalytic converter is close to said stoichiometric air-fuel ratio, as a target value for the output of said exhaust gas sensor, and selectively executing a control process in a stoichiometric operation mode for controlling the air-fuel ratio of the exhaust gas entering said catalytic converter in order to converge the estimated value, represented by the data generated by said estimating means, of the output of said exhaust gas sensor to said target value and a control process in a lean operation mode for controlling the air-fuel ratio of the exhaust gas entering said catalytic converter at the lean air-fuel ratio, the arrangement being such that said control means executes said control process in the stoichiometric operation mode after executing said control process in the lean operation mode to perform a reducing process to reduce the nitrogen oxide in said catalytic converter; and reduced-state recognizing means for sequentially recognizing a reduced state of the nitrogen oxide in said catalytic converter based on data generated by said estimating means while said control process in the stoichiometric operation mode is being executed in said reducing process;

said control means comprising means for determining whether to switch from said control process in the stoichiometric operation mode to said control process in the lean operation mode or not depending on the reduced state recognized by said reduced-state recognizing means.

2. An apparatus according to claim 1, wherein said reduced state recognized by said reduced-state recognizing means represents a state in which the reduction of said nitrogen oxide in said catalytic converter is completed after the dead time of said exhaust system, and said control means comprises means for inhibiting said control process in the stoichiometric operation mode from switching to said control process in the lean operation mode until said reduced-state recognizing means recognizes the state in which the reduction of said nitrogen oxide in said catalytic converter is completed after the dead time of said exhaust system.

3. An apparatus according to claim 2, wherein said reduced-state recognizing means comprises means for recognizing the state in which the reduction of said nitrogen oxide in said catalytic converter is completed after the dead time of said exhaust system, by comparing the estimated value, represented by the data generated by said estimating means, of the output of said exhaust gas sensor with a predetermined threshold value.

4. An apparatus according to claim 2, further comprising:

reducing agent amount data generating means for generating data representing an integrated amount of said reducing agent given to said catalytic converter until said reduced-state recognizing means recognizes the state in which the reduction of said nitrogen oxide in said catalytic converter is completed after the dead time of said exhaust system after said control process in the stoichiometric operation mode is started, while said control process in the stoichiometric operation mode is being executed in said reducing process; and catalytic converter deterioration evaluating means for evaluating a deteriorated state of said catalytic converter based on the data generated by said reducing agent amount data generating means.

5. An apparatus according to claim 4, further comprising:

absorption saturated-state recognizing means for recognizing whether the absorption of the nitrogen oxide by said catalytic converter is saturated or not while said control process in the stoichiometric operation mode is being executed by said control means;

said catalytic converter deterioration evaluating means comprising means for evaluating the deteriorated state of said catalytic converter based on the data generated by said reducing agent amount data generating means while said control process in the stoichiometric operation mode is being executed, only when said control means switches from said control process in the lean operation mode to said control process in the stoichiometric operation mode after said absorption saturated-state recognizing means recognizes that the absorption of the nitrogen oxide by said catalytic converter is saturated.

6. An apparatus according to claim 5, further comprising:

nitrogen oxide amount data generating means for sequentially generating data representing an integrated amount of the nitrogen oxide given to said catalytic converter while said control process in the lean operation mode is being executed by said control means;

said absorption saturated-state recognizing means comprising means for determining whether the absorption of the nitrogen oxide by said catalytic converter is saturated or not by comparing the integrated amount of the nitrogen oxide represented by the data generated by said nitrogen oxide amount data generating means with a predetermined threshold value.

7. An apparatus according to claim 6, wherein said predetermined threshold value to be compared with the integrated amount of the nitrogen oxide represented by the data generated by said nitrogen oxide amount data generating means is established depending on a latest result of the deteriorated state of said catalytic converter evaluated by said catalytic converter deterioration evaluating means.

8. An apparatus according to claim 7, wherein said control means comprises means for canceling said control process in the lean operation mode and executing said control process in the stoichiometric operation mode when said absorption saturated-state recognizing means recognizes that the absorption of the nitrogen oxide by said catalytic converter is saturated while said control process in the lean operation mode is being executed.

9. An apparatus according to claim 1 or 4, wherein said estimating means comprises means for generating the data representing the estimated value of the output of said exhaust gas sensor according to an algorithm constructed based on a model of said exhaust system, which represents a behavior of the exhaust system regarded as a system for generating the output of said exhaust gas sensor from the air-fuel ratio of the exhaust gas entering said catalytic converter via a response delay element and a dead time element.

10. An apparatus according to claim 9, further comprising:

an air-fuel ratio sensor disposed upstream of said catalytic converter for detecting the air-fuel ratio of the exhaust gas entering said catalytic converter;

said estimating means comprising means for generating the data representing the estimated value of the output of said exhaust gas sensor, using data of the output of said exhaust gas sensor and data of an output of said air-fuel ratio sensor.

11. An apparatus according to claim 10, further comprising:

identifying means for sequentially identifying the value of a parameter to be established of the model of said exhaust system, using the data of the output of said exhaust gas sensor and the data of the output of said air-fuel ratio sensor, while said control process in the stoichiometric operation mode is being executed by said control means;

said estimating means comprising means for generating the data representing the estimated value of the output of said exhaust gas sensor, using the value of the parameter of said model which is identified by said identifying means, as well as the data of the output of said exhaust gas sensor and the data of the output of said air-fuel ratio sensor.

12. An apparatus according to claim 11, wherein the parameter of said model which is identified by said identifying means includes a gain coefficient relative to said response delay element and a gain coefficient relative to said dead time element.

13. An apparatus according to claim 10, wherein said model of the exhaust system comprises a discrete-time system model which expresses the output of said exhaust gas sensor in each control cycle, using the output of said exhaust gas sensor in a past control cycle prior to said control cycle and the output of said air-fuel ratio sensor in a control cycle prior to the dead time of said exhaust system.

14. An apparatus according to claim 11, wherein said model of the exhaust system comprises a discrete-time system model which expresses the output of said exhaust gas sensor in each control cycle, using the output of said exhaust gas sensor in a past control cycle prior to said control cycle and the output of said air-fuel ratio sensor in a control cycle prior to the dead time of said exhaust system.

15. An apparatus according to claim 1, wherein said control process in the stoichiometric operation mode which is executed by said control means comprises a process for generating, according to a feedback control process, a manipulated variable which defines the air-fuel ratio of the exhaust gas entering said catalytic converter in order to converge the estimated value of the output of said exhaust gas sensor which is represented by the data generated by said estimating means to said target value, and manipulating the air-fuel ratio of an air-fuel mixture to be combusted by said internal combustion engine depending on the manipulated variable.

16. An apparatus according to claim 15, wherein said feedback control process comprises a sliding mode control process.

17. An apparatus according to claim 16, wherein said sliding mode control process comprises an adaptive sliding mode control process.

18. An apparatus according to claim 10, wherein said control process in the stoichiometric operation mode which is executed by said control means comprises a process for generating, according to a first feedback control process, a target air-fuel ratio for the exhaust gas entering said catalytic converter in order to converge the estimated value of the output of said exhaust gas sensor which is represented by the data generated by said estimating means to said target value, and manipulating, according to a second feedback control process, the air-fuel ratio of an air-fuel mixture to be combusted by said internal combustion engine in order to converge the air-fuel ratio detected by said air-fuel ratio sensor to said target air-fuel ratio.

19. An apparatus according to claim 18, wherein said first feedback control process comprises a sliding mode control process.

20. An apparatus according to claim 19, wherein said sliding mode control process comprises an adaptive sliding mode control process.

21. An apparatus according to claim 18, wherein said second feedback control process comprises a control process carried out by a recursive-type feedback control means.

* * * * *